US008462063B2

(12) United States Patent
Gummalla et al.

(10) Patent No.: US 8,462,063 B2
(45) Date of Patent: Jun. 11, 2013

(54) METAMATERIAL ANTENNA ARRAYS WITH RADIATION PATTERN SHAPING AND BEAM SWITCHING

(75) Inventors: Ajay Gummalla, Sunnyvale, CA (US); Marin Stoytchev, Chandler, AZ (US); Maha Achour, Encinitas, CA (US); Gregory Poilasne, El Cajon, CA (US)

(73) Assignee: Tyco Electronics Services GmbH (CH)

( * ) Notice: Subject to any disclaimer, the term of this patent is extended or adjusted under 35 U.S.C. 154(b) by 99 days.

(21) Appl. No.: 12/849,623

(22) Filed: Aug. 3, 2010

(65) Prior Publication Data

US 2011/0026624 A1 Feb. 3, 2011

Related U.S. Application Data

(63) Continuation of application No. 12/050,107, filed on Mar. 17, 2008, now Pat. No. 7,855,696.

(60) Provisional application No. 60/918,564, filed on Mar. 16, 2007, provisional application No. 61/016,392, filed on Dec. 21, 2007.

(51) Int. Cl.
*H01Q 9/00* (2006.01)

(52) U.S. Cl.
USPC ..... 343/745; 343/749; 343/700 MS

(58) Field of Classification Search
USPC ..... 343/700 MS, 702, 846, 745, 749, 343/860, 853
See application file for complete search history.

(56) References Cited

U.S. PATENT DOCUMENTS

| | | | |
|---|---|---|---|
| 4,014,024 | A | 3/1977 | Parker et al. |
| 5,511,238 | A | 4/1996 | Bayraktaroglu |
| 5,874,915 | A | 2/1999 | Lee et al. |
| 6,005,515 | A | 12/1999 | Allen et al. |
| 6,366,254 | B1 | 4/2002 | Sievenpiper et al. |
| 6,489,927 | B2 | 12/2002 | LeBlanc et al. |
| 6,512,494 | B1 | 1/2003 | Diaz et al. |
| 6,525,695 | B2 | 2/2003 | McKinzie |
| 6,545,647 | B1 | 4/2003 | Sievenpiper et al. |
| 6,774,850 | B2 | 8/2004 | Chen |
| 6,842,140 | B2 | 1/2005 | Killen et al. |
| 6,859,114 | B2 | 2/2005 | Eleftheriades et al. |
| 6,897,831 | B2 | 5/2005 | McKinzie et al. |
| 6,906,674 | B2 | 6/2005 | McKinzie et al. |
| 6,943,731 | B2 | 9/2005 | Killen et al. |
| 6,950,069 | B2 | 9/2005 | Gaucher et al. |
| 6,958,729 | B1 | 10/2005 | Metz |

(Continued)

FOREIGN PATENT DOCUMENTS

| | | |
|---|---|---|
| JP | 50-037323 | 4/1975 |
| JP | 2006501719 A | 1/2006 |

(Continued)

OTHER PUBLICATIONS

Caloz, Christophe, et al., "Electromagnetic Metamaterials: Transmission Line Theory and Microwave Applications", John Wiley & Sons (2006).

(Continued)

*Primary Examiner* — Tan Ho

(57) ABSTRACT

Apparatus, systems and techniques for using composite left and right handed (CRLH) metamaterial (MTM) structure antenna elements and arrays to provide radiation pattern shaping and beam switching.

22 Claims, 36 Drawing Sheets

U.S. PATENT DOCUMENTS

| | | | | |
|---|---|---|---|---|
| 6,995,711 | B2 | 2/2006 | Killen et al. | |
| 7,068,234 | B2 | 6/2006 | Sievenpiper | |
| 7,071,889 | B2 | 7/2006 | McKinzie et al. | |
| 7,193,562 | B2 | 3/2007 | Shtrom et al. | |
| 7,205,941 | B2 | 4/2007 | Wang et al. | |
| 7,215,007 | B2 | 5/2007 | McKinzie et al. | |
| 7,224,241 | B2 * | 5/2007 | Jue | 333/32 |
| 7,256,753 | B2 | 8/2007 | Werner et al. | |
| 7,330,090 | B2 | 2/2008 | Itoh et al. | |
| 7,358,915 | B2 | 4/2008 | Legay et al. | |
| 7,391,288 | B1 | 6/2008 | Itoh et al. | |
| 7,429,961 | B2 | 9/2008 | Sievenpiper et al. | |
| 7,446,712 | B2 | 11/2008 | Itoh et al. | |
| 7,453,328 | B2 * | 11/2008 | Jue | 333/32 |
| 7,463,213 | B2 | 12/2008 | Nakano et al. | |
| 7,482,893 | B2 | 1/2009 | Itoh et al. | |
| 7,592,957 | B2 | 9/2009 | Achour et al. | |
| 7,764,232 | B2 | 7/2010 | Achour et al. | |
| 7,839,236 | B2 | 11/2010 | Dupuy et al. | |
| 7,855,696 | B2 | 12/2010 | Gummalla et al. | |
| 7,911,386 | B1 | 3/2011 | Itoh et al. | |
| 7,932,863 | B2 | 4/2011 | Pros et al. | |
| 7,952,526 | B2 | 5/2011 | Lee et al. | |
| 7,961,809 | B2 | 6/2011 | Bourdoux et al. | |
| 2003/0011522 | A1 | 1/2003 | McKinzie | |
| 2003/0198475 | A1 | 10/2003 | Tiemann et al. | |
| 2004/0075614 | A1 * | 4/2004 | Dakeya et al. | 343/745 |
| 2004/0075617 | A1 | 4/2004 | Lynch et al. | |
| 2004/0113848 | A1 | 6/2004 | Gaucher et al. | |
| 2004/0164900 | A1 | 8/2004 | Casabona et al. | |
| 2004/0227668 | A1 | 11/2004 | Sievenpiper et al. | |
| 2005/0225492 | A1 | 10/2005 | Metz | |
| 2005/0253667 | A1 | 11/2005 | Itoh et al. | |
| 2006/0066422 | A1 | 3/2006 | Itoh et al. | |
| 2007/0004363 | A1 | 1/2007 | Kusaka et al. | |
| 2007/0010202 | A1 | 1/2007 | Yamamoto et al. | |
| 2007/0085754 | A1 * | 4/2007 | Ella et al. | 343/862 |
| 2007/0176827 | A1 | 8/2007 | Itoh et al. | |
| 2008/0001684 | A1 | 1/2008 | Itoh et al. | |
| 2008/0048917 | A1 | 2/2008 | Achour et al. | |
| 2008/0074332 | A1 | 3/2008 | Arronte et al. | |
| 2008/0204327 | A1 | 8/2008 | Lee et al. | |
| 2008/0231521 | A1 | 9/2008 | Pros et al. | |
| 2008/0258981 | A1 | 10/2008 | Achour et al. | |
| 2008/0258993 | A1 | 10/2008 | Gummalla et al. | |
| 2009/0128446 | A1 | 5/2009 | Gummalla et al. | |
| 2009/0135087 | A1 | 5/2009 | Gummalla et al. | |
| 2009/0160575 | A1 | 6/2009 | Dupuy et al. | |
| 2009/0251385 | A1 | 10/2009 | Zu et al. | |
| 2010/0045554 | A1 | 2/2010 | Xu et al. | |
| 2010/0109971 | A2 | 5/2010 | Gummalla et al. | |
| 2010/0117908 | A2 | 5/2010 | Lee et al. | |
| 2010/0238081 | A1 | 9/2010 | Achour et al. | |
| 2011/0008873 | A1 | 1/2011 | Lipinski et al. | |
| 2011/0039501 | A1 | 2/2011 | Achour et al. | |
| 2011/0156963 | A1 | 6/2011 | Rajgopal et al. | |
| 2011/0273348 | A1 * | 11/2011 | Lopez et al. | 343/749 |
| 2011/0273353 | A1 * | 11/2011 | Achour et al. | 343/850 |

FOREIGN PATENT DOCUMENTS

| | | | |
|---|---|---|---|
| JP | 4918594 | A | 2/2012 |
| KR | 10-2003-0022407 | | 3/2003 |
| KR | 20030086030 | A | 11/2003 |
| KR | 107011754 | B1 | 10/2011 |
| KR | 1086743 | B1 | 11/2011 |
| KR | 10-1119228 | B1 | 2/2012 |
| WO | WO-0108259 | A1 | 2/2001 |
| WO | WO-2007098061 | A3 | 8/2007 |
| WO | WO-2007127955 | A2 | 11/2007 |
| WO | WO-2007127955 | A3 | 11/2007 |
| WO | WO-20070127955 | A2 | 11/2007 |
| WO | WO2008/024993 | | 2/2008 |
| WO | WO-2008024993 | A2 | 2/2008 |
| WO | WO-2008024993 | A3 | 2/2008 |
| WO | WO-2008115881 | A1 | 9/2008 |
| WO | WO-2009049303 | A1 | 4/2009 |
| WO | WO-2009064926 | A1 | 5/2009 |
| WO | WO-2010021854 | A1 | 2/2010 |

OTHER PUBLICATIONS

Collin, Robert E., "Field Theory of Guided Waves", John Wiley & Sons, Inc., 2nd Edition, Dec. 1990.

Engheta, N., et al., Metamaterials: Physics and Engineering Explorations, John Wiley & Sons, Inc., Jul. 2006.

Gesbert, D., et al., "From Theory to Practice: An Overview of MIMO Space-Time Coded Wireless Systems", IEEE Journal Selected Areas in Communications, 21(3): 281-302, Apr. 2003.

Itoh, T., "Invited Paper: Prospects for Metamaterials", Electronics Letters, 40(16):972-973, Aug. 2004.

Jiang, J.-S., et al., "Comparison of Beam Selection and Antenna Selection Techniques in Indoor MIMO Systems at 5.8 GHz", Proceedings Radio and Wireless Conference (RAWCOM), pp. 179-182, Aug. 2003.

Lai, A., et al., "Dual-Mode Compact Microstrip Antenna Based on Fundamental Backward Wave", APMC 2005 Proceedings, vol. 4, pp. 4-7, Dec. 2005.

Lai, A., et al., "Infinite Wavelength Resonant Antennas with Monopolar Radiation Pattern Based on Periodic Structures", IEEE Transactions on Antennas and Propogation, 55(3): 868-876, Mar. 2007.

Lim, S., et al., "Metamaterial-Based Electronically Controlled Transmission-Line Structure as a Novel Leaky-Wave Antenna With Tunable Radiation Angle and Beamwidth," IEEE Transactions on Microwave Theory and Techniques, 52(12):2678-2690, Dec. 2004.

Pozar, D.M., Microwave Engineering, 3rd Ed., John Wiley & Sons, 2005.

Sievenpiper, D.F., "High-Impedance Electromagnetic Surfaces," Ph.D. Dissertation, University of California, Los Angeles, 1999.

Waldschmidt, C., et al., "Compact Wide-Band Multimode Antennas for MIMO and Diversity," IEEE Transactions on Antennas and Propagation, 52(8):1963-1969, Aug. 2004.

Waldschmidt, C., et al., "Complete RF System Model for Analysis of Compact MIMO Arrays," IEEE Transactions on Vehicular Technology, 53(3):579-586, May 2004.

Waldschmidt, C., et al., "Handy MIMO," IEEE Communications Engineer, 3(1):22-25, Feb./Mar. 2005.

International Search Report and Written Opinion dated Aug. 21, 2008 for International Application No. PCT/US2008/057255, filed Mar. 17, 2008 (10 pages).

Lee, C.J., et al., "Design of Resonant Small Antenna Using Composite Right/Left-Handed Transmission Line", Antennas and Propogation Society International Symposium, pp. 218-221 vol. 2B, Jul. 3-8, 2005.

Lai, A., "Composite Right/Left-Handed Transmission Line Metamaterials", IEEE Microwave magazine, pp. 34-50, Sep. 2004.

Lai, A., et al., "Analysis and Design of Left-Handed Metamaterial Lenses Using Ansoft HFSS", UCLA 2005 Annual Research Review, Microwave Electronics Lab, pp. 1-8, Oct. 2005.

Balanis, Constantine, A., "Antenna Theory Analysis and Design", 3rd Edition, Chapter 2, John Wiley & Sons 2005.

Korean Intellectual Property Office Search Report for Korean Patent Application No. 10-2008-7028654, dated Mar. 15, 2010 (4 pages).

"U.S. Appl. No. 12/050,107, Notice of Allowance mailed Jun. 29, 2010", 8 pgs.

"U.S. Appl. No. 12/050,107, Preliminary Amendment mailed Mar. 31, 2009", 3 pgs.

Damm, C., et al., "Artificial Line Phase Shifter with separately tunable Phase and Line Impedance", 36th European Microwave Conference, (2006), 423-426.

Sajin, George, et al., "Silicon Supported Microwave Directional Coupler Metamaterial Approach", International Semiconductor Conference, 2007. CAS 2007., (Oct. 2007), 241-244.

"U.S. Appl. No. 11/741,674, Notice of Allowance mailed May 18, 2010", 14 pgs.

"U.S. Appl. No. 11/741,674, Response filed Apr. 22, 2010 to Restriction Requirement mailed Apr. 15, 2010", 12 pgs.

"U.S. Appl. No. 11/741,674, Restriction Requirement mailed Apr. 15, 2010", 7 pgs.
"U.S. Appl. No. 11/844,982, Final Office Action mailed Jun. 5, 2009", 13 pgs.
"U.S. Appl. No. 11/844,982, Non Final Office Action mailed Feb. 17, 2009", 10 pgs.
"U.S. Appl. No. 11/844,982, Notice of Allowance mailed Jan. 13, 2009", 7 pgs.
"U.S. Appl. No. 11/844,982, Notice of Allowance mailed Jul. 27, 2009", 9 pgs.
"U.S. Appl. No. 11/844,982, Response filed Feb. 20, 2009 to Non Final Office Action mailed Feb. 17, 2009", 27 pgs.
"U.S. Appl. No. 11/844,982, Response filed Jun. 29, 2009 to Final Office Action mailed Jun. 5, 2009", 26 pgs.
"U.S. Appl. No. 12/250,477, Response filed May 15, 2012 to Non Final Office Action mailed Feb. 15, 2012", 18 pgs.
"U.S. Appl. No. 12/250,477, Response filed Sep. 15, 2011 to Restriction Requirement mailed Aug. 15, 2011", 15 pgs.
"U.S. Appl. No. 12/250,477, Non Final Office Action mailed Feb. 15, 2012", 14 pgs.
"U.S. Appl. No. 12/250,477, Preliminary Amendment filed Jan. 28, 2009", 15 pgs.
"U.S. Appl. No. 12/250,477, Restriction Requirement mailed Aug. 15, 2011", 6 pgs.
"U.S. Appl. No. 12/270,410 , Response filed Feb. 7, 2012 to Final Office Action mailed Nov. 7, 2011", 23 pgs.
"U.S. Appl. No. 12/562,114, Notice of Allowance mailed Aug. 6, 2010", 7 pgs.
"U.S. Appl. No. 12/562,114, Preliminary Amendment filed Jun. 7, 2010", 4 pgs.
"U.S. Appl. No. 12/562,114, Preliminary Amendment filed Sep. 17, 2009", 31 pgs.
"U.S. Appl. No. 12/562,114, Preliminary Amendment filed Sep. 22, 2009", 15 pgs.
"U.S. Appl. No. 12/785,226, Final Office Action mailed May 3, 2012", 14 pgs.
"U.S. Appl. No. 12/785,226, Non Final Office Action mailed Aug. 12, 2011", 10 pgs.
"U.S. Appl. No. 12/785,226, Response filed Jan. 12, 2012 to Non Final Office Action mailed Aug. 12, 2011", 13 pgs.
"U.S. Appl. No. 12/785,246 , Response filed Dec. 1, 2011 to Non Final Office Action mailed Aug. 1, 2011", 7 pgs.
"U.S. Appl. No. 12/785,246, Non Final Office Action mailed Feb. 8, 2012", 12 pgs.
"U.S. Appl. No. 12/785,246, Non Final Office Action mailed Aug. 1, 2011", 6 pgs.
"U.S. Appl. No. 12/785,246, Preliminary Amendment filed Oct. 28, 2010", 2 pgs.
"U.S. Appl. No. 12/914,936, Advisory Action mailed Sep. 27, 2011", 3 pgs.
"U.S. Appl. No. 12/914,936, Final Office Action mailed Jul. 21, 2011", 8 pgs.
"U.S. Appl. No. 12/914,936, Non Final Office Action mailed Jan. 6, 2011", 6 pgs.
"U.S. Appl. No. 12/914,936, Non Final Office Action mailed Dec. 28, 2011", 7 pgs.
"U.S. Appl. No. 12/914,936, Notice of Allowance mailed Jun. 11, 2012", 8 pgs.
"U.S. Appl. No. 12/914,936, Response filed Mar. 28, 2012 to Non Final Office Action mailed Dec. 28, 2011", 11 pgs.
"U.S. Appl. No. 12/914,936, Response filed May 6, 2011 to Non Final Office Action mailed Jan. 6, 2011", 11 pgs.
"U.S. Appl. No. 12/914,936, Response filed Sep. 14, 2011 to Final Office Action mailed Jul. 21, 2011", 10 pgs.
"Chinese Application Serial No. 200780024716.3, Office Action mailed Mar. 12, 2012", w/ English Translation, 10 pgs.
"Chinese Application Serial No. 200780024716.3, response to Office Action filed Jul. 27, 2012", w/English Translation, 77 pgs.
"Chinese Application Serial No. 2007800392167, Office Action mailed Apr. 5, 2012", w/English Translation, 4 pgs.
"European Application Serial No. 08732356.4, Extended Search Report mailed Apr. 16, 2012", 11 pgs.
"European Application Serial No. 08838349.2, Search Report mailed Jul. 30, 2012", 7 pgs.
"International Application Serial No. PCT/US2007/067696, International Preliminary Report on Patentability mailed Oct. 28, 2008", 6 pgs.
"International Application Serial No. PCT/US20071067696, International Search Report mailed Jul. 14, 2008", 1 pg.
"International Application Serial No. PCT/US2007/067696, Written Opinion mailed Jul. 14, 2008", 5 pgs.
"International Application Serial No. PCT/US2007/076791, International Preliminary Report on Patentability mailed Mar. 3, 2009", 7 pgs.
"International Application Serial No. PCT/US2007/076791, International Search Report mailed Dec. 12, 2008", 1 pg.
"International Application Serial No. PCT/US2007/076791, Written Opinion mailed Mar. 12, 2008", 6 pgs.
"International Application Serial No. PCT/US2008/079753, International Search Report mailed Jan. 28, 2009", 3 pgs.
"International Application Serial No. PCT/US2008/079753, International Written Opinion mailed Jan. 29, 2009", 5 pgs.
"Japanese Application Serial No. 2009-507995, Office Action mailed Apr. 19, 2011", w/English Translation, 9 pgs.
"Japanese Appiication Serial No. 2009-525799, Non Final Office Action mailed Sep. 13, 2011", w/English Translation, 6 pgs.
"Japanese Application Serial No. 2009-525799, Response filed Nov. 22, 2011 to Office Action mailed Sep. 27, 2011", w/English Translation, 14 pgs.
"Korean Application Serial No. 2010-7011754, Office Action mailed Jan. 21, 2011", w/Engiish Translation, 7 pgs.
"Korean Application Serial No. 10-2008-7028654, Final Office Action mailed Sep. 30, 2010", w/English translation, 6 pgs.
"Korean Application Serial No. 10-2008-7028654, Office Action mailed Dec. 29, 2010", w/English Translation, 5 pgs.
"Korean Application Serial No. 10-2008-7028654, Office Action mailed May 31, 2010", w/English Translation, 16 pgs.
"Korean Application Serial No. 10-2008-7028654, Response filed Oct. 30, 2010 to Final Office Action Sep. 30, 2010", English translation, 7 pgs.
"Korean Application Serial No. 10-2011-7004230, Office Action Mailed May 24, 2012", w/English Translation, 15 Pgs.
"Korean Application Serial No. 2009-7005625, Final Office Action mailed Aug. 29, 2010", English translation, 2 pgs.
"Korean Application Serial No. 2009-7005625, Notice of Allowance mailed Sep. 5, 2011", w/English Translation, 6 pgs.
"Korean Application Serial No. 2009-7005625, Office Action mailed Sep. 29, 2010", w/English Translation, 6 pgs.
"Korean Application Serial No. 2009-7005625, Office Action mailed May 31, 2010", w/English Translation, 5 pgs.
"Korean Application Serial No. 2009-7005625, Response filed Oct. 30, 2010 to Final Office Action mailed Sep. 29, 2010", English translation, 3 pgs.
"Korean Application Serial No. 2010-7007682, Final Office Action mailed Apr. 25, 2011", w/English Translation, 9 pgs.
"Korean Application Serial No. 2010-7007682, Office Action mailed Jul. 23, 2010", w/English Translation, 14 pgs.
"Korean Application Serial No. 2010-7009769, Final Office Action mailed Dec. 23, 2010". w/English translation, 7 pgs.
"Korean Application Serial No. 2010-7009769, Office Action mailed Jul. 23, 2010", w/English translation, 12 pgs.
"Korean Application Serial No. 2010-7009770, Final Office Action mailed Dec. 23, 2010", with English translation, 6 pgs.
"Korean Application Serial No. 2010-7009770, Response filed Sep. 23, 2010 to Office Action mailed Jul. 23, 2010", English translation, 14 pgs.
"Korean Application Serial No. 2010-7011754, Office Action mailedAug. 18, 2010", w/English Translation, 12 pgs.
"Korean Application Serial No. 2010-7011754, Response filed Oct. 18, 2010 to Office Aaction mailed Aug. 18, 2010", English Translation Only, 9 pgs.
"Korean Application Serial No. 2010-7011755, Final Office Action mailed Jan. 21, 2011", w/English Translation, 11 pgs.
"Korean Application Serial No. 2010-7011755, Office Action mailed Aug. 18, 2010", w/English Translation, 16 pgs.

"Korean Application Serial No. 2010-7011755, Response filed Oct. 18, 2010 to Office Action mailed Aug. 18, 2010", English Translation Only, 17 pgs.
"Korean Application Serial No. 2011-7004230, Response filed Jul. 24, 2012 to Office Action mailed May 24, 2012", w/English claims, 26 pgs.
"Korean Application Serial No. Korean Application Serial No. 2010-7009770, Office Action mailed Jul. 23, 2010", English Translation, 6 pgs.
"Taiwan Application Serial No. 97139201, Office Action maiied Mar. 22, 2012", w/English Translation, 13 pgs.
"Taiwanese Application Serial No. 1-2008-02876, Office Action mailed May 4, 2010", English translation, 6 pgs.
"Taiwanese Application Serial No. 1-2008-02876, Response filed Jun. 28, 2010 to Office Action mailed May 4, 2010", w/English claims, 21 pgs.
"Taiwanese Application Serial No. 1-2009-00589, Office Action mailed Jan. 18, 2011", English translation, 2 pgs.
"Taiwanese Application Serial No. 96115082, Office Action maiied Feb. 14, 2011", w/English translation, 5 pgs.
"Taiwanese Application Serial No. 96115082, Office Action mailed Nov. 2, 2011", w/English Translation, 5 pgs.
"Taiwanese Application Serial No. 97139201, Response filed Jul. 4, 2012 to Office Action mailed Mar. 22, 2012", w/English Translation, 32 pgs.
Caloz, Christophe, et al., "Guided-Wave Applications", Electromagnetic Metamaterials: Transmission Line Theory and Microwave Applications, (2006), 192-260.
Caloz, Christophe, "Radiated-Wave Applications", Electromagnetic Metamaterials, ISBN: 978-0-47-166985-2, (Nov. 7, 2005), 261-315.
Cheng-Jung, L, et al., "Design of resonate small antenna using composite right/left-handed transmission lines", Antennas and propagation Society International Symposium, (Jul. 8, 2005), 218-221.
Choi, S H, et al., "A new ultra-wideband antenna for UWB applications", Microwave and Optical Technology Letters, 40(5), (Mar. 5, 2004), 399-401.
Eleftheriades, G V, et al., "Negative-refractive-index transmission-line metamaterials and enabling electromagnetic applications", Antennas and Propagation Society International Symposium, (Jun. 2004), 1399-1402.
Eleftheriades, George V, "Two-Dimensional Planar Negative-Index Structures", Metamaterials: Physics and Engineering Explorations, Chapter 5, (Sep. 20, 2006), 143-169.
Gummalla, et al., "U.S. Appl. No. 61/091,203, Information Disclosure Statement mailed Aug. 22, 2008", Metamaterial Antenna Structures with Non-Linear Coupling Geometry.
Herraiz-Martinez, Francisco Javier, et al., "Multi-frequency microstrip patch antennas based on metamaterial structures", IEEE Antennas and Propagation Society International Symposium 2007, (2007), 3484-3487.
Huang, W., et al., "Composite Right-Left Handed Metamaterial ultra-wideband antenna", IEEE International Workshop on Antenna Technology, 2009. iWAT 2009., (2009), 1-4.
Lai, Anthony, "Infinate Wavelength Resonant Antennas With Monopolar Rapiciaton Pattern Based on periodic structures", 9 pgs.
Lim, S., et al., "A Reflecto-Directive System Using a Composite Right/Left-Handed (CRLH) Leaky-Wave Antenna and Heterodyne Mixing", IEEE Mircrowave and Wireless Components Letters, vol. 14, No. 4, (Apr. 2004), 183-185.
Liu, C., et al., "Frequency-Scanned Leaky-Wave Antenna from Negative Refractive Index Transmission Lines", 2nd European Conference on Antennas and Propagation (EuCAP 2007), (Nov. 2007), 4 pgs.
Park, Jae-Hyun, et al., "Compact Spiral Zeroth-order Resonance Antenna using metamaterial transmission line", Journal of the Institute of Electronics Engineers of Korea. TC, Telecommunication, 44(7), University Paper, (2007), 6 pgs.
Rahmat-Samii, Yahya, at al., "Development of Complex Artificial Ground Planes in Antenna Engineering", Metamaterials: Physics and Engineering Explorations, (Sep. 20, 2006), 313-349.
Samada. A, et al., "A planar zeroth-order resonator antenna using a left-handed transmission line", 34th European Microwave Conference, 2004, vol. 3, (2004), 1341-1344.
Sanada, A., et al., "A via-free microstrip left-handed transmission line", 2004 IEEE MTT-S International Microwave Symposium Digest, vol. 1, (2004), 301-304.
Sato, K., "Composite right/left-handed leaky wave antenna for millimeter-wave automotive applications", First European Conference on Antennas and Propagation, 2006. EuCAP 2006, (2006), 1-4.
Simion, S., et al., "CPW Antenna Fabricated on Silicon Substrate, Based on Transmission Line Metamaterial Approach", ICEAA 2007. international Conference on Electromagnetics in Advanced Applications, 2007, (2007), 488-491.
Sungjoon, L. et al., "A reflecto-directive system using a composite right/left-handed (CRLH) leaky-wave antenna and heterodyne mixing", Microwave and Wireless Component Letter, (Apr. 30, 2004), 183-185.
Vendik, O. G, et al., "Electronically controlled phase shifters based on right/left-handed transmission lines", 2005 European Microwave Conference, vol. 2, (2005).
Wu, Chien-Hung, et al., "A novel small planar antenna utilizing cascaded right/left-handed transmission lines", 2007 IEEE Antennas and Propagation Society International Symposium, (2007), 1889-1892.

* cited by examiner

Phase Offset = 0°

Phase Offset = 90°

XY-plane

XZ-plane

YZ-plane

XY-plane

XZ-plane

YZ-plane

| X1= 2.88GHz<br>Y1= -6.06 | X2= 3.54GHz<br>Y2= -5.99 | X3= 3.09GHz<br>Y3= -15.52 | X4= 2.88GHz<br>Y4= -15.38 |
|---|---|---|---|

METAMATERIAL ANTENNA ARRAYS WITH RADIATION PATTERN SHAPING AND BEAM SWITCHING

PRIORITY CLAIMS

This application is a continuation of U.S. patent application Ser. No. 12/050,107 entitled "Metamaterial Antenna Arrays With Radiation Pattern Shaping and Beam Switching" and filed on Mar. 17, 2008, now issued as U.S. Pat. No. 7,855,696, which claims the benefit of U.S. Provisional Application Ser. No. 60/918,564 entitled "Metamaterial Antenna Array with Beamforming and Beam-Switching" and filed on Mar. 16, 2007. The disclosures of the above patent applications are incorporated by reference as part of the specification of this application.

BACKGROUND

This application relates to metamaterial (MTM) structures and their applications for radiation pattern shaping and beam-switching.

The propagation of electromagnetic waves in most materials obeys the right handed rule for the (E,H,β) vector fields, where E is the electrical field, H is the magnetic field, and β is the wave vector. The phase velocity direction is the same as the direction of the signal energy propagation (group velocity) and the refractive index is a positive number. Such materials are "right handed" (RH). Most natural materials are RH materials. Artificial materials can also be RH materials.

A metamaterial has an artificial structure. When designed with a structural average unit cell size p much smaller than the wavelength of the electromagnetic energy guided by the metamaterial, the metamaterial can behave like a homogeneous medium to the guided electromagnetic energy. Unlike RH materials, a metamaterial can exhibit a negative refractive index with permittivity ∈ and permeability μ being simultaneously negative, and the phase velocity direction is opposite to the direction of the signal energy propagation where the relative directions of the (E,H,β) vector fields follow the left handed rule. Metamaterials that support only a negative index of refraction with permittivity ∈ and permeability ∈ being simultaneously negative are "left handed" (LH) metamaterials.

Many metamaterials are mixtures of LH metamaterials and RH materials and thus are Composite Left and Right Handed (CRLH) metamaterials. A CRLH metamaterial can behave like a LH metamaterial at low frequencies and a RH material at high frequencies. Designs and properties of various CRLH metamaterials are described in, Caloz and Itoh, "Electromagnetic Metamaterials: Transmission Line Theory and Microwave Applications," John Wiley & Sons (2006). CRLH metamaterials and their applications in antennas are described by Tatsuo Itoh in "Invited paper: Prospects for Metamaterials," Electronics Letters, Vol. 40, No. 16 (August, 2004).

CRLH metamaterials can be structured and engineered to exhibit electromagnetic properties that are tailored for specific applications and can be used in applications where it may be difficult, impractical or infeasible to use other materials. In addition, CRLH metamaterials may be used to develop new applications and to construct new devices that may not be possible with RH materials.

SUMMARY

This application includes apparatus, systems and techniques for using MTM antenna elements and arrays to provide radiation pattern shaping and beam switching.

In one aspect, an antenna system includes antenna elements that wirelessly transmit and receive radio signals, each antenna element configured to include a composite left and right handed (CRLH) metamaterial (MTM) structure; a radio transceiver module in communication with the antenna elements to receive a radio signal from or to transmit a radio signal to the antenna elements; a power combining and splitting module connected in signal paths between the radio transceiver module and the antenna elements to split radio power of a radio signal directed from the radio transceiver module to the antenna elements and to combine power of radio signals directed from the antenna elements to the radio transceiver module; switching elements that are connected in signal paths between the power combining and splitting module and the antenna elements, each switching element to activate or deactivate at least one antenna element in response to a switching control signal; and a beam switching controller in communication with the switching elements to produce the switching control signal to control each switching element to activate at least one subset of the antenna elements to receive or transmit a radio signal.

One implementation of the above system can include a dielectric substrate on which the antenna elements are formed; a first conductive layer supported by the dielectric substrate and patterned to comprise (1) a first main ground electrode that is patterned to comprise a plurality of separate coplanar waveguides to guide and transmit RF signals, (2) a plurality of separate cell conductive patches that are separated from the first main ground electrode, and (3) a plurality of conductive feed lines. Each conductive feed line includes a first end connected to a respective coplanar waveguide and a second end electromagnetically coupled to a respective cell conductive patch to carry a respective RF signal between the respective co-planar waveguide and the respective cell conductive patch. This implementation includes a second conductive layer supported by the dielectric substrate that is separate from and parallel to the first conductive layer. The second conductive layer is patterned to include (1) a second main ground electrode in a footprint projected to the second conductive layer by the first ground electrode, (2) cell ground conductive pads that are respectively located in footprints projected to the second conductive layer by the cell conductive patches, and (3) ground conductive lines that connect the cell ground conductive pads to the second main ground electrode, respectively. Cell conductive via connectors are formed in the substrate, each cell conductive via connection connecting a cell conductive patch in the first conductive layer and a cell ground pad in the second conductive layer in the footprint projected by the cell conductive path and ground via connectors are formed in the substrate to connect the first main ground electrode in the first conductive layer and the second main ground electrode in the second conductive layer. Each cell conductive patch, the substrate, a respective cell conductive via connector and the cell ground conductive pad, a respective co-planar waveguide, and a respective electromagnetically coupled conductive feed line are structured to form a composite left and right handed (CRLH) metamaterial structure as one antenna element.

In another aspect, an antenna system includes antenna arrays and pattern shaping circuits that are respectively coupled to the antenna arrays. Each antenna array is configured to transmit and receive radiation signals and includes antenna elements that are positioned relative to one another to collectively produce a radiation transmission pattern. Each antenna element includes a composite left and right handed (CRLH) metamaterial (MTM) structure. Each pattern shaping circuit supplies a radiation transmission signal to a respective antenna array and produces and directs replicas of the radiation transmission signal with selected phases and amplitudes to the antenna elements in the antenna array, respectively, to generate a respective radiation transmission pattern associated with the antenna array. This system also includes an antenna switching circuit coupled to the pattern shaping circuits to supply the radiation transmission signal to at least one of the pattern shaping circuits and configured to selectively direct the radiation transmission signal to at least one of the antenna arrays at a time to transmit the radiation transmission signal.

In another aspect, an antenna system includes antenna elements. Each antenna element is configured to include a composite left and right handed (CRLH) metamaterial (MTM) structure. This system includes pattern shaping circuits, each of which is coupled to a subset of the antenna elements and operable to shape a radiation pattern associated with the subset of the antenna elements. An antenna switching circuit is included in this system and is coupled to the pattern shaping circuits that activates at least one subset at a time to generate the radiation pattern associated with the at least one subset. The activation is switched among the subsets as time passes based on a predetermined or adaptive control logic.

In yet another aspect, a method of shaping radiation patterns and switching beams based on an antenna system having antenna elements includes receiving a main signal from a main feed line; providing split paths from the main feed line by using a radial power combiner/divider, to transmit a signal on each path to one of a plurality of pattern shaping circuits; shaping a radiation pattern associated with a subset of antenna elements by using the pattern shaping circuit that is coupled to the subset; and activating at least one subset at a time to generate the radiation pattern associated with the at least one subset. The activation is switched among the subsets as time passes based on predetermined or adaptive control logic and a composite left and right handed (CRLH) metamaterial (MTM) structure is used to form each of the antenna elements.

These and other implementations and their variations are described in detail in the attached drawings, the detailed description and the claims.

Figure 1A:
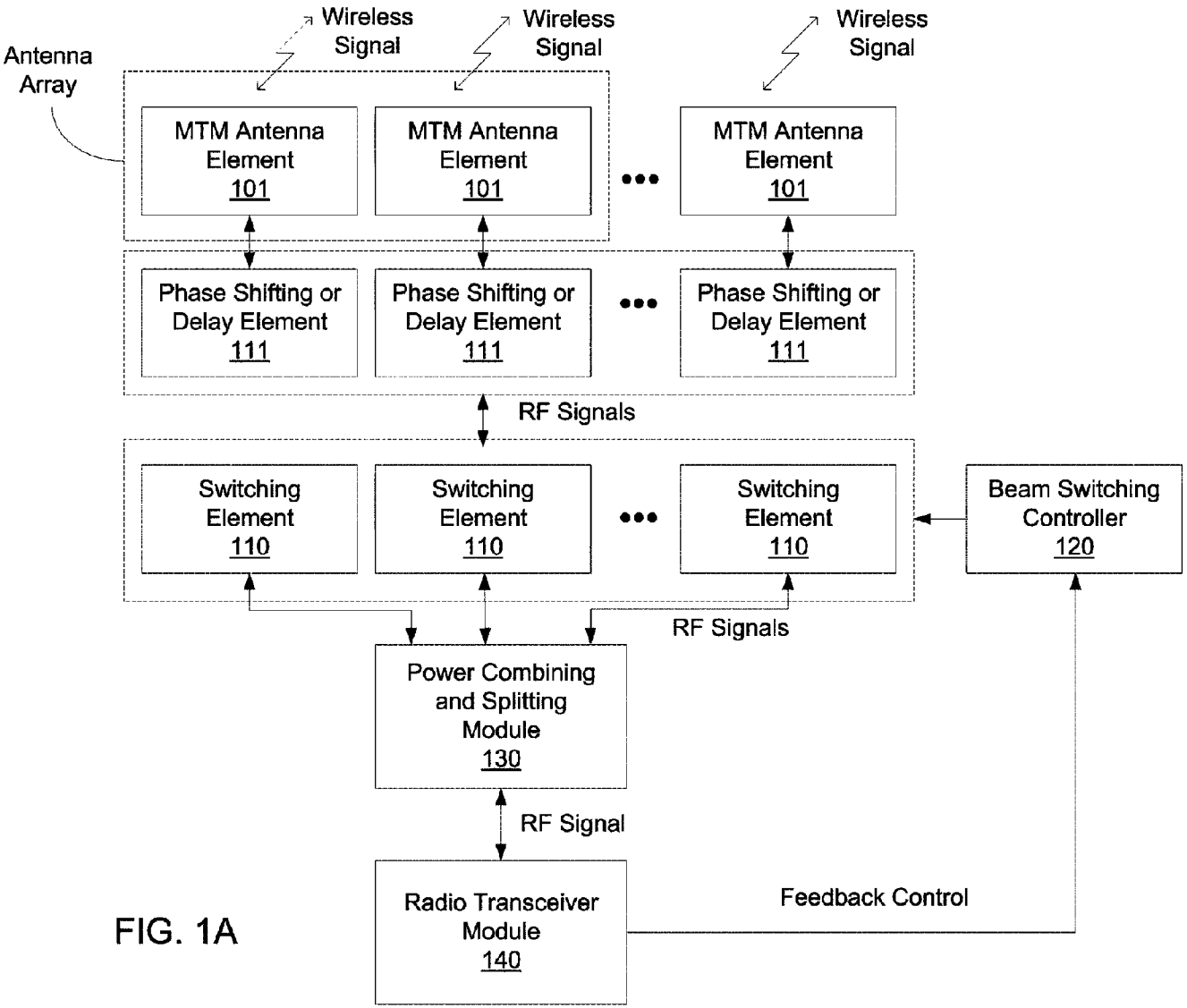
FIGS. 1A, 1B and 1C show examples of MTM antenna systems having MTM antenna arrays with radiation pattern shaping and beam switching.

In the appended figures, similar components and/or features may have the same reference numeral. Further, various components of the same type may be distinguished by following the reference numeral by a dash and a second label that distinguishes among the similar components. If only the first reference numeral is used in the specification, the description is applicable to any one of the similar components having the same first reference numeral irrespective of the second reference numeral.

DETAILED DESCRIPTION

Metamaterial (MTM) structures can be used to construct antennas and other electrical components and devices. The present application describes examples of multiple MTM antennas configured to be used in WiFi access points (AP), base-stations, micro base-stations, laptops, and other wireless communication devices that require higher Signal-to-Noise Ratio (SNR) to increase the throughput and range, while at the same time minimizing interference. The present application describes, among others, techniques, apparatuses and systems that employ composite left and right handed (CRLH) metamaterials for shaping radiation patterns and beam-switching antenna solutions.

Specifically, the antenna array designs in this application use CRLH metamaterials to construct compact antenna arrays in a radiation pattern shaping and beam switching antenna system. Arrays of multiple MTM antennas are used to build an antenna system that is capable of switching among multiple beam patterns depending on an operational requirement or preference, e.g., the wireless link communication status. Such an antenna system using antennas made from CRLH metamaterials can be designed to retain the benefits of the conventional smart antenna systems and provide additional benefits that are not available or difficult to achieve with conventional smart antenna systems. The reduction in antenna size based on MTM structures allows CRLH MTM antenna arrays to be adapted for a wide range of antenna improvements.

In the examples described in this application, each beam pattern is created from a single antenna element or by combining signals from a corresponding antenna subset of multiple antenna elements. The layout of the antenna elements within the antenna array is geometrically designed in conjunction with a single antenna pattern and desired beam patterns. Various techniques to shape radiation patterns are presented in this application. Some examples include phase-shifting, power combining and coupling circuits.

The described antenna systems implement an antenna switching circuit that activates at least one subset of the beam patterns based on the communication link status or other requirements. Switching elements, such as diodes and RF switch ICs, are used along the traces connecting the antenna elements to a power combining and splitting module that interfaces with the RF transceiver module. The switching elements may be placed at a distance that is multiple of $\lambda/2$, where $\lambda$ is the wavelength of the propagating wave, from the radial power combining and splitting module to improve matching conditions. The RF transceiver module includes an analog front end connected to the power combining and splitting module, an analog-to-digital conversion block, and a digital signal processor in the backend that performs digital processing on a received signal and generates an outgoing transmission signal. This digital processor can perform various signal processing operations on a received signal, such as evaluating the packet error rate of the received signal or determining the relative signal strength intensity (RSSI) of the received signal.

The MTM radiation pattern shaping and beam switching antenna system can support multiple bands provided that the switches or diodes are multi-bands as well. The radial power combiner/divider, couplers, and delay lines can be designed to support multiple bands. In some implementations, Electromagnetic Band Gap (EBG) structures can be printed in the vicinity of antennas to modify antenna radiation patterns.

The antenna systems described in this application can be formed on various circuit platforms. For example, FR-4 printed circuit boards can be used to support the RF structures and antenna elements described in this application. In addition, the RF structures and antenna elements described in this application can be implemented by using other fabrication techniques, such as but not limited to, thin film fabrication techniques, system on chip (SOC) techniques, low temperature co-fired ceramic (LTCC) techniques, and monolithic microwave integrated circuit (MMIC) techniques.

Figure 1B:
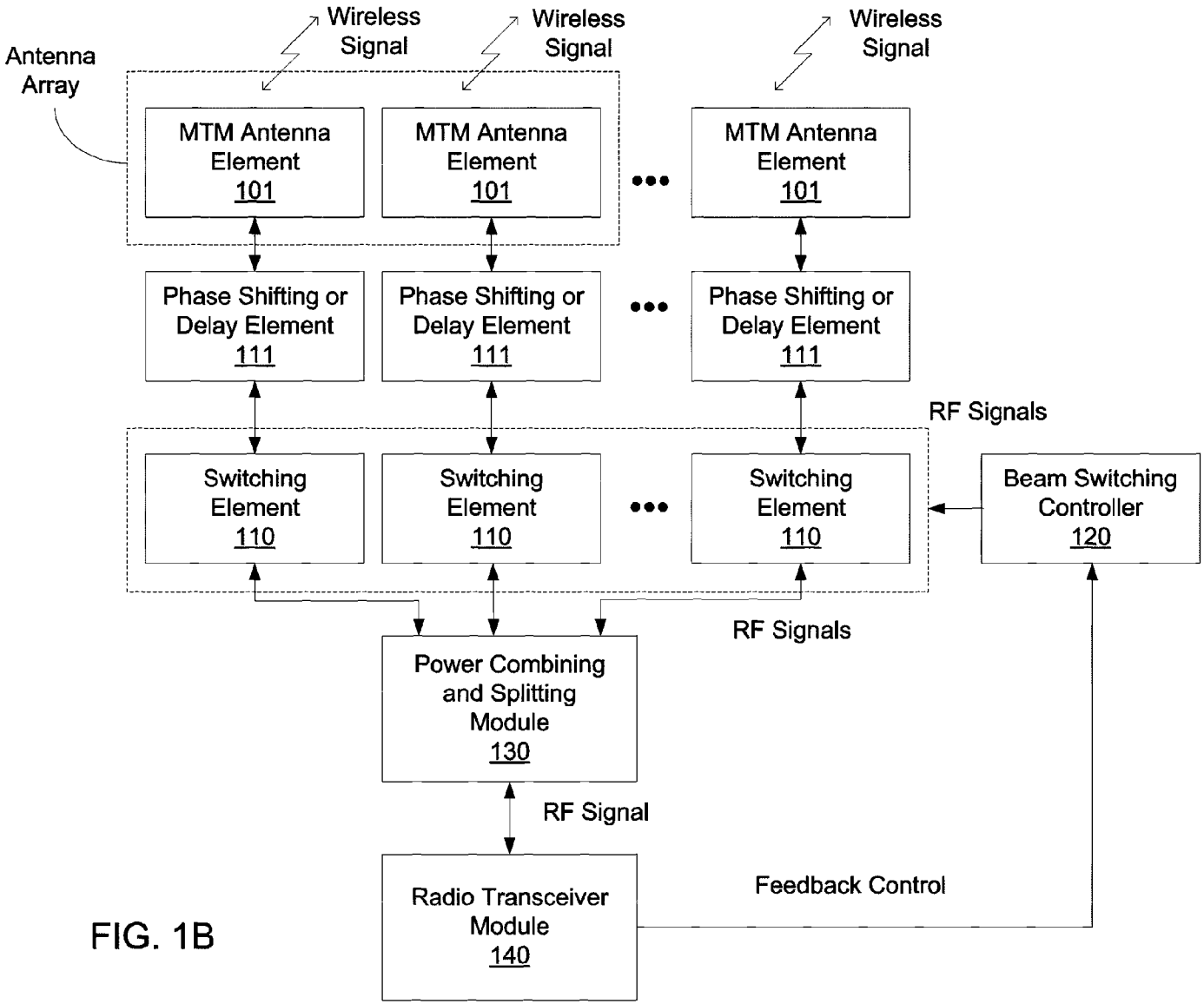
Figure 1C:
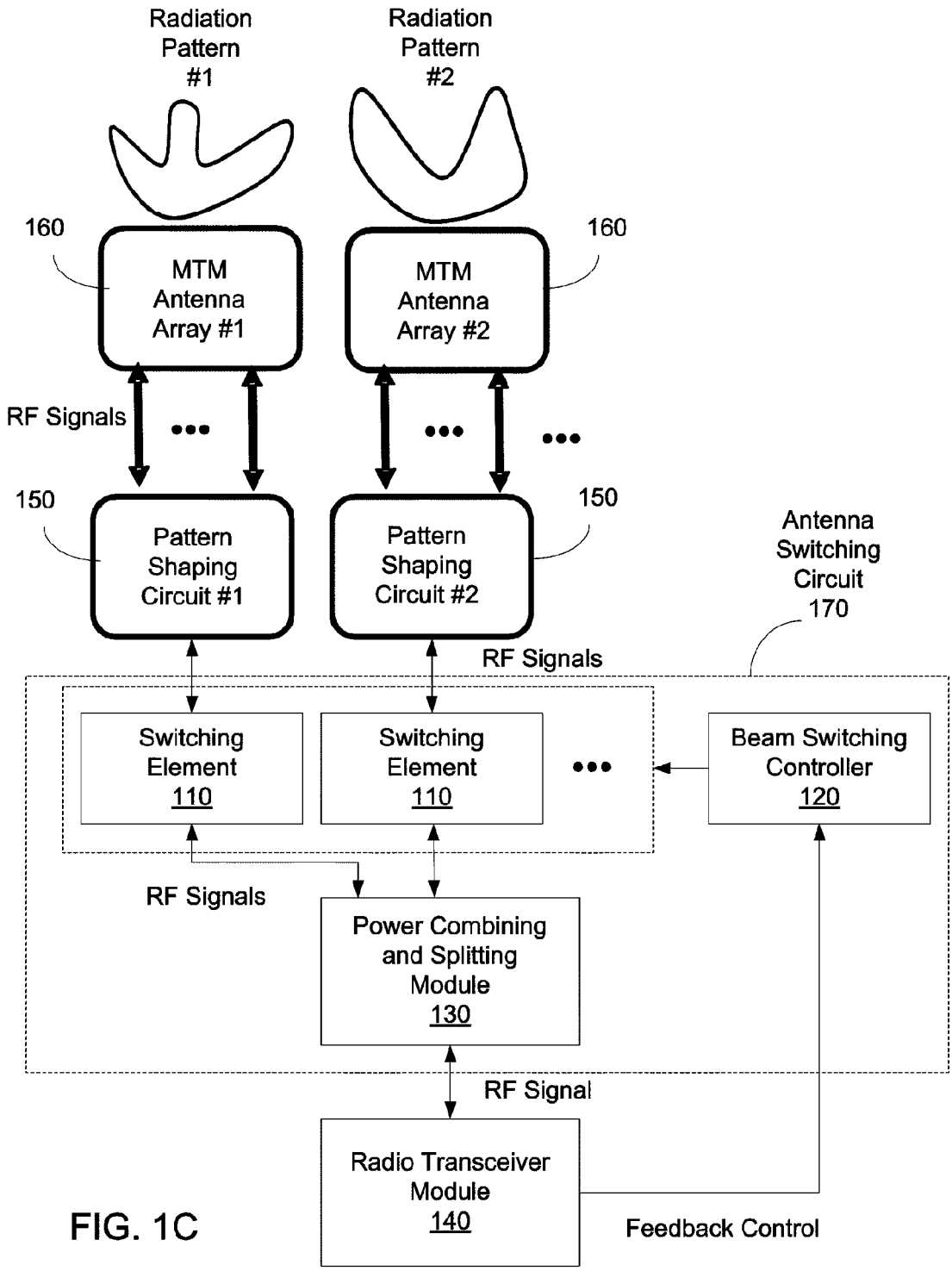

FIGS. 1A, 1B and 1C show examples of MTM antenna systems having MTM antenna arrays with radiation pattern shaping and beam switching. These systems include antenna elements 101 that wirelessly transmit and receive radio signals and each antenna element 101 is configured to include a composite left and right handed (CRLH) metamaterial (MTM) structure. A radio transceiver module 140 is provided to be in communication with the antenna elements 101 to receive a radio signal from or to transmit a radio signal to the antenna elements 101. A power combining and splitting module 130 is connected in signal paths between the radio transceiver module 140 and the antenna elements to split radio power of a radio signal directed from the radio transceiver module to the antenna elements and to combine power of radio signals directed from the antenna elements 101 to the radio transceiver module 140. Switching elements 110 are connected in signal paths between the power combining and splitting module 130 and the antenna elements 101 and each switching element 110 is operated to activate or deactivate at least one antenna element 101 in response to a switching control signal from a beam switching controller 120. The beam switching controller 120 is in communication with the switching elements 110 to produce the switching control signal to control each switching element 110 to activate at least one subset of the antenna elements 101 to receive or transmit a radio signal. Each switching element 110 can be used to activate or deactivate the signal path between a single antenna element 101 and the power combining and splitting module 130 as shown in FIG. 1B. Alternatively, each switching element 110 can be used to activate or deactivate the signal path between two or more antenna elements 101 and the power combining and splitting module 130 as shown in FIG. 1C.

Phase shifting elements or delay lines 111 are also provided in signal paths between the antenna elements 101 and power combining and splitting module 130 to control a radiation pattern produced by each subset of the antenna elements 101 activated by the switching elements 110. In this example, the phase shifting elements or delay lines 111 are in the signal paths between the antenna elements 101 and the switching elements 110. This control of the relative phase or delay between two or more adjacent antenna elements 101 can be combined with control over the amplitudes of the signals associated with the antenna elements to control the radiation pattern of each subset of the antenna elements 101. The antenna elements in one subset can be adjacent antenna elements as an antenna array. When different subsets are activated, the system has multiple antenna arrays. Such a system can be operated to activate one subset of antenna elements 101 at a time or two or more subsets of antenna elements 101 at the same time.

The beam switching controller 120 can be pre-programmed with selected switching configurations for the switching elements 101. As an option, a feedback control can be provided to use the beam switching controller 120 to control the switching elements 110 based on the signal quality of the received signal by the antenna elements 101. The radio transceiver module 140 includes a digital signal processor that can be configured to process a received radio signal from the antenna elements 101 to evaluate a signal performance parameter. The signal performance parameter is then used to produce a feedback control signal based on the signal performance parameter to control the beam switching controller 120 which in turn reacts to the feedback control signal to control a switching status of the switching elements 101 so that the evaluated signal performance in the received signal is improved. The packet error rate and the relative signal strength intensity, for example, can be used to evaluate the signal quality of the signal received by the antenna elements 101.

As another option, the beam switching control 120 can be configured to execute through the following operation modes of a scanning mode, a locked mode, a re-scanning mode, and a MIMO (multiple input multiple output) mode when converging toward the optimal beam pattern suitable for communication environment at a specific location and time. The scanning mode is the initialization process where wider beams are used first to narrow down the directions of the strong paths before transitioning to narrower beams. Multiple directions may exhibit the same signal strength. These patterns are stamped with client information and time before being logged in memory. In the locked mode, the switching configuration that exhibits the best signal quality (e.g., the highest signal strength) is used to transmit and receive signals. If the link starts showing lower signal quality performance, the re-scanning mode is triggered and the beam switching controller 120 exits the locked mode and changes the switching configuration of the switching elements 110 to other switching configurations, e.g., the pre-selected switching configurations for certain beam patterns logged in memory. If none of these pre-selected switching configurations produces the satisfactory signal quality, the system then initiates the MIMO mode to find the directions of strong multipath links and then lock the MIMO multiple antenna patterns to these directions. Hence, multiple subsets of the antennas are operating simultaneously and each connected to the MIMO transceiver.

FIG. 1C shows another example of an MTM antenna system having MTM antenna arrays with radiation pattern shaping and beam switching. Each MTM antenna array 160 includes two or more antenna elements 101 and is connected to a pattern shaping circuit 150 designated to that array 160. Different antenna arrays 160 have different pattern shaping circuits 150. Each pattern shaping circuit 150 is used to supply a radiation transmission signal to a respective antenna array 160 and to produce and direct replicas of the radiation transmission signal with selected phases and amplitudes to the antenna elements 101 in the antenna array 160, respectively, to generate a respective radiation transmission pattern associated with the antenna array 160.

For example, each pattern shaping circuit 150 controls the phase values and amplitudes of the signals to the antenna elements 101 in that array 150 to create a particular radiation pattern to have increased gain in certain directions. The pattern shaping circuit 150 can, for example, include phase shifting or delay elements 111 shown in FIGS. 1A and 1B. In this example, one switching element 110 is connected to only one designated pattern shaping circuit 150 and different pattern shaping circuits 150 are connected to different switching elements 110. The switching elements, the beam switching controller 120 and the power combining and splitting module 130 collectively form an antenna switching circuit 170 that is coupled to the pattern shaping circuits 150 to supply the radiation transmission signal to at least one pattern shaping circuit 150 and configured to selectively direct the radiation transmission signal to at least one of the antenna arrays at a time to transmit the radiation transmission signal. Exemplary implementations of this antenna switching circuit 170 are described in this specification.

In FIG. 1C, the antenna switching circuit 170 is shown to receive a feedback control from the radio transceiver module 140. This feedback control can be a dynamic signal that varies in time due to changing signal conditions. The digital signal processor in the radio transceiver module 140 can monitor the signal conditions and inform the antenna switching circuit 170 of the changing signal conditions and the control logic of the antenna switching circuit 170 can adjust the beamforming pattern and beam switching to dynamically improve the antenna system performance. In operation, the antenna switching circuit 170 activates at least one subset or antenna array of the antenna elements at a time to generate the radiation pattern associated with the at least one subset. The activation is switched among the subsets as time passes based on a predetermined or adaptive control logic.

The MTM antenna systems described in this application can be implemented in ways that provide significant advantages over other antenna systems in terms of size and performance. Due to the current distribution in the MTM antenna structure, these antenna elements can be closely spaced with minimal interaction between adjacent antenna elements. This feature can be used to obtain compact antenna arrays with a desired radiation pattern. Examples of some MTM antenna structures that can be used to implement the present antenna systems are described in U.S. patent application Ser. No. 11/741,674 entitled "Antennas, Devices, and Systems Based on Metamaterial Structures," filed on Apr. 27, 2007, and U.S. patent application Ser. No. 11/844,982 entitled "Antennas Based on Metamaterial Structures," filed on Aug. 24, 2007, which are incorporated by reference as part of the specification of this application.

An MTM antenna or transmission line can be treated as a MTM structure with one or more MTM unit cells. The equivalent circuit for each MTM unit cell has a right-handed (RH) series inductance LR, a shunt capacitance CR and a left-handed (LH) series capacitance CL, and a shunt inductance LL. The shunt inductance LL and the series capacitance CL are structured and connected to provide the left handed properties to the unit cell. This CRLH TL can be implemented by using distributed circuit elements, lumped circuit elements or a combination of both. Each unit cell is smaller than $\lambda/10$ where $\lambda$ is the wavelength of the electromagnetic signal that is transmitted in the CRLH TL or antenna.

A pure LH material follows the left hand rule for the vector trio (E,H,$\beta$) and the phase velocity direction is opposite to the signal energy propagation. Both the permittivity and permeability of the LH material are negative. A CRLH Metamaterial can exhibit both left hand and right hand electromagnetic modes of propagation depending on the regime or frequency of operation. Under certain circumstances, a CRLH metamaterial can exhibit a non-zero group velocity when the wavevector of a signal is zero. This situation occurs when both left hand and right hand modes are balanced. In an unbalanced mode, there is a bandgap in which electromagnetic wave propagation is forbidden. In the balanced case, the dispersion curve does not show any discontinuity at the transition point of the propagation constant $\beta(\omega_o)=0$ between the Left and Right handed modes, where the guided wavelength is infinite $\lambda_g=2\pi/|\beta|\rightarrow\infty$ while the group velocity is positive:

$$v_g = \frac{d\omega}{d\beta}\bigg|_{\beta=0} > 0$$

This state corresponds to the Zeroth Order mode m=0 in a Transmission Line (TL) implementation in the LH handed region. The CRLH structure supports a fine spectrum of low frequencies with a dispersion relation that follows the negative $\beta$ parabolic region which allows a physically small device to be built that is electromagnetically large with unique capabilities in manipulating and controlling near-field radiation patterns. When this TL is used as a Zeroth Order Resonator (ZOR), it allows a constant amplitude and phase resonance across the entire resonator. The ZOR mode can be used to build MTM-based power combiners and splitters or dividers, directional couplers, matching networks, and leaky wave antennas. Examples of MTM-based power combiners and dividers are described below.

In RH TL resonators, the resonance frequency corresponds to electrical lengths $\theta_m=\beta_m l=m\pi$ (m=1, 2, 3, . . . ), where l is the length of the TL. The TL length should be long to reach low and wider spectrum of resonant frequencies. The operating frequencies of a pure LH material are at low frequencies. A CRLH metamaterial structure is very different from RH and LH materials and can be used to reach both high and low spectral regions of the RF spectral ranges of RH and LH materials. In the CRLH case $\theta_m=\beta_m l=m\pi$, where l is the length of the CRLH TL and the parameter m=0, ±1, ±2, ±3, . . . , ±∞.

Figure 2:
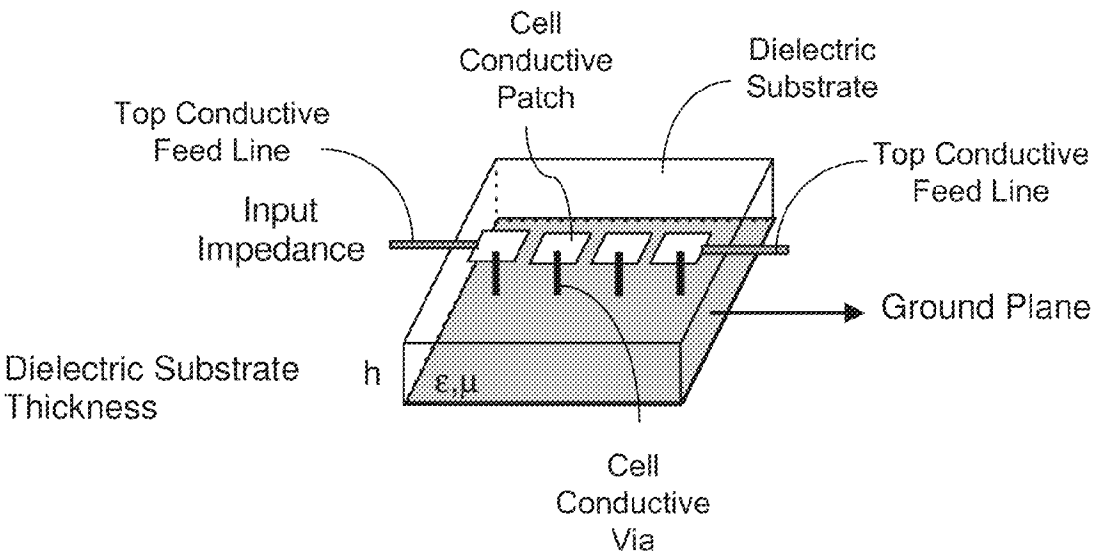
FIG. 2 shows an example of a CRLH MTM transmission line with four unit cells.
Figure 2A:
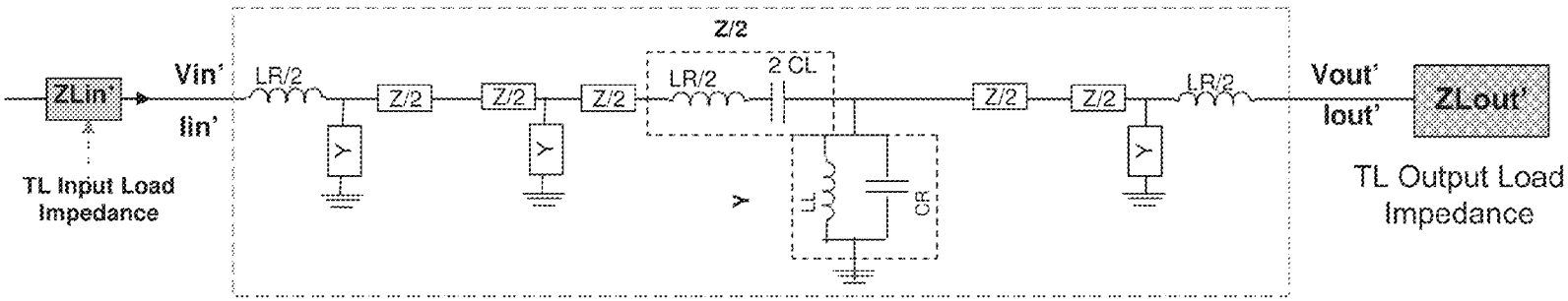
FIGS. 2A, 2B, 2C, 2D, 3A, 3B and 3C show equivalent circuits of the device in FIG. 2 under different conditions in transmission line mode and antenna mode.
Figure 2C:
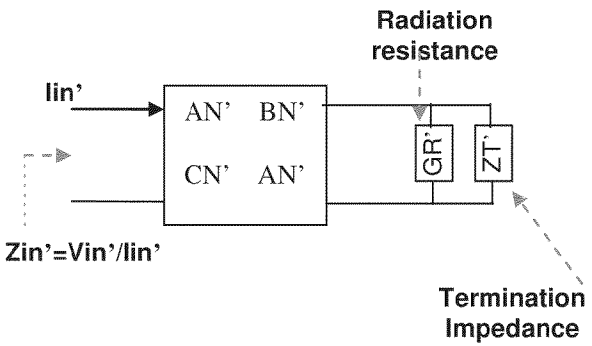
Figure 2B:
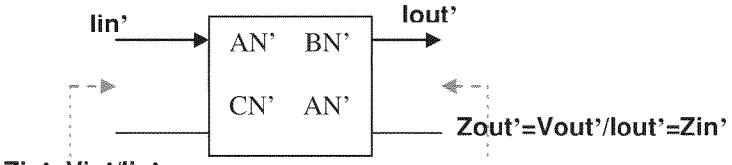
Figure 2D:
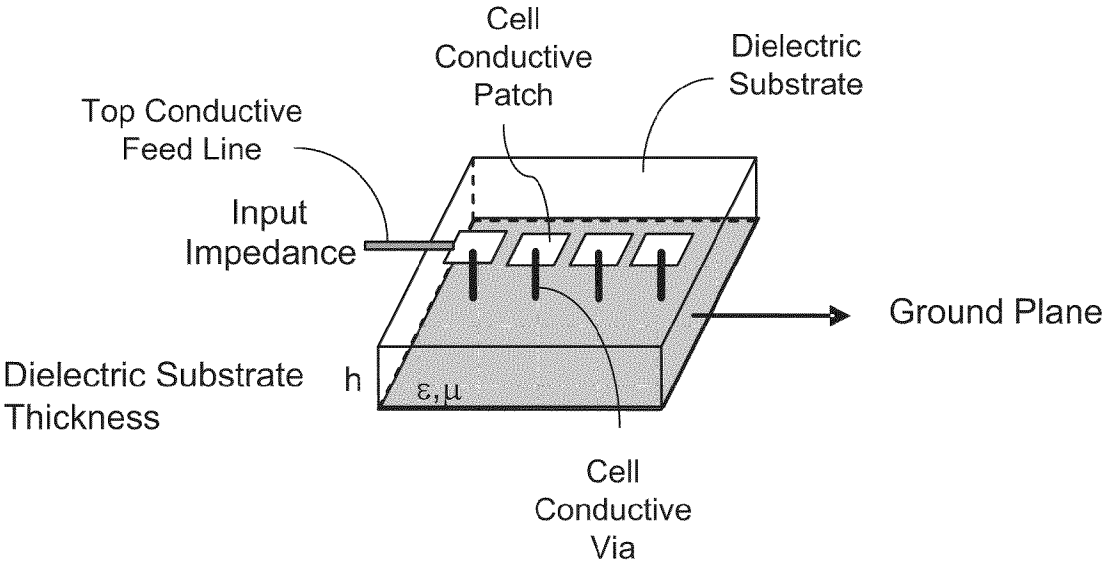

FIG. 2 provides an example of a 1D CRLH material Transmission Line (TL) based on four unit cells. The four patches are placed above a dielectric substrate with centered vias connected to the ground electrode. FIG. 2A shows an equivalent network circuit analogy of the device in FIG. 2. The ZLin' and ZLout' corresponding to the input and output load impedances respectively and are due to the TL couplings at each end. This is an example of a printed 2-layer structure. FIG. 2C shows the equivalent circuit for an antenna with four MTM unit cells as shown in FIG. 2D. The impedance labeled "GR" represents the radiation resistance of the antenna. In FIGS. 2A-2C, the correspondences between FIG. 2 and FIG. 2A are illustrated, where the Right-Handed (RH) series inductance LR and shunt capacitor CR are due to the dielectric being sandwiched between the patch and the ground plane, the series Left-Handed (LH) capacitance CL is due to the presence of two adjacent patches, and the via induces the shunt LH inductance LL.

The individual internal cell has two resonances $\omega_{SE}$ and $\omega_{SH}$ corresponding to the series impedance Z and shunt admittance Y. Their values are given by the following relation:

$$\omega_{SH} = \frac{1}{\sqrt{LL\ CR}};\ \omega_{SE} = \frac{1}{\sqrt{LR\ CL}};\ \omega_R = \frac{1}{\sqrt{LR\ CR}};\ \omega_L = \frac{1}{\sqrt{LL\ CL}} \tag{1}$$

$$\text{where, } Z = j\omega LR + \frac{1}{j\omega CL} \text{ and } Y = j\omega CR + \frac{1}{j\omega LL}$$

The two input/output edge cells in FIG. 2A do not include part of the CL capacitor since it represents the capacitance between two adjacent MTM cells, which are missing at these input/output ports. The absence of a CL portion at the edge cells prevents $\omega_{SE}$ frequency from resonating. Therefore, only $\omega_{SH}$ appears as an n=0 resonance frequency.

Figure 3A:
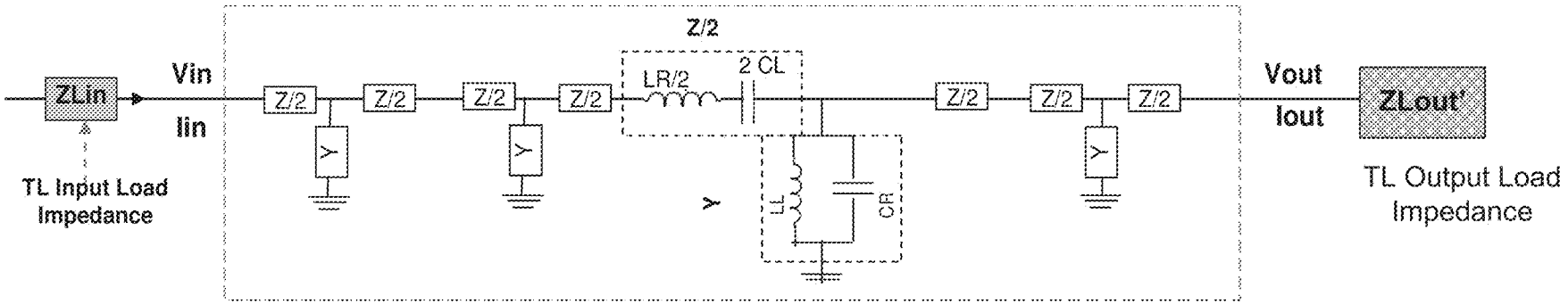

In order to simplify the computational analysis, we include part of the ZLin' and ZLout' series capacitor to compensate for the missing CL portion as seen in FIG. 3A. Under this condition, all N cells have identical parameters.

Figure 3B:
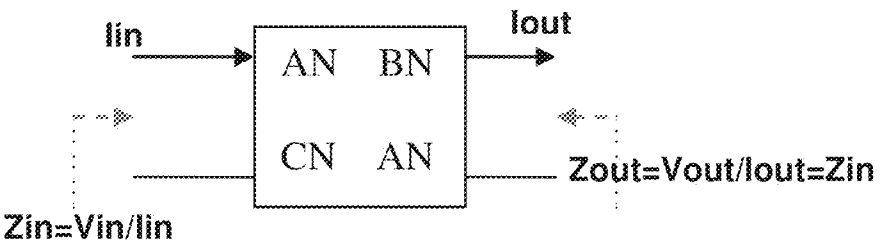
Figure 3C:
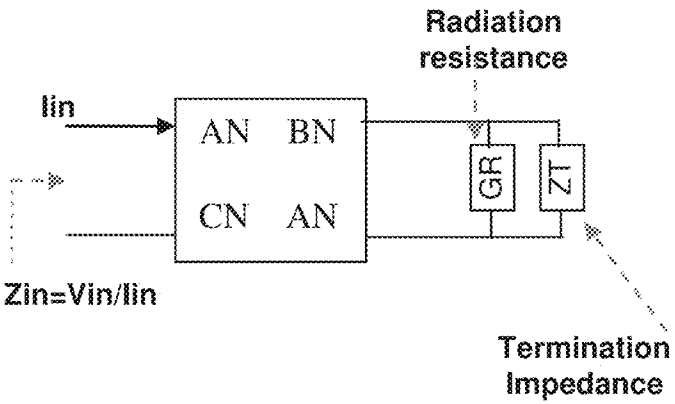

FIG. 2B and FIG. 3B provide the 2-ports network matrix of FIG. 2A and FIG. 3A, respectively, without the load impedances, and FIG. 2C and FIG. 3C provide the analogous antenna circuit when the TL design is used as an antenna. In matrix notations, FIG. 3B represents the relation given by:

$$\begin{pmatrix} Vin \\ Iin \end{pmatrix} = \begin{pmatrix} AN & BN \\ CN & AN \end{pmatrix} \begin{pmatrix} Vout \\ Iout \end{pmatrix} \tag{2}$$

where AN=DN because the CRLH circuit in FIG. 3A is symmetric when viewed from Vin and Vout ends. The impedance "GR" is the structure corresponding to radiation resistance and ZT is the termination impedance. ZT is basically the desired termination of the structure in FIG. 2B with an additional 2CL series capacitor. The same goes for ZLin' and ZLout', in other terms:

$$ZLin' = ZLin + \frac{2}{j\omega CL},\quad ZLout' = ZLin + \frac{2}{j\omega CL},\quad ZT' = ZT + \frac{2}{j\omega CL} \tag{3}$$

Since the radiation resistance "GR" is derived by either building the antenna or simulating it with HFSS, it is difficult to work with the antenna structure to optimize the design. Hence, it is preferable to adopt the TL approach and then simulate its corresponding antennas with various terminations ZT. The notations in Eq (1) also hold for the circuit in FIG. 2A with the modified values AN', BN', and CN' which reflect the missing CL portion at the two edge cells.

The frequency bands are determined from the dispersion equation derived by letting the N CRLH cell structure resonates with $n\pi$ propagation phase length, where n=0, ±1, ±2, . . . ±N. Here, each of the N CRLH cells is represented by Z and Y in Eq (1), which is different from the structure shown in FIG. 2A, where CL is missing from end cells. Hence, one might expect that the resonances associated with these two structures are different. However, extensive calculations show that all resonances are the same except for n=0, where both $\omega_{SE}$ and $\omega_{SH}$ resonate in the first structure and only $\omega_{SH}$ resonates in the second one (FIG. 2A). The positive phase offsets (n>0) correspond to RH region resonances and the negative values (n<0) are associated with LH region resonances.

The dispersion relation of N identical cells with the Z and Y parameters, which are defined in Eq (1), is given by the following relation:

$$\begin{cases} N\beta p = \cos^{-1}(A_N), \ \Rightarrow |A_N| \le 1 \Rightarrow 0 \le \chi = -ZY \le 4 \forall N \\ \text{where } A_N = 1 \text{ at even resonances } |n| = 2m \in \left\{0, 2, 4, \ldots 2 \times Int\left(\frac{N-1}{2}\right)\right\} \\ \text{and } A_N = -1 \text{ at odd resonances } |n| = 2m+1 \in \left\{1, 3, \ldots \left(2 \times Int\left(\frac{N}{2}\right) - 1\right)\right\} \end{cases} \quad (4)$$

where, Z and Y are given in Eq (1), AN is derived from either the linear cascade of N identical CRLH circuit or the one shown in FIG. 3A, and p is the cell size. Odd n=(2m+1) and even n=2m resonances are associated with AN=−1 and AN=1, respectively. For AN' in FIG. 2A and FIG. 2B, due to the absence of CL at the end cells, the n=0 mode resonates at $\omega_0=\omega_{SH}$ only and not at both $\omega_{SE}$ and $\omega_{SH}$ regardless of the number of cells. Higher frequencies are given by the following equation for the different values of $\chi$ specified in Table 1:

$$\text{For } n > 0,\ \omega_{\pm n}^2 = \frac{\omega_{SH}^2 + \omega_{SE}^2 + M\omega_R^2}{2} \pm \sqrt{\left(\frac{\omega_{SH}^2 + \omega_{SE}^2 + M\omega_R^2}{2}\right)^2 - \omega_{SH}^2\omega_{SE}^2} \quad (5)$$

Table 1 provides $\chi$ values for N=1, 2, 3, and 4. It should be noted that the higher resonances |n|>0 are the same regardless if the full CL is present at the edge cells (FIG. 3A) or absent (FIG. 2A). Furthermore, resonances close to n=0 have small $\chi$ values (near $\chi$ lower bound 0), whereas higher resonances tend to reach $\chi$ upper bound 4 as stated in Eq (4).

TABLE 1

Resonances for N = 1, 2, 3 and 4 cells.

| N\Modes | \|n\| = 0 | \|n\| = 1 | \|n\| = 2 | \|n\| = 3 |
|---|---|---|---|---|
| N = 1 | $\chi_{(1,0)} = 0; \omega_0 = \omega_{SH}$ | | | |
| N = 2 | $\chi_{(2,0)} = 0; \omega_0 = \omega_{SH}$ | $\chi_{(2,1)} = 2$ | | |
| N = 3 | $\chi_{(3,0)} = 0; \omega_0 = \omega_{SH}$ | $\chi_{(3,1)} = 1$ | $\chi_{(3,2)} = 3$ | |
| N = 4 | $\chi_{(4,0)} = 0; \omega_0 = \omega_{SH}$ | $\chi_{(4,1)} = 2 - \sqrt{2}$ | $\chi_{(4,2)} = 2$ | |

Figure 4A:
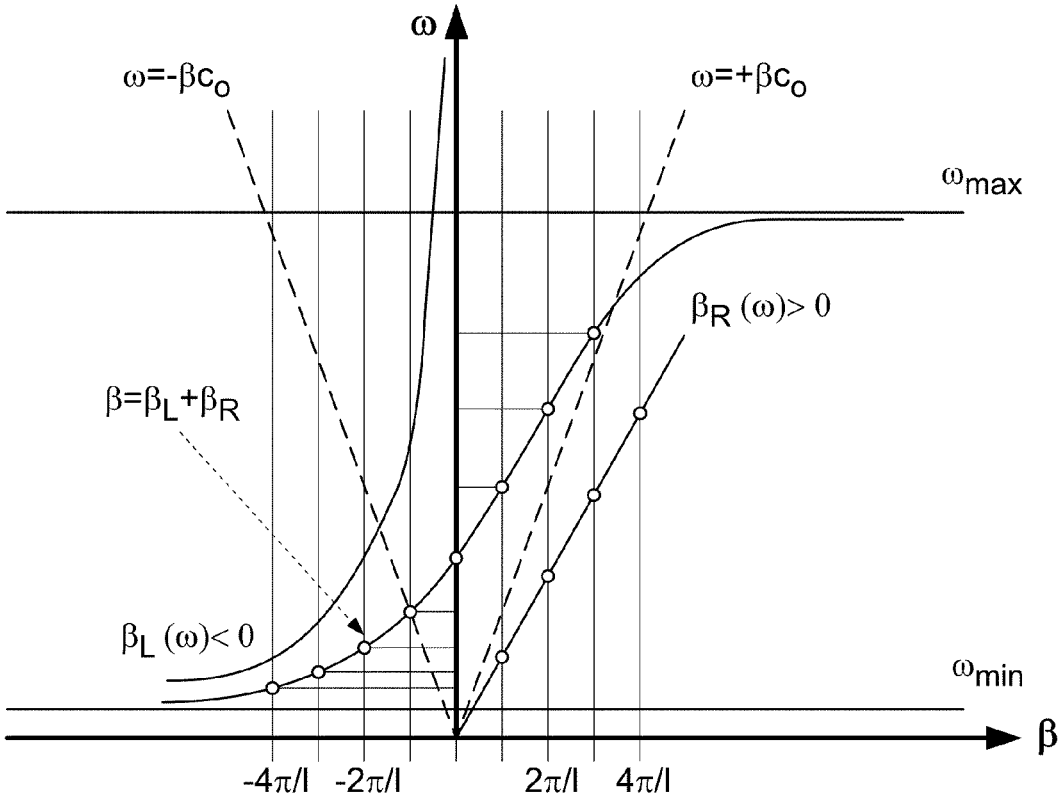
FIGS. 4A and 4B show examples of the resonant position along the beta curves in the device in FIG. 2.
Figure 4B:
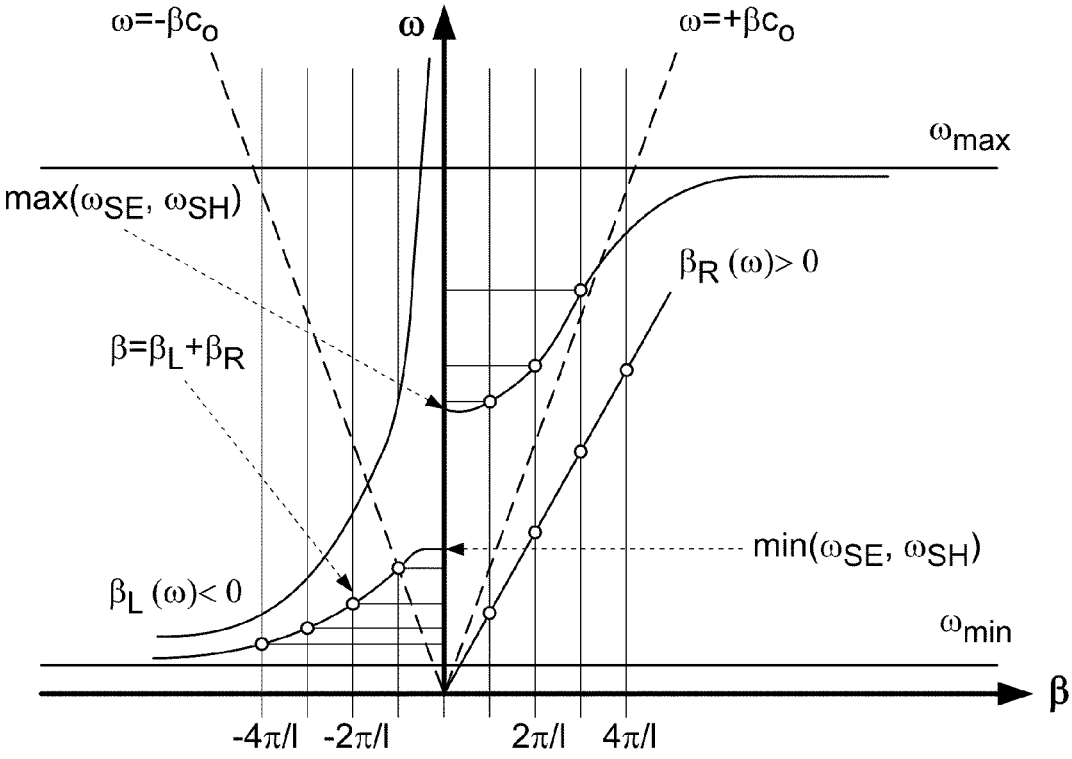

An illustration of the dispersion curve β as a function of omega is provided in FIGS. 4A and 4B for the $\omega_{SE}=\omega_{SH}$ (balanced) and $\omega_{SE}\neq\omega_{SH}$ (unbalanced) cases respectively. In the latter case, there is a frequency gap between min($\omega_{SE}$, $\omega_{SH}$) and max($\omega_{SE}$,$\omega_{SH}$). The limiting frequencies $\omega_{min}$ and $\omega_{max}$ values are given by the same resonance equations in Eq (5) with $\chi$ reaching its upper bound $\chi$=4 as stated in the following equations:

$$\omega_{min}^2 = \frac{\omega_{SH}^2 + \omega_{SE}^2 + 4\omega_R^2}{2} - \sqrt{\left(\frac{\omega_{SH}^2 + \omega_{SE}^2 + 4\omega_R^2}{2}\right) - \omega_{SH}^2\omega_{SE}^2} \quad (6)$$

$$\omega_{max}^2 = \frac{\omega_{SH}^2 + \omega_{SE}^2 + 4\omega_R^2}{2} + \sqrt{\left(\frac{\omega_{SH}^2 + \omega_{SE}^2 + 4\omega_R^2}{2}\right)^2 - \omega_{SH}^2\omega_{SE}^2}$$

FIGS. 4A and 4B provide examples of the resonance position along the beta curves. FIG. 4A illustrates the balanced case where LR CL=LL CR, and FIG. 4B shows the unbalanced case with the gap between LH and RH regions.

In the RH region (n>0) the structure size l=Np, where p is the cell size, increases with decreasing frequencies. In contrast, in the LH region, lower frequencies are reached with smaller values of Np, hence size reduction. The β curves provide some indication of the bandwidth around these resonances. For instance, LH resonances suffer from narrow bandwidth because the β curves are almost flat. In the RH region bandwidth should be higher because the β curves are steeper, or in other terms:

$$COND1\text{: } 1^{st} BBcondition \left|\frac{d\beta}{d\omega}\right|_{res} = \left|-\frac{\frac{d(AN)}{d\omega}}{\sqrt{(1-AN^2)}}\right|_{res} << 1 \text{ near } \omega = \omega_{res} = \omega_0, \omega_{\pm 1}, \quad (7)$$

$$\omega_{\pm 2} \ldots \Rightarrow \left|\frac{d\beta}{d\omega}\right| = \left|\frac{\frac{d\chi}{d\omega}}{2p\sqrt{\chi\left(1-\frac{\chi}{4}\right)}}\right|_{res} << 1 \text{ with } p = \text{cell size and } \frac{d\chi}{d\omega}\bigg|_{res} = \frac{2\omega_{\pm n}}{\omega_R^2}\left(1 - \frac{\omega_{SE}^2\omega_{SH}^2}{\omega_{\pm n}^4}\right)$$

where, $\chi$ is given in Eq (4) and $\omega_R$ is defined in Eq (1). From the dispersion relation in Eq (4) resonances occur when |AN|=1, which leads to a zero denominator in the $1^{st}$ BB condition (COND1) of Eq (7). As a reminder, AN is the first transmission matrix entry of the N identical cells (FIG. 3A and FIG. 3B). The calculation shows that COND1 is indeed independent of N and given by the second equation in Eq (7). It is the values of the numerator and $\chi$ at resonances, which are defined in Table 1, that define the slope of the dispersion curves, and hence possible bandwidth. Targeted structures are at most Np=λ/40 in size with bandwidth exceeding 4%. For structures with small cell sizes p, Eq (7) clearly indicates that high $\omega_R$ values satisfy COND1, i.e. low CR and LR values since for n<0 resonances happens at χ values near 4 in Table 1, in other terms (1−χ/4→0).

As previously indicated, once the dispersion curve slopes have steep values, then the next step is to identify suitable matching. Ideal matching impedances have fixed values and do not require large matching network footprints. Here, the word "matching impedance" refers to feed lines and termination in case of, a single side feed such as antennas. In order to analyze input/output matching network, Zin and Zout need to be computed for the TL circuit in FIG. 3B. Since the network in FIG. 3A is symmetric, it is straightforward to demonstrate the Zin=Zout. It can be demonstrated that Zin is independent of N as indicated in the equation below:

$$Zin^2 = \frac{BN}{CN} = \frac{B1}{C1} = \frac{Z}{Y}\left(1 - \frac{\chi}{4}\right), \quad (8)$$

which has only positive real values

The reason that B1/C1 is greater than zero is due to the condition of |AN|≦1 in Eq (4) which leads to the following impedance condition:

$$0 \leqq -ZY = \chi \leqq 4.$$

The $2^{ed}$ BB condition is for Zin to slightly vary with frequency near resonances in order to maintain constant matching. Remember that the real matching Zin' includes a portion of the CL series capacitance as stated in Eq (3).

$$COND2:\ 2^{ed}\ BBcondition:\ \text{near resonances},\ \left.\frac{dZin}{d\omega}\right|_{near\ res} << 1 \quad (9)$$

Different from the transmission line example in FIG. 2 and FIG. 2B, antenna designs have an open-ended side with an infinite impedance which typically poorly matches the structure edge impedance. The capacitance termination is given by the equation below:

$$Z_T = \frac{AN}{CN} \text{ which depends on } N \text{ and is purely imaginary} \quad (10)$$

Since LH resonances are typically narrower than the RH ones, selected matching values are closer to the ones derived in the n<0 than the n>0.

In order to increase the bandwidth of LH resonances, the shunt capacitor CR can be reduced. This reduction leads to higher $\omega_R$ values of steeper beta curves as explained in Eq. (7). There are various ways to decrease CR, including: 1) increasing substrate thickness, 2) reducing the top cell patch area, or 3) reducing the ground electrode under the top cell patch. In designing the devices, these three methods may be combined to produce a desired design.

Figure 5A:
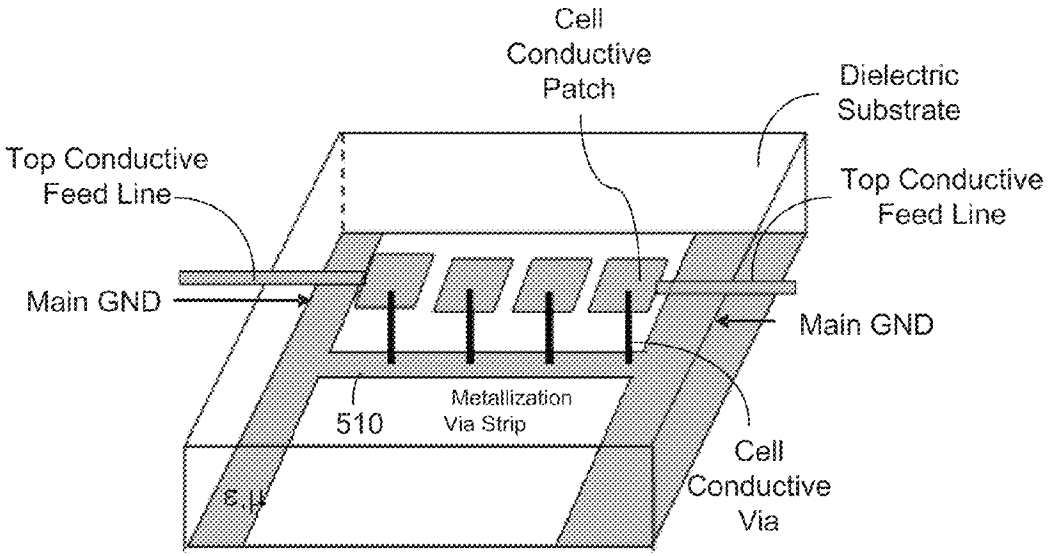
FIGS. 5A and 5B show an example of a CRLH MTM device with a truncated ground conductive layer design.
Figure 5B:
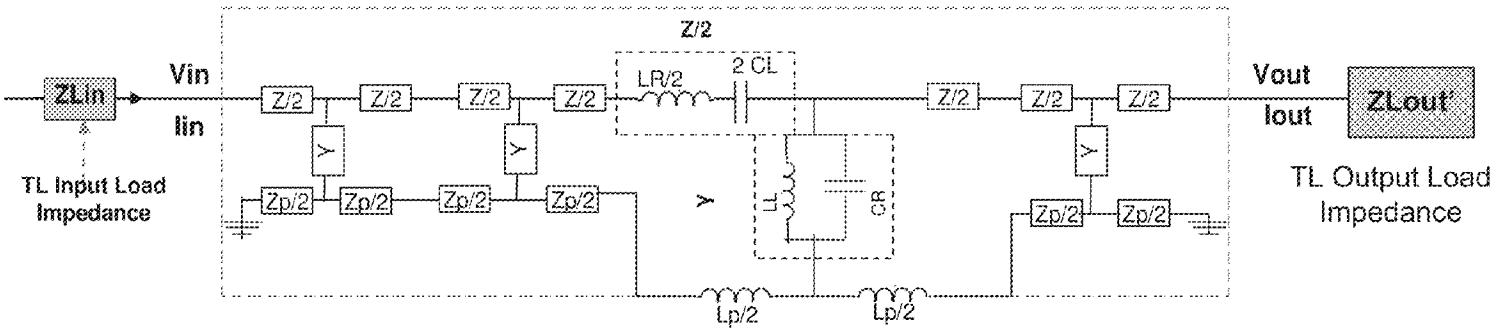
Figure 5C:
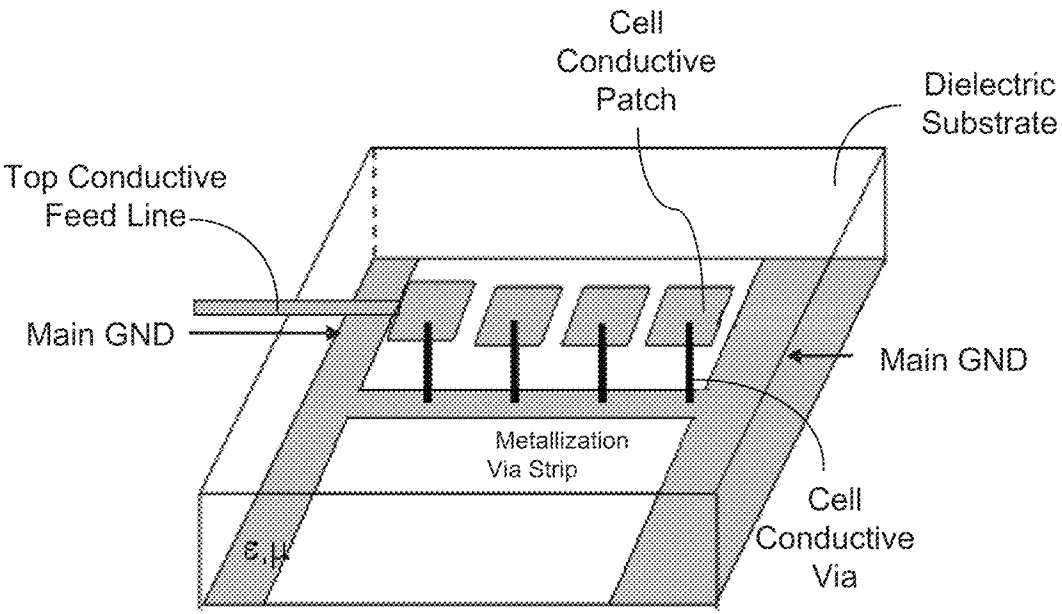
FIG. 5C shows an example of a CRLH MTM antenna with four MTM cells with a truncated ground conductive layer design based on the structure in FIG. 5A.

FIG. 5A illustrates one example of a truncated ground electrode (GND) in a 4-cell transmission line where the GND has a dimension less than the top patch along one direction underneath the top cell patch. The ground conductive layer includes a strip line 510 that is connected to the conductive via connectors of at least a portion of the unit cells and passes through underneath the conductive patches of the portion of the unit cells. The strip line 510 has a width less than a dimension of the conductive path of each unit cell. The use of truncated GND can be more practical than other methods to implement in commercial devices where the substrate thickness is small and the top patch area cannot be reduced because of lower antenna efficiency. When the bottom GND is truncated, another inductor Lp (FIG. 5B) appears from the metallization strip that connects the vias to the main GND as illustrated in FIG. 5A. FIG. 5C shows a 4-cell antenna based on the structure in FIG. 5A.

Figure 6A:
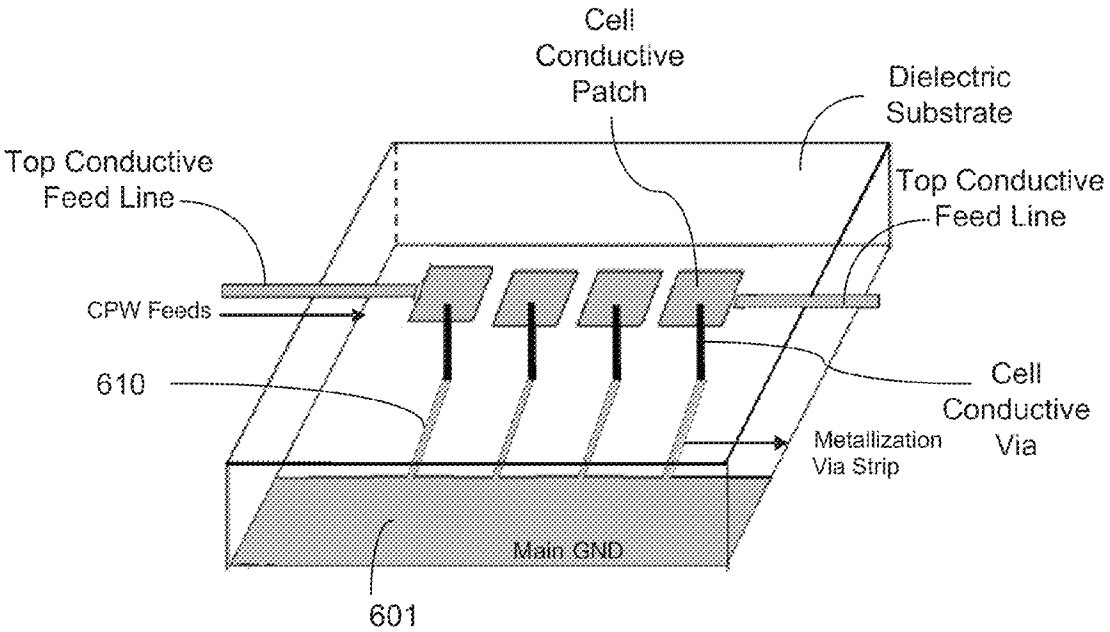
FIGS. 6A and 6B show another example of a CRLH MTM device with a truncated ground conductive layer design.
Figure 6B:
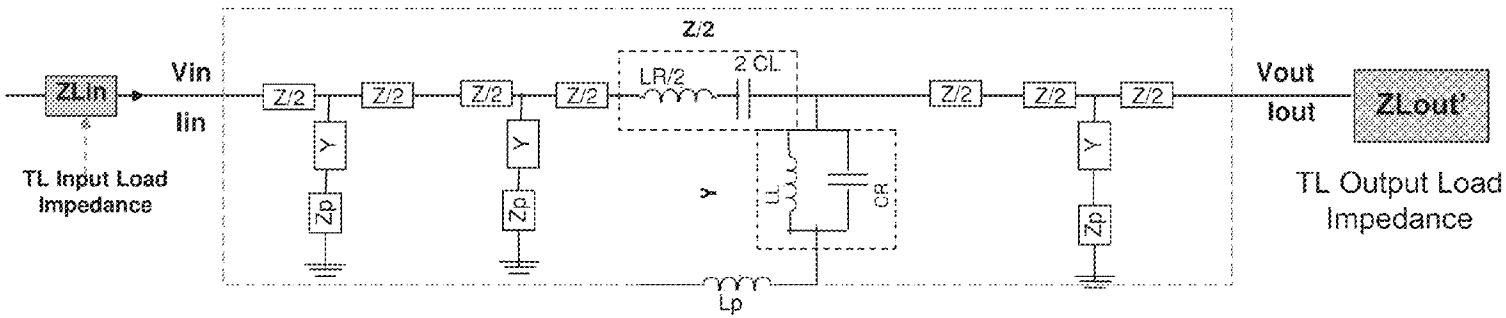

FIGS. 6A and 6B show another example of a truncated GND design. In this example, the ground conductive layer includes a common ground conductive area 601 and strip lines 610 that are connected to the common ground conductive area 601 at first distal ends of the strip lines 610 and having second distal ends of the strip lines 610 connected to conductive via connectors of at least a portion of the unit cells underneath the conductive patches of the portion of the unit cells. The strip line 610 has a width less than a dimension of the conductive path of each unit cell.

The equations for truncated GND can be derived. The resonances follow the same equation as in Eq (5) and Table 1 as explained below:

Approach 1 (FIGS. 5A and 5B):

Resonances: same as in Eqs (1), (5) and (6) and Table 1 after replacing LR by LR+Lp CR becomes very small Furthermore, for |n|≠0, each mode has two resonances corresponding to (1) ω±n for LR being replaced by LR+Lp (2) ω±n for LR being replaced by LR+Lp/N where N is the number of cells The impedance equation becomes:

$$Zin^2 = \frac{BN}{CN} = \frac{B1}{C1} = \frac{Z}{Y}\left(1 - \frac{\chi + \chi_P}{4}\right)\frac{(1 - \chi - \chi_P)}{(1 - \chi - \chi_P/N)}, \quad (11)$$

where $\chi = -YZ$ and $\chi = -YZ_P$, where Zp=jωLp and Z, Y are defined in Eq. (2).

From the impedance equation in Eq (11), it can be seen that the two resonances ω and ω' have low and high impedance respectively. Hence, it is easy to tune near the ω resonance in most cases.

Approach 2 (FIGS. 6A and 6B):

Resonances: same as in Eq. (1), (5), and (6) and Table 1 after replacing LL by LL+Lp CR becomes very small In the second approach, the combined shunt induction (LL+Lp) increases while the shunt capacitor decreases, which leads to lower LH frequencies.

Due to the current distribution in the MTM structure, the MTM antennas can be closely spaced with minimal interaction between them [Caloz and Itoh, "Electromagnetic Metamaterials: Transmission Line Theory and Microwave Applications," John Wiley & Sons (2006) pp. 172-177]. The close spacing makes radiation pattern shaping more tractable than otherwise.

Referring back to FIG. 1, the pattern shaping circuit splits the RF signal into different antenna feed signals with required amplitude and phase to create the desired radiation pattern. Many different techniques can be used to shape the radiation pattern, including techniques based on phase combining, a Wilkinson power combiner/divider, phase combining using zero-degree metamaterial transmission line, a metamaterial coupler, and an Electromagnetic Band Gap (EBG) structure.

Referring back to FIG. 1, the antenna switching circuit feeds the RF signal from the wireless radio to one or more pattern shaping circuits based on the antenna control logic. This control logic takes into consideration the signal strength from the communication link. Examples of the antenna switching circuit include: 1) conventional RF switch IC, 2) conventional radial divider/combiner terminated with switching devices such as diodes and switches, and 3) metamaterial radial combiner/divider terminated with switching devices such as diodes and switches.

FIGS. 7A-7D show an example of a 2-antenna MTM array that can be used to implement the antenna elements of the present systems. The top and bottom layers can be formed in the top and bottom metallization layers on the FR4 substrate shown in FIG. 7E.

The dielectric substrate on which the antenna elements are formed includes two different conductive layers. The first conductive layer is the top layer supported by the dielectric substrate and is patterned to include a first (top) main ground electrode 742 that is patterned to include separate co-planar waveguides 710-1 and 710-2 to guide and transmit RF signals. The cell conductive patches 722-1 and 722-2 are separated from the first main ground electrode 742 and is in the first layer. Cell conductive feed lines 718-1 and 718-2 are formed on the first layer so that each cell conductive feed line has a first end connected to a respective co-planar waveguide and a second end electromagnetically coupled via capacitive coupling to a respective cell conductive patch to carry a respective RF signal between the respective co-planar waveguide and the respective cell conductive patch. In each cell, a cell conductive launch pad 714-1 or 714-2 is formed in the first layer and is located between each cell conductive patch and a respective conductive feed line with a narrow gap with the cell conductive patch to allow for electromagnetically coupling to the cell conductive patch. The launch pad is connected to the second end of the respective conductive feed line.

The second (bottom) conductive layer supported by the dielectric substrate is separate from and parallel to the first (top) conductive layer. This conductive layer is patterned to include a second main ground electrode 738 in a footprint projected to the second conductive layer by the first ground electrode 742. Cell ground conductive pads 726-1 and 726-2 are respectively located in footprints projected to the second conductive layer by the cell conductive patches 722-1 and 722-2. Ground conductive lines 734-1 and 734-2 connect the cell ground conductive pads 726-1 and 726-2 to the second main ground electrode 738, respectively. In this example, the cell ground conductive pad has a dimension less than a dimension of a respective cell conductive patch in a truncated ground design.

Cell conductive via connectors 730-1 and 730-2 are formed in the substrate and each cell conductive via connection connects a cell conductive patch and the corresponding cell ground pad. Multiple ground via connectors are formed in the substrate to connect the first main ground electrode 742 in the first conductive layer and the second main ground electrode 738 in the second conductive layer. In this example, each cell conductive patch, the substrate, a respective cell conductive via connector and the cell ground conductive pad, a respective co-planar waveguide, and a respective electromagnetically coupled conductive feed line are structured to form a composite left and right handed (CRLH) metamaterial structure as one antenna element. The 2 antenna elements can be made to be identical in structure but are oriented in opposite directions (as shown) to minimize coupling and maximize the diversity gain.

Figure 7A:
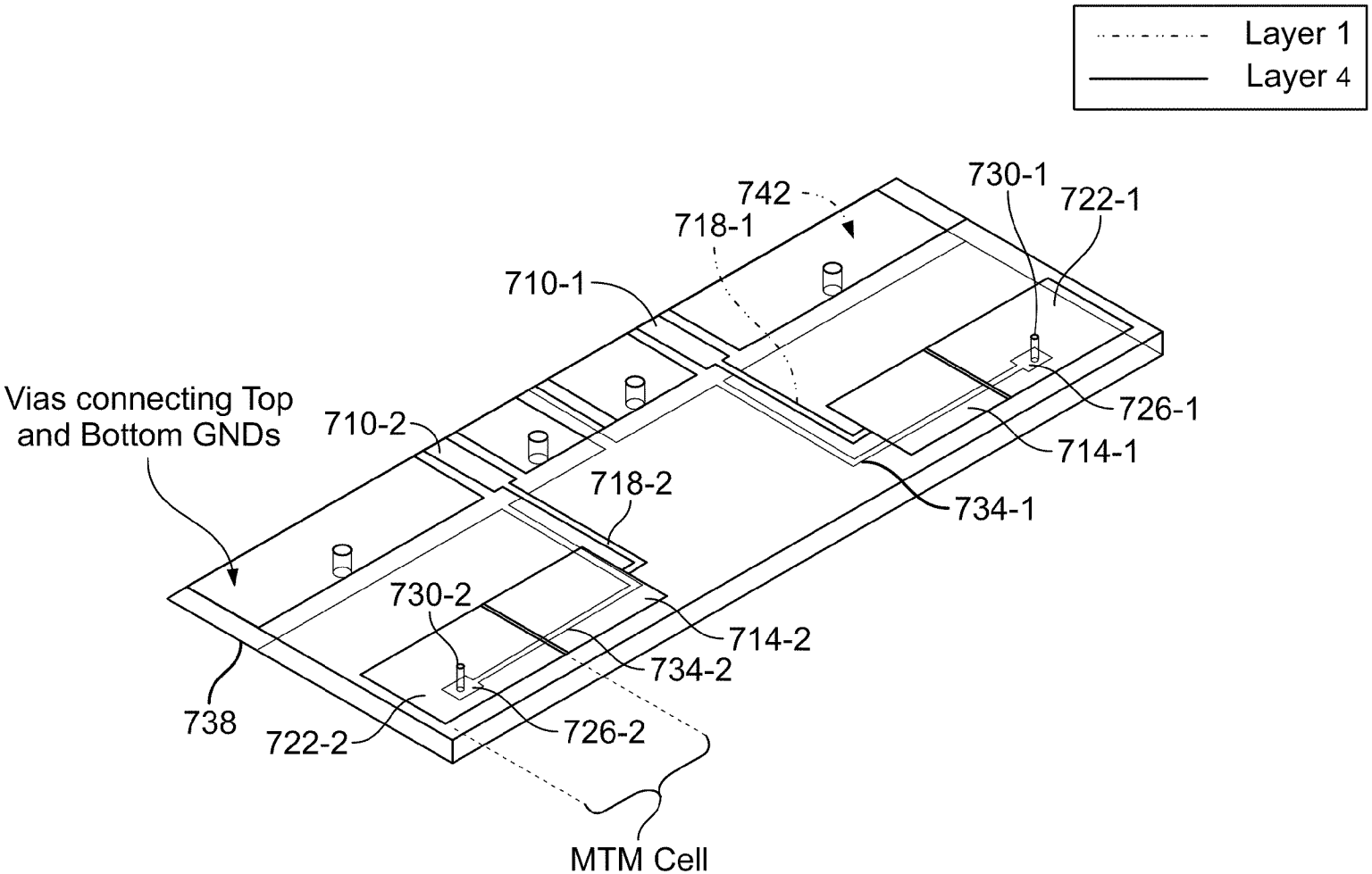
FIG. 7A shows the 3-D view of an example of a 2-antenna MTM array.
Figure 7B:
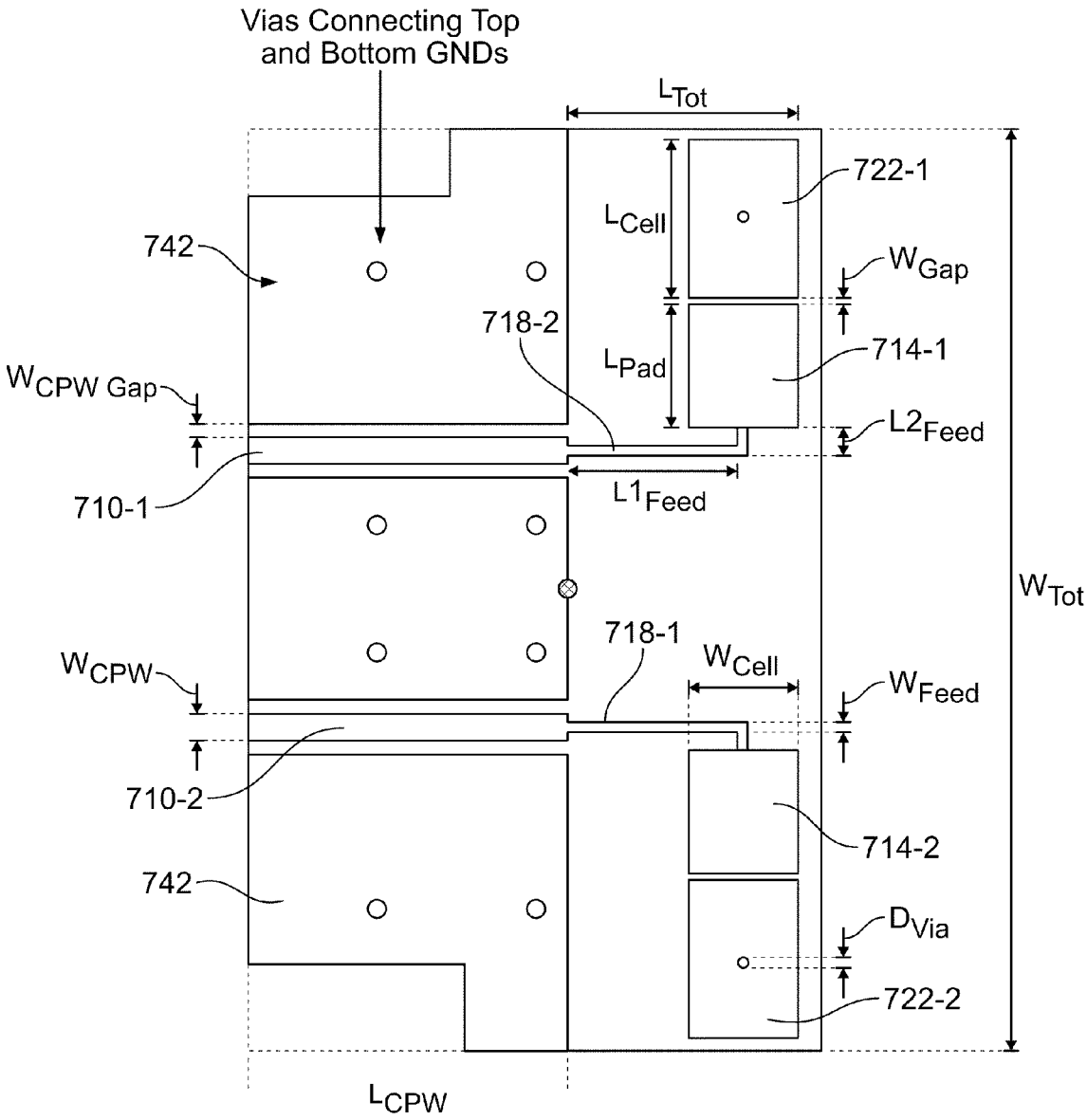
FIG. 7B shows the top layer of the 2-antenna MTM array in FIG. 7A.
Figure 7C:
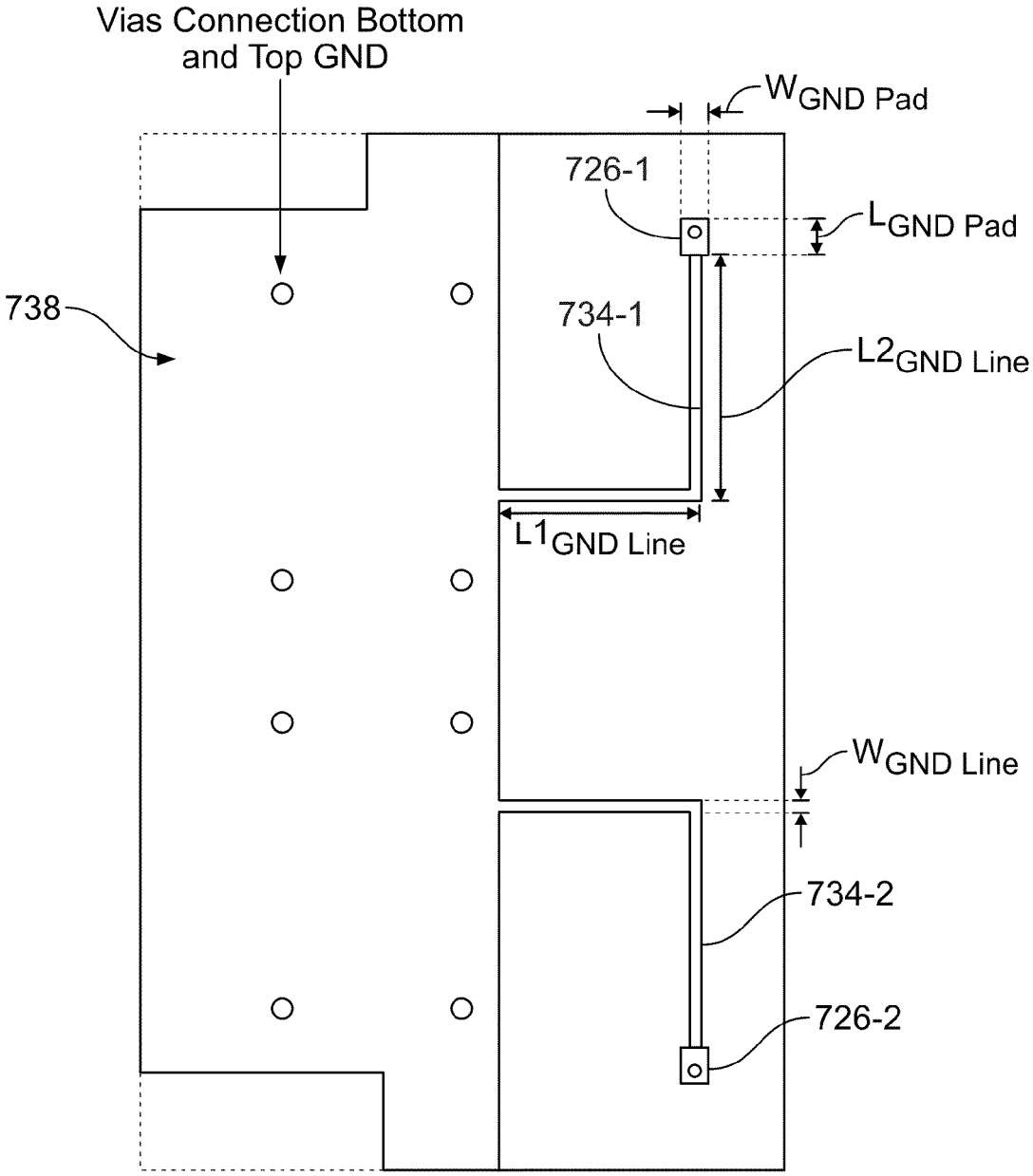
FIG. 7C shows the bottom layer of the 2-antenna array in FIG. 7A.
Figure 7D:
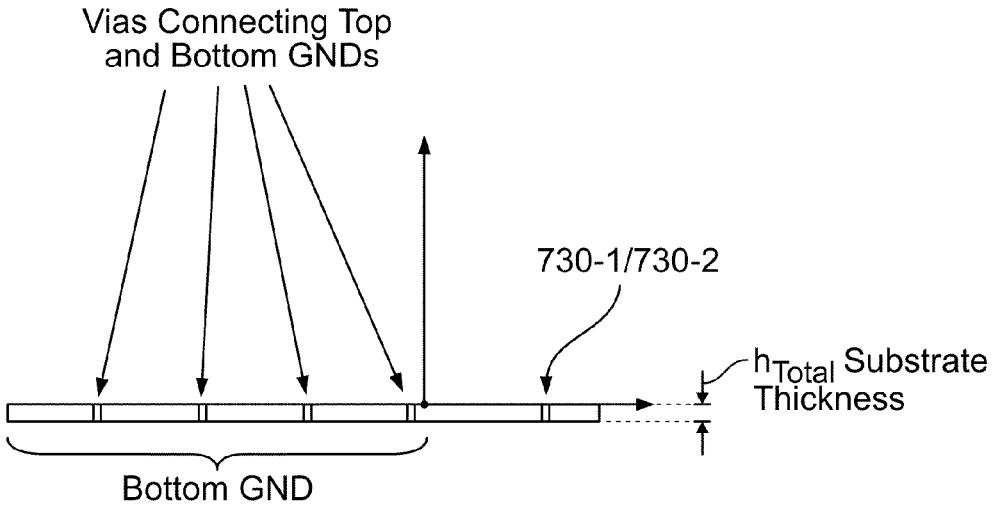
FIG. 7D shows the side view of the substrate in FIG. 7A.

The different sectional views of the antennas are shown in FIGS. 7B, 7C, and 7D. Each 50Ω co-planar waveguide (CPW) line is denoted by reference numeral 710. Each antenna comprises an MTM cell, a launch pad 714 and a feed line 718, where the MTM cell is connected to the 50Ω CPW line 710 via the launch pad 714 and the feed line 718. The MTM cell comprises a cell patch 722 which has a rectangular shape in this example, a ground (GND) pad 726, a via 730 which has a cylindrical shape and connects the cell patch 722 with the ground (GND) pad 726, and a ground (GND) line 734 which connects the GND pad 726, hence the MTM cell, with a main ground (GND) 738. The cell patch 722, launch pad 714 and feed line 718 are located on the top layer. There is a gap between the launch pad 714 and the cell patch 722. The GND pad 726 in this example has a small square shape and connects the bottom part of the via 730 to the GND line 734. The GND pad 726 and the GND line 734 are located on the bottom layer. The CPW feed line is surrounded by a top ground (GND) 742.

The antennas were simulated using HFSS EM simulation software. In addition, some of the designs were fabricated and characterized by measurements.

In one implementation, the substrate is FR4 with dielectric constant $\in$=4.4 and with width=64 mm, length=38 mm, and thickness=1.6 mm. The GND size is 64×30 mm. The cell size is 3×6.2 mm and is located at 8 mm away from the top GND 742. At −10 dB the bands are at 2.38-2.72 GHz.

Specific geometrical shapes and dimensions of the antennas are employed in this example. It should be understood that various other antenna variations can also be used to comply with other Printed Circuit Board (PCB) implementation factors. Examples of several variations are listed below:

- The launch pad 714 can have different geometrical shapes such as but not limited to rectangular, spiral (circular, oval, rectangular, and other shapes), or meander.
- The cell patch 722 can have different geometrical shapes such as but not limited to rectangular, spiral (circular, oval, rectangular, and other shapes), or meander
- The gap between the launch pad 714 and the cell patch 722 can take different forms such as but not limited to straight line, curved, L-shape, meander, zigzag, or discontinued line.
- The GND line 734 that connects the MTM cell to the GND can be located on the top or bottom layer.
- Antennas can be placed few millimeters above the substrate.
- Additional MTM cells may be cascaded in series with the first cell creating a multi-cell 1D structure.
- Additional MTM cells may be cascaded in an orthogonal direction generating a 2D structure.

Antennas can be designed to support single or multi-bands. As discussed earlier, the antenna resonances are affected by the presence of the left handed mode. When one of the following operations is performed, the lowest resonance in both the impedance and return loss disappears:

- The gap between the launch pad 714 and the cell patch 722 is closed. This corresponds to an inductively loaded monopole antenna.
- The GND line 734 connecting the MTM cell to GND is removed.
- The GND line 734 is removed and the gap is closed. This corresponds to a printed monopole resonance.

The left handed mode helps excite and better match the lowest resonance as well as improves the matching of higher resonances.

Figure 8A:
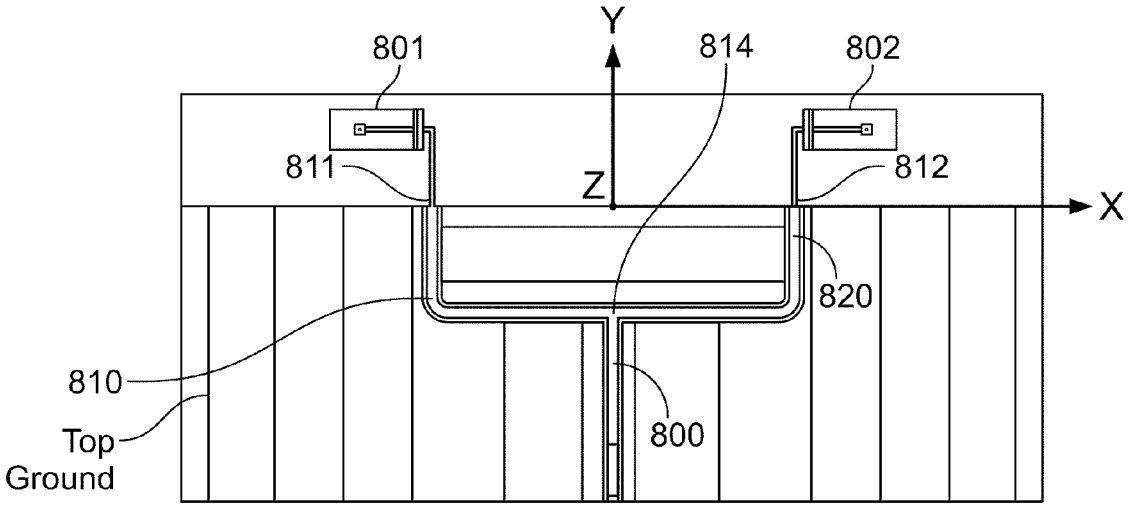
FIGS. 8A, 8B, 8C and 8D show two examples of 2-antenna MTM arrays with a phase combining device for shaping the radiation pattern: (1) phase offset=0 degree, mechanical configuration and the corresponding radiation pattern; (2) phase offset=90 degrees.
Figure 8B:
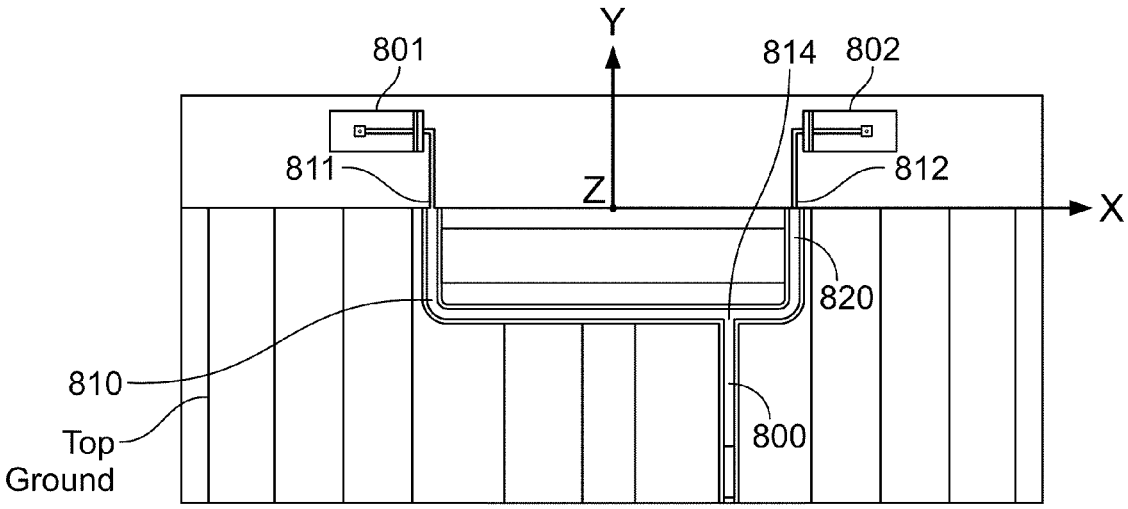

FIGS. 8A and 8B show two examples of pattern shaping using phase-combining of signals. In both examples, two MTM antenna elements 801 and 802 are connected to receive replicas of the common RF signal. A 3-port RF splitter is provided to feed the RF signal to the two antenna elements 801 and 802. This RF splitter includes a main CPW feed line 800 that receives the RF signal generated by the radio transceiver module, a branch point 814, two CPW branch feed lines 810 and 820. The terminals 811 and 812 of the two branch feed lines 810 and 820 are respectively connected to the two antenna elements 801 and 802.

Figure 8C:
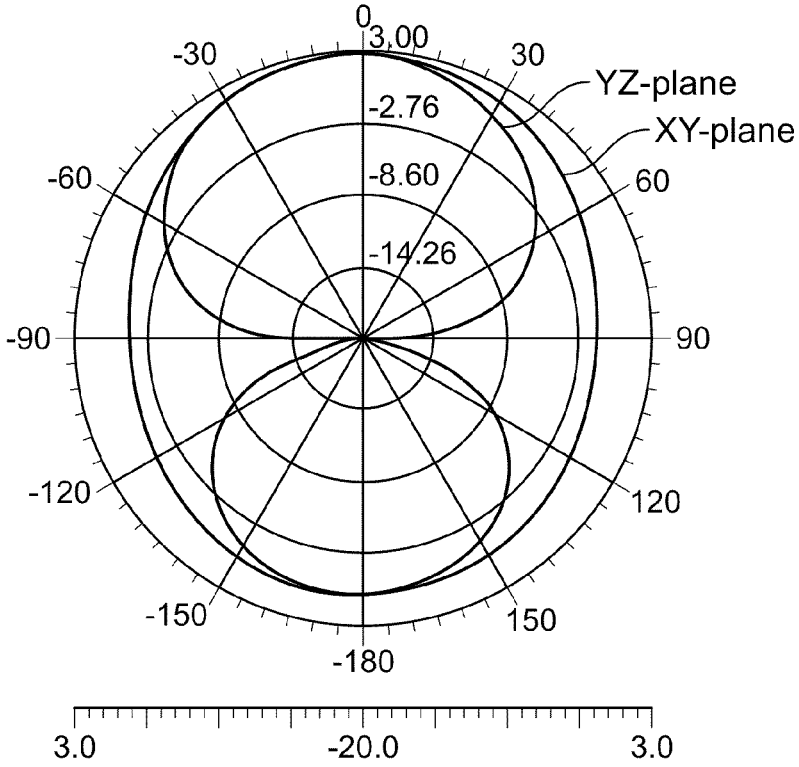

The antenna system in FIG. 8A is configured to have a phase offset of 0 degree between the two branch feed lines 810 and 802. Therefore, the two MTM antennas 801 and 802 are fed in phase and this equal phase condition creates a dipole-like radiation pattern in the YZ plane and an omni-directional radiation pattern in the XY plane. FIG. 8C shows the radiation pattern.

Figure 8D:
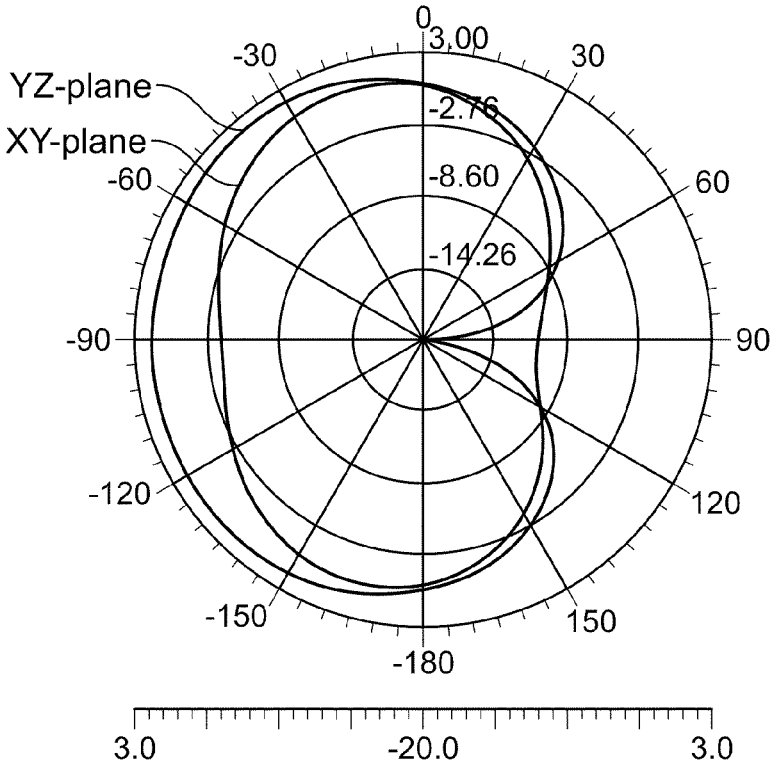

The antenna system in FIG. 8B is configured to have different lengths for the two branch CPW feed lines 810 and 820 with a phase offset of 90 degrees. Therefore, the two antennas 801 and 802 are fed 90 degrees out of phase with respect to each other. Referring to FIG. 8D, this out of phase condition creates a directional pattern with high gain in the −x direction and very good rejection in the +x direction. In such antenna systems, the radiated patterns are determined by the phase offset of the signals and the distance between the two antennas 801 and 802. The phase offset of the radiated signals between the two antennas 801 and 802 can be varied by changing the relative length between the two branch feed lines 810 and 820 connected to respective antennas. Specifically, as shown in top figures in FIGS. 8A and 8B, the phase offset is determined by the difference between the length of the first feed line 810 connecting the first antenna input point 811 with the branch point 814 and the length of the second feed line 820 connecting the second antenna input point 812 with the branch point 814. The coupling between the two antennas 801 and 802 can be difficult to control in this phase combining scheme due to the connected paths inherent in the design. Thus, the two antennas together act as a single antenna.

Figure 9A:
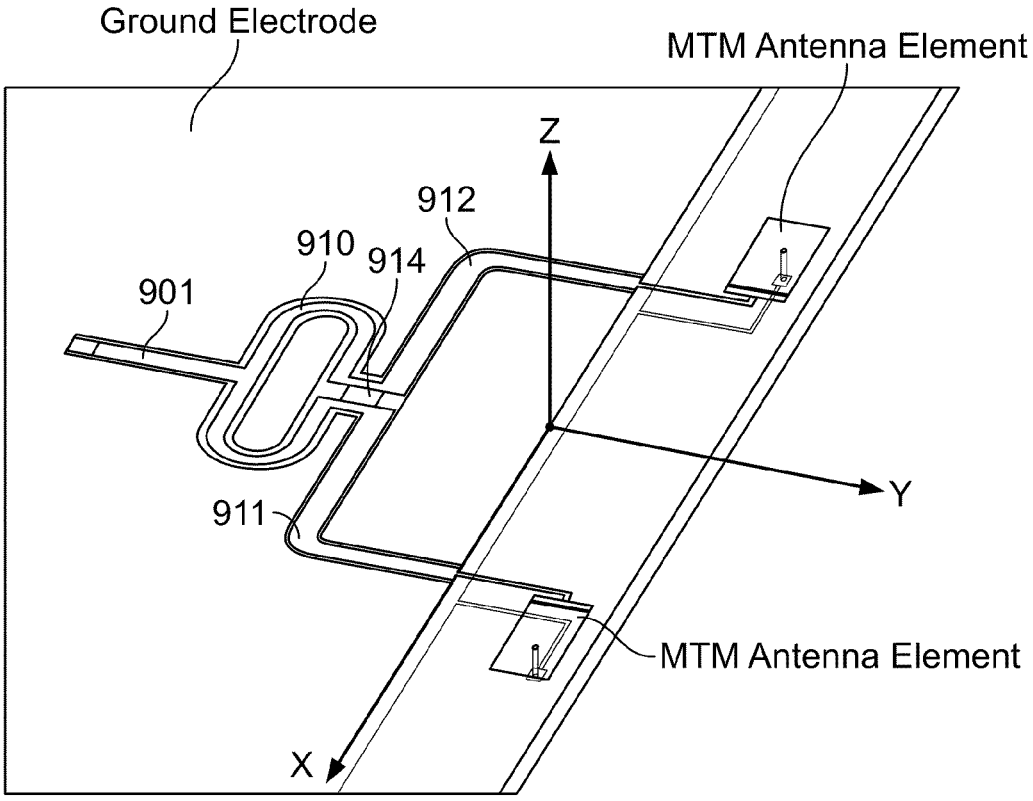
FIG. 9A shows the 3-D view of an example of a 2-antenna MTM array with a Wilkinson power divider.
Figure 9B:
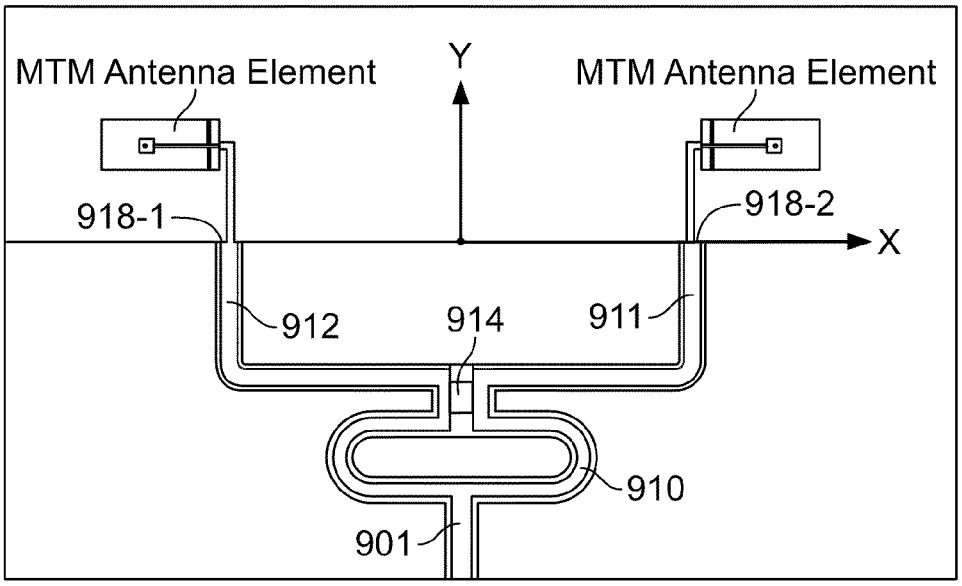
FIG. 9B shows the top view of the 2-antenna MTM array with the Wilkinson power divider.

FIGS. 9A and 9B show an example of pattern shaping circuit using a Wilkinson power divider. Examples of Wilkinson power dividers can be found in, e.g., pages 318-323 in Pozar, "Microwave Engineering," John Wiley & Sons (2005). FIG. 9A shows a 3D view of the structure and FIG. 9B shows the top view of the structure. The Wilkinson power divider 910 is designed so as to generate two replica signals of equal amplitude and phase of a common RF signal received by the main CPW feed line 901. Two branch CPW feed lines 911 and 912 are connected to the Wilkinson divider output point 914 to receive the two signals, respectively, and to feed the two signals to the two MTM antenna elements. The two feed lines 911 and 912 are minimally coupled in this case owing to the design of the Wilkinson power divider 910. The phase offset of the radiated signals is determined by the difference in length between the feed lines 911 and 912 from the Wilkinson divider output 914 to respective antenna input points, that is, the difference between the first length between the Wilkinson divider output 914 and the first antenna input point 918-1 and the second length between the Wilkinson divider output 914 and the second antenna input point 918-2. Using this phase offset, in conjunction with the distance between the two antennas, a variety of radiation patterns can be created.

Figure 9C:
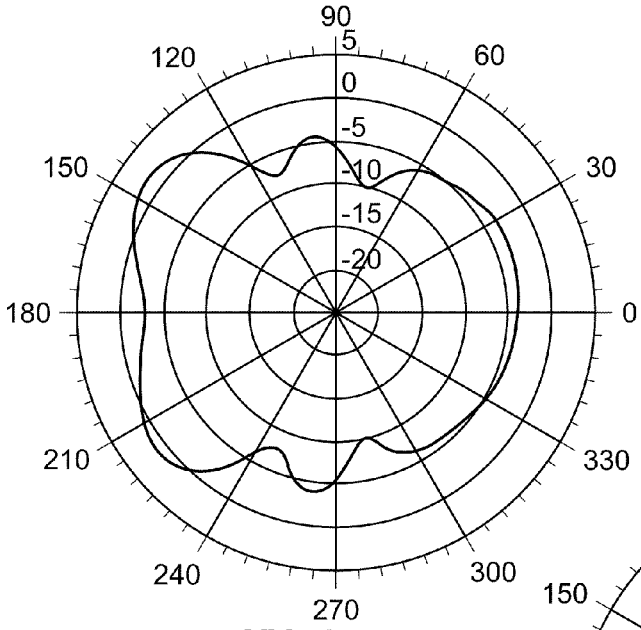
FIG. 9C shows radiation patterns of the 2-antenna MTM array with the Wilkinson power divider in three different planes.
Figure 9C:
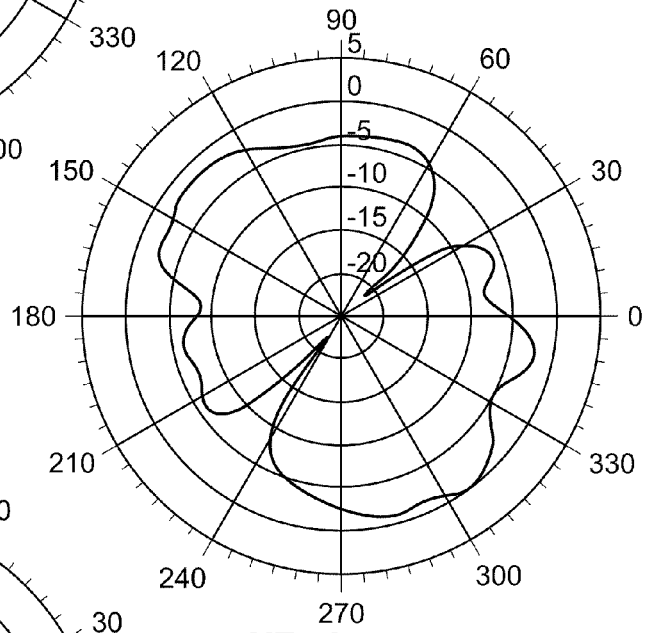
Figure 9C:
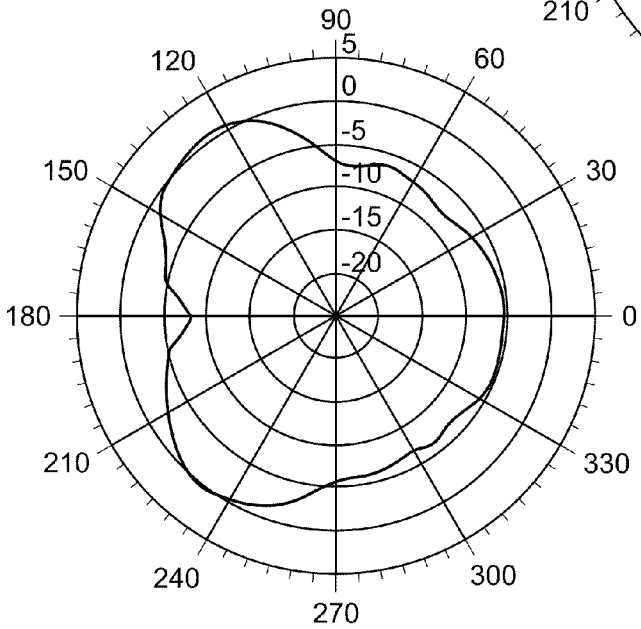

FIG. 9C shows the measured radiation patterns in the XY, XZ and YZ-planes for this example. The radiation pattern is shaped with the maximum gain of 1.7 dBi in the XY-plane at θ=140 degree and a rejection of greater than 10 dB in the XY-plane at θ=15 degree.

Shaping of the radiation pattern can be achieved by using a zero degree CRLH transmission line (TL). The theory and analysis on the design of zero degree CRLH transmission lines are summarized below. Examples of such CRLH transmission lines are described in U.S. patent application Ser. No. 11/963,710 entitled "Power Combiners and Dividers Based on Composite Right and Left Handed Metamaterial Structures" and filed on Dec. 21, 2007, which is incorporated by reference as part of the specification of this application.

Referring back to FIGS. 4A and 4B as well as to Eq (1), in the unbalanced case where $L_RC_L \neq L_LC_R$, two different resonant frequencies $\omega_{se}$ and $\omega_{sh}$ exist and they can support an infinite wavelength. At $\omega_{se}$ and $\omega_{sh}$ the group velocity ($v_g = d\omega/d\beta$) is zero and the phase velocity ($v_p = \omega/\beta$) is infinite. When the series and shunt resonances are equal, i.e. $L_RC_L = L_LC_R$, the structure is balanced, and the resonant frequencies coincide: $\omega_{se} = \omega_{sh} = \omega_0$.

For the balanced case, the phase response can be approximated by:

$$\varphi_C = \varphi_{RH} + \varphi_{LH} = -\beta l = -\frac{Nl\omega}{c}$$

$$\varphi_{RH} \approx -N2\pi f\sqrt{L_RC_R}$$

$$\varphi_{LH} \approx \frac{N}{2\pi f\sqrt{L_LC_L}}$$

where N is the number of unit cells. The slope of the phase is given by:

$$\frac{d\varphi_{CRLH}}{df} = -N2\pi\sqrt{L_RC_R} - \frac{N}{2\pi f^2\sqrt{L_LC_L}}$$

The characteristic impedance is given by:

$$Z_o^{CRLH} = \sqrt{\frac{L_R}{C_R}} = \sqrt{\frac{L_L}{C_L}}.$$

The inductance and capacitance values can be selected and controlled to create a desired slope for a chosen frequency. In addition, the phase can be set to have a positive phase offset at DC. These two factors are used to provide the designs of multi-band and other MTM power combining and dividing structures.

The following sections provide examples of determining MTM parameters of dual-band mode MTM structures. Similar techniques can be used to determine MTM parameters with three or more bands.

In a dual-band MTM structure, the signal frequencies $f_1$, $f_2$ for the two bands are first selected for two different phase values: $\phi_1$ at $f_1$ and $\phi_2$ at $f_2$. Let N be the number of unit cells in the CRLH TL and $Z_t$, the characteristic impedance. The values for parameters $L_R$, $C_R$, $L_L$ and $C_L$ can be calculated as:

$$L_R = \frac{Z_t\left[\phi_1\left(\frac{\omega_1}{\omega_2}\right) - \phi_2\right]}{N\omega_2\left[1 - \left(\frac{\omega_1}{\omega_2}\right)^2\right]}, \quad C_R = \frac{\phi_1\left(\frac{\omega_1}{\omega_2}\right) - \phi_2}{N\omega_2 Z_t\left[1 - \left(\frac{\omega_1}{\omega_2}\right)^2\right]},$$

$$L_L = \frac{NZ_t\left[1 - \left(\frac{\omega_1}{\omega_2}\right)^2\right]}{\omega_1\left[\phi_1 - \left(\frac{\omega_1}{\omega_2}\right)\phi_2\right]}, \quad C_L = \frac{N\left[1 - \left(\frac{\omega_1}{\omega_2}\right)^2\right]}{\omega_1 Z_t\left[\phi_1 - \left(\frac{\omega_1}{\omega_2}\right)\phi_2\right]}$$

$$Z_0^{CRLH} = \sqrt{\frac{L_R}{C_R}} = \sqrt{\frac{L_L}{C_L}}$$

In the unbalanced case, the propagation constant is given by:

$$\beta = s(\omega)\sqrt{\omega^2 L_R C_R + \frac{1}{\omega^2 L_L C_L} - \left(\frac{L_R}{L_L} + \frac{C_R}{C_L}\right)}$$

$$\text{With } s(\omega) = \begin{cases} -1 & \text{if } \omega < \min(\omega_{se}, \omega_{sh}): \ LH \text{ range} \\ +1 & \text{if } \omega > \max(\omega_{se}, \omega_{sh}): \ RH \text{ range} \end{cases}$$

For the balanced case:

$$\beta = \omega\sqrt{L_R C_R} - \frac{1}{\omega\sqrt{L_L C_L}}$$

A CRLH TL has a physical length of d with N unit cells each having a length of p: d=N·p. The signal phase value is $\phi = -\beta d$. Therefore, $$\beta = -\frac{\phi}{d}, \quad \text{and } \beta_i = -\frac{\phi_i}{(N \cdot p)}$$

It is possible to select two different phases $\phi_1$ and $\phi_2$, at two different frequencies $f_1$ and $f_2$, respectively:

$$\begin{cases} \beta_1 = \omega_1\sqrt{L_R C_R} - \frac{1}{\omega_1\sqrt{L_L C_L}} \\ \beta_2 = \omega_2\sqrt{L_R C_R} - \frac{1}{\omega_2\sqrt{L_L C_L}}. \end{cases}$$

In comparison, a conventional RH microstrip transmission line exhibits the following dispersion relationship:

$$\beta_n = \beta_0 + \frac{2\pi}{p}n, \ n = 0, \pm 1, \pm 2, \ldots .$$

See, for example, the description on page 370 in Pozar, "Microwave Engineering", 3rd Edition John Wiley & Sons (2005), and page 623 in Collin, "Field Theory of Guided Waves," Wiley-IEEE Press, 2nd Edition (Dec. 1, 1990).

Dual- and multi-band CRLH TL devices can be designed based on a matrix approach described in the referenced U.S. patent application Ser. No. 11/844,982. Under this matrix approach, each 1D CRLH transmission line includes N identical cells with shunt ($L_L$, $C_R$) and series ($L_R$, $C_L$) parameters. These five parameters determine the N resonant frequencies and phase curves, corresponding bandwidth, and input/output TL impedance variations around these resonances.

The frequency bands are determined from the dispersion equation derived by letting the N CRLH cell structure resonates with $n\pi$ propagation phase length, where n=0, ±1, . . . ±(N−1). That means, a zero and $2\pi$ phase resonances can be accomplished with N=3 CRLH cells. Furthermore, a tri-band power combiner and divider can be designed using N=5 CRLH cells where zero, $2\pi$, and $4\pi$ cells are used to define resonances.

The n=0 mode resonates at $\omega_0 = \omega_{SH}$ and higher frequencies are given by the following equation for the different values of M specified in Table 1:

For $n > 0$, $$\omega_{\pm n}^2 = \frac{\omega_{SH}^2 + \omega_{SE}^2 + M\omega_R^2}{2} \pm \sqrt{\left(\frac{\omega_{SH}^2 + \omega_{SE}^2 + M\omega_R^2}{2}\right)^2 - \omega_{SH}^2\omega_{SE}^2}.$$

Table 2 provides M values for N=1, 2, 3, and 4.

TABLE 2

Resonances for N = 1, 2, 3 and 4 cells

| N\Modes | \|n\| = 0 | \|n\| = 1 | \|n\| = 2 | \|n\| = 3 |
|---|---|---|---|---|
| N = 1 | $M = 0; \omega_0 = \omega_{SH}$ | | | |
| N = 2 | $M = 0; \omega_0 = \omega_{SH}$ | M = 2 | | |
| N = 3 | $M = 0; \omega_0 = \omega_{SH}$ | M = 1 | M = 3 | |
| N = 4 | $M = 0; \omega_0 = \omega_{SH}$ | $M = 2 - \sqrt{2}$ | M = 2 | |

Figure 10:
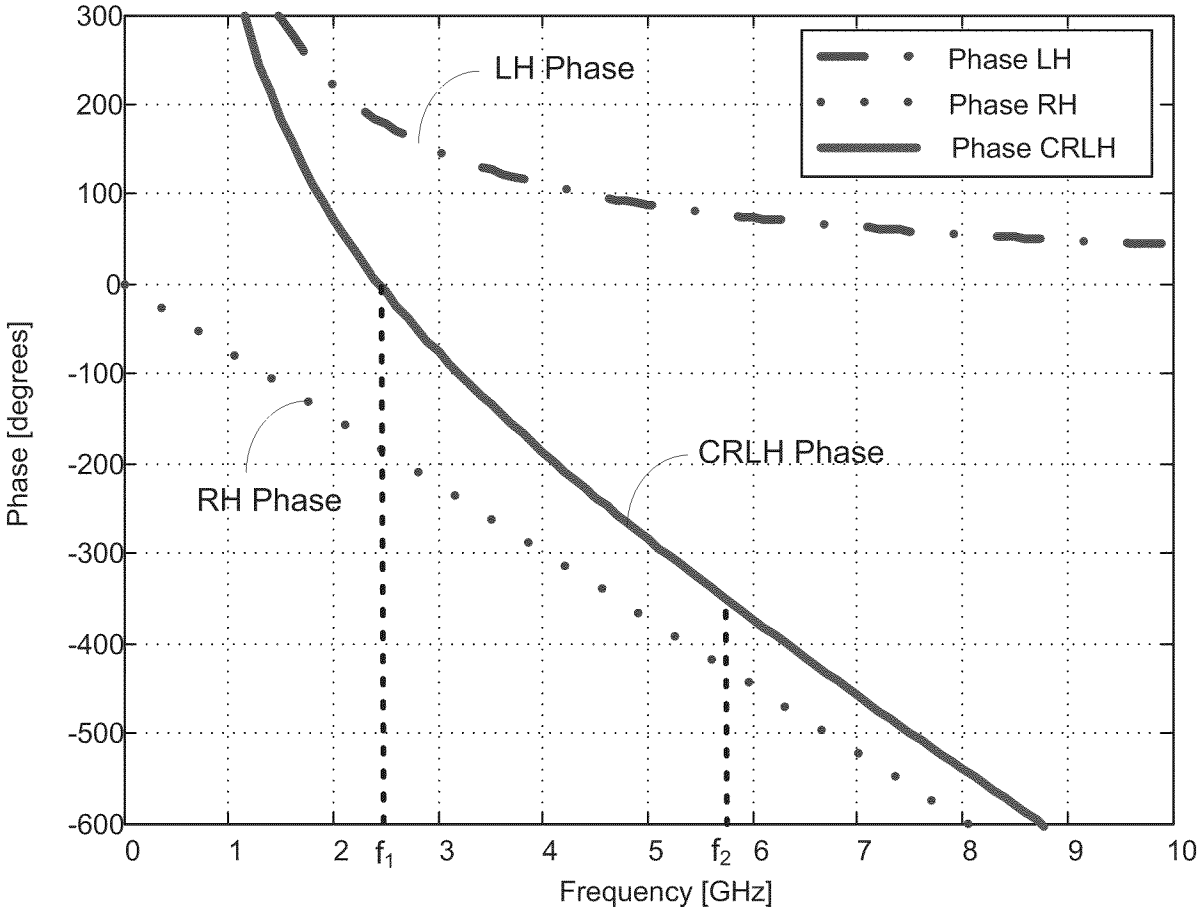
FIG. 10 shows the phase response of a CRLH transmission line which is a combination of the phase of the RH transmission line and the phase of the LH transmission line.

FIG. 10 shows an example of the phase response of a CRLH TL which is a combination of the phase of the RH components and the phase of the LH components. Phase curves for CRLH, RH and LH transmission lines are shown. The CRLH phase curve approaches to the LH TL phase at low frequencies and approaches to the RH TL phase at high frequencies. It should be noted that the CRLH phase curve crosses the zero-phase axis with a frequency offset from zero. This offset from zero frequency enables the CRLH curve to be engineered to intercept a desired pair of phases at any arbitrary pair of frequencies. The inductance and capacitance values of the LH and RH can be selected and controlled to create a desired slope with a positive offset at the zero frequency (DC). By way of example, FIG. 10 shows that the phase chosen at the first frequency $f_1$ is 0 degree and the phase chosen at the second frequency $f_2$ is −360 degrees. The two frequencies $f_1$ and $f_2$ do not have a harmonic frequency relationship with each other. This feature can be used to comply with frequencies used in various standards such as the 2.4 GHz band and the 5.8 GHz in the Wi-Fi applications. A zero degree CRLH transmission line refers to a case in which the CRLH unit cell is configured to provide a phase offset of zero degree at an operating frequency.

Figure 11A:
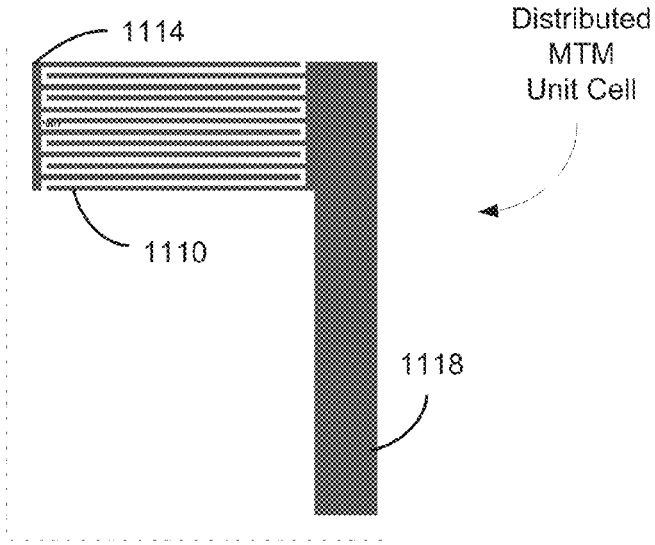
FIGS. 11A and 11B show a distributed MTM unit cell and a zero degree CRLH transmission line based on the MTM unit cell.

FIG. 11A shows an example of a distributed MTM unit cell structure that can be used in the design of the zero degree CRLH transmission line. Various configurations for distributed MTM unit cells are possible and some examples are described and analyzed in Caloz and Itoh, "Electromagnetic Metamaterials: Transmission Line Theory and Microwave Applications," John Wiley & Sons (2006).

In FIG. 11A, the MTM unit cell includes a first set of connected electrode digits 1110 and a second set of connected electrode digits 1114. These two sets of electrode digits are separated without direct contact and are spatially interleaved to provide electromagnetic coupling with one another. A perpendicular stub electrode 1118 is connected to the first set of connected electrode digits 1110 and protrudes along a direction that is perpendicular to the electrode digits 1110 and 1110. The perpendicular stub electrode 1118 is connected to the ground electrode to effectuate the LH shunt inductor. In one example, various dimensions are specified as follows. The cell is designed for a 1.6 mm thick FR4 substrate. The series capacitance comprises an interdigital capacitor that has 12 digits, each digit with 5 mil width. The spacing between the digits is 5 mil. The length of each digit is 5.9 mm. The shunt inductor is a shorted stub of length 7.5 mm and width 1.4 mm. The stub 1118 is shorted to the ground using a via with 10 mil diameter.

Figure 11B:
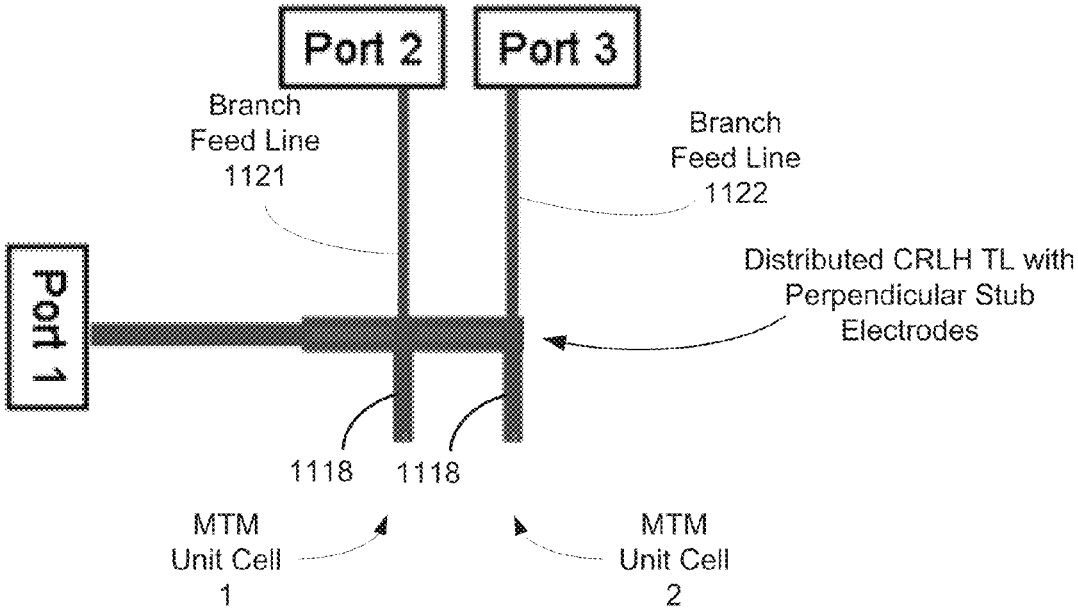

FIG. 11B shows an example of a 3-port CRLH transmission line power divider and combiner based on the distributed CRLH unit cell in FIG. 11A. This 3-port CRLH TL power divider and combiner is shown to include two unit cells in FIG. 11A with perpendicular shorted stub electrodes 1118. Two branch feed lines 1121 and 1122 are connected to the two MTM cells, respectively, to provide two branch ports 2 and 3. The distributed CRLH transmission line can be structured as a zero degree transmission line to form a zeroth order power combiner and divider with the structure in FIG. 11B.

Figure 11C:
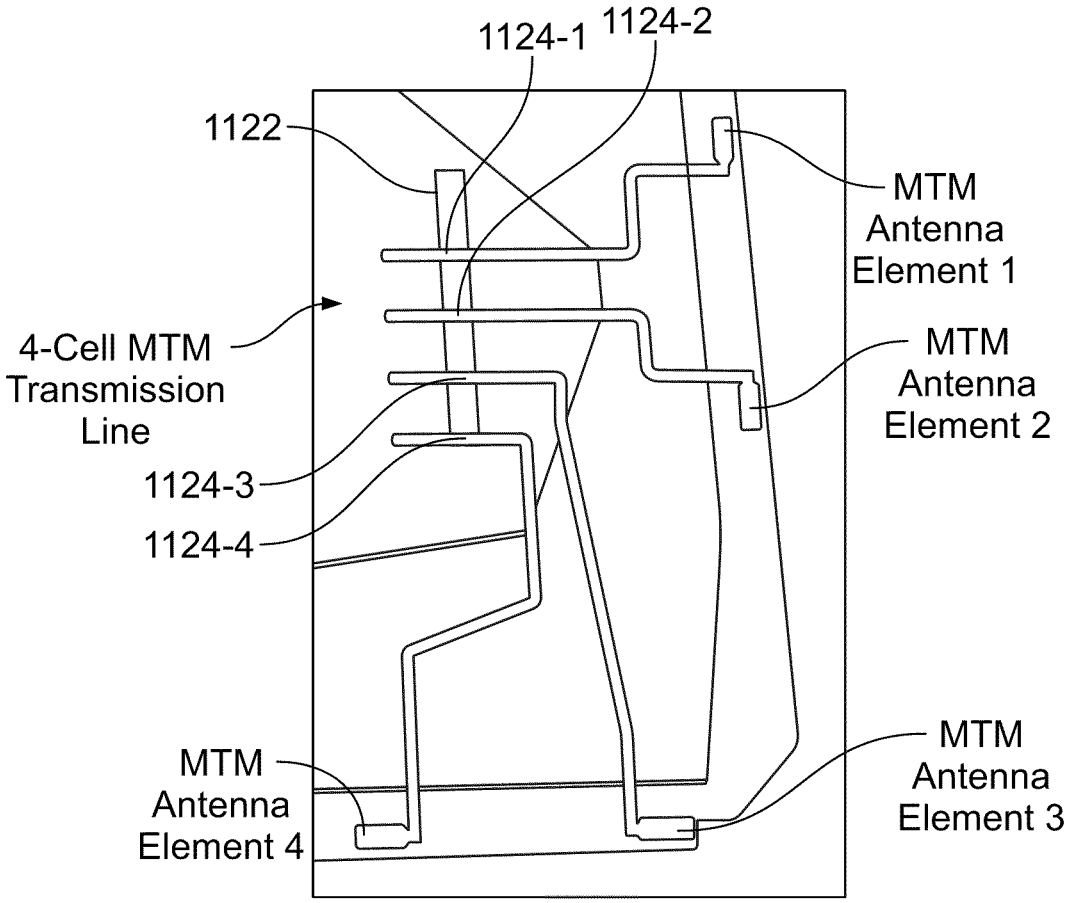
FIG. 11C shows an example of a 4-antenna MTM array with a zero degree CRLH transmission line for shaping the radiation pattern.

FIG. 11C shows an example antenna system that uses a 4-branch zero degree CRLH transmission line for shaping the radiation pattern emitted by two adjacent MTM antenna elements of four MTM antenna elements. In this example, the four MTM antenna elements 1-4 are formed by four MTM unit cells are connected in series with four feed lines to form two sets of 2-antenna MTM arrays where the adjacent antenna elements 1 and 2 are located close to each other on one edge of the circuit board as the first set and the adjacent antenna elements 3 and 4 are located close to each other on another edge of the circuit board as the second set. The 4-branch zero degree CRLH transmission line is based on the distributed MTM unit cell design in FIGS. 11A and 11B. The signal input from the input point 1122 of the TL is split at the four output points 1124-1 through 1124-4. The TL is designed so that the phase offset between two neighboring split signals at 1124-1 and 1124-2 is zero degree and the phase offset between two neighboring split signals at 1124-3 and 1124-4 is zero degree. The radiation patterns can be changed by changing the distances among antennas, and the differences in length among the feed lines and thus the phase offsets. Each feed line connects one of the output points 1124-1 through 1124-4 with the corresponding antenna. These output points are independent due to the design of the zero-degree CRLH TL, and thus the individual MTM antennas can be treated independently. Therefore, performance of the pattern shaping device by use of the zero degree CRLH transmission line does not depend on the number of antennas connected.

Figure 11D:
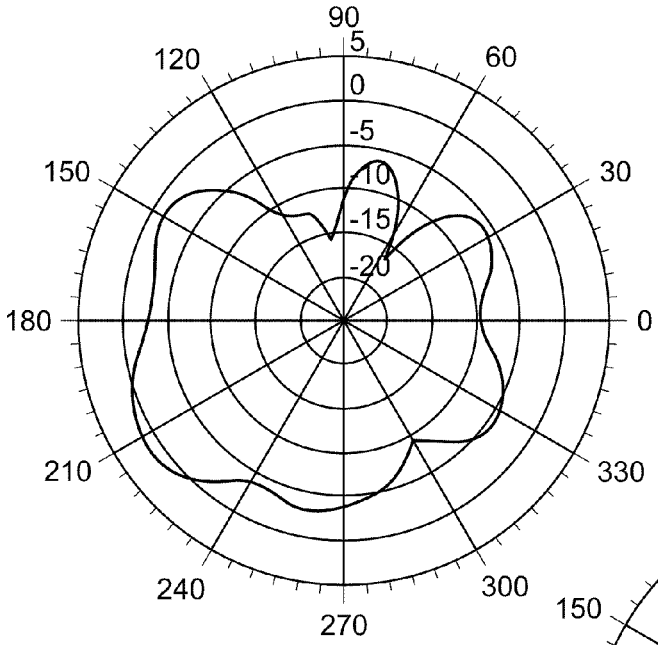
FIG. 11D shows radiation patterns of the 4-antenna MTM array with the zero degree CRLH transmission line in three different planes.
Figure 11D:
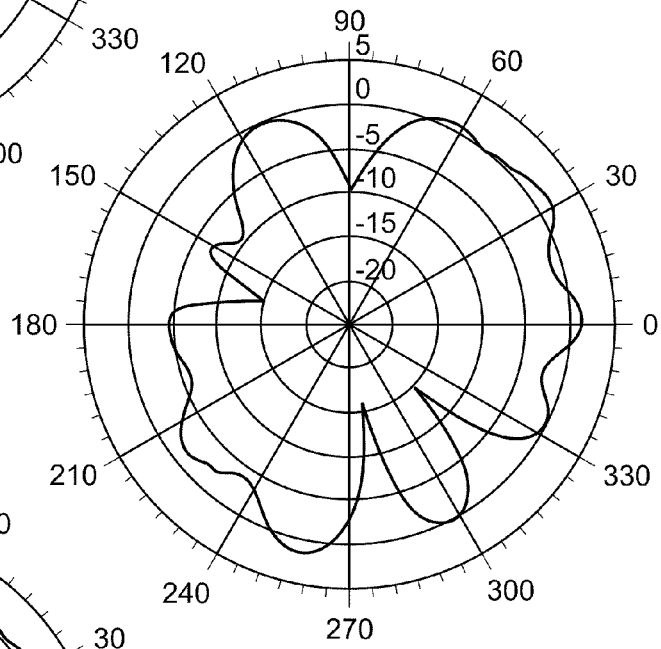
Figure 11D:
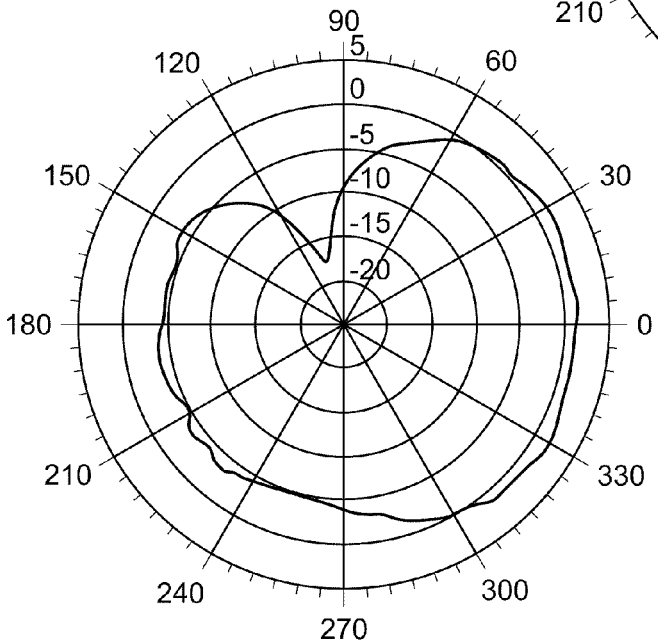

FIG. 11D shows the measured radiation patterns in the XY, XZ and YZ planes for the case of using two sets of the 2-antenna MTM arrays (i.e. total of four MTM antennas) with the zero degree CRLH transmission lines. The radiation pattern is shaped with the maximum gain of 2.9 dBi in the XY-plane at θ=210 degree and a rejection of greater than 10 dB in the XY-plane at θ=90 degree.

Shaping of the radiation pattern can be achieved by using an MTM directional coupler. The theory and analysis on the design of MTM couplers are described in U.S. Provisional Patent Application Ser. No. 61/016,392 entitled "Advanced Metamaterial Multi-Antenna Subsystems," filed on Dec. 21, 2007, which is incorporated by reference as part of the specification of this application, and summarized below.

Figure 12:
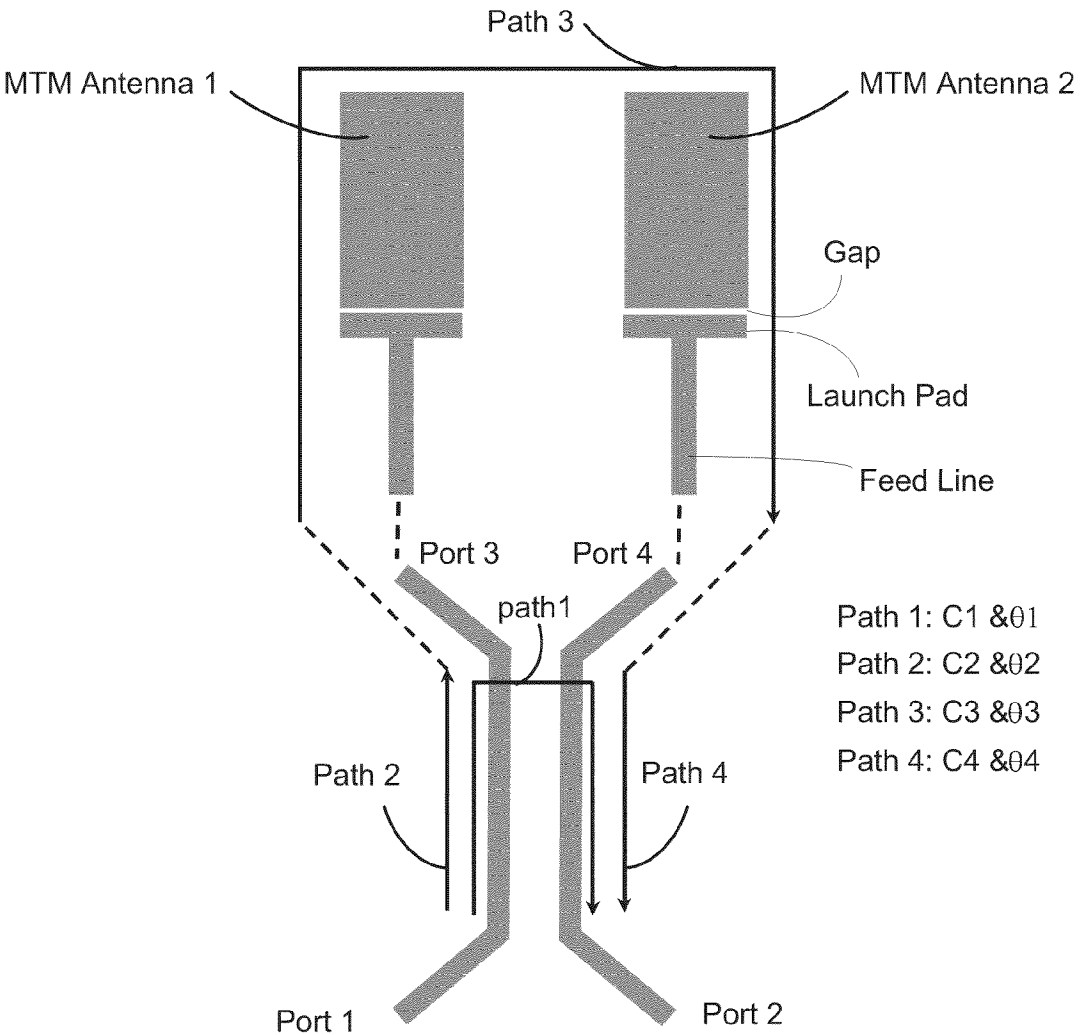
FIG. 12 shows an example of a four-port directional coupler with coupling magnitudes and phases for four different paths.

The technical features associated with the MTM coupler can be used to decouple multiple coupled antennas using a four-port microwave directional coupler as shown in FIG. 12. In this figure, the coupling magnitude and phase for path 1 through path 4 are represented as Cn and θn, respectively, where n=1, 2, 3, 4. In the ideal situation where $$C_1=C_2*C_3*C_4$$

$$\theta 2+\theta 3+\theta 4-\theta 1=-180°$$

the zero coupling between two input ports can be obtained. Thus, the MTM coupler can be configured to increase isolation between different signal ports and restore orthogonality between multi-path signals at the output.

Figure 13A:
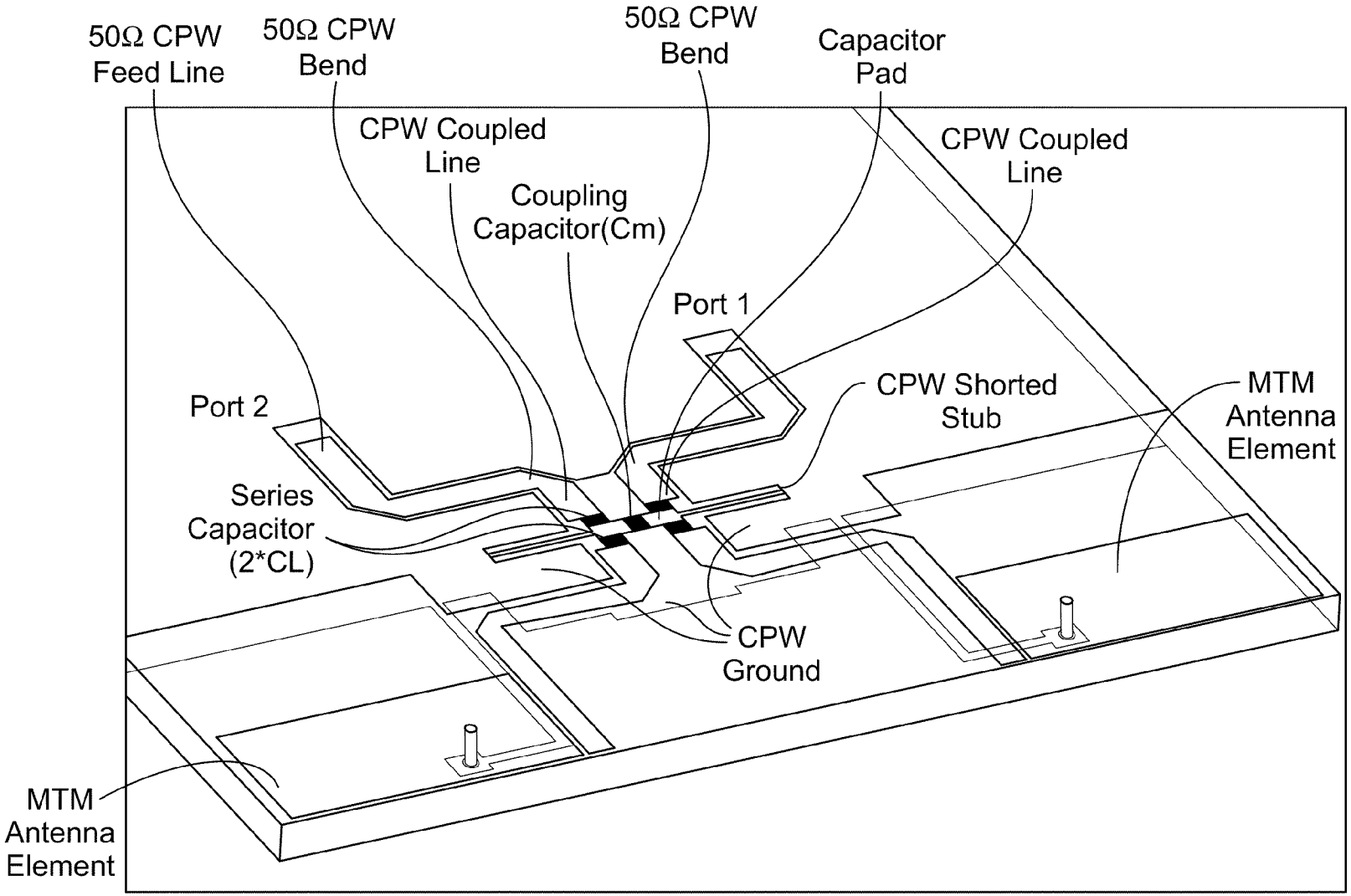
FIG. 13A shows an example of a 2-antenna MTM array with a directional MTM coupler for shaping the radiation pattern.

In the example shown in FIG. 13A, a directional MTM coupler is used to offset the antenna feed signals to create an orthogonal radiation pattern set at the two input ports for antennas. The MTM directional coupler has four input/output ports, where in this example port 1 and port 2 are used for RF inputs and the two outputs are connected to the 2-antenna MTM array. In this example, the dimensions of various parts of the MTM coupler are specified as follows. The total CPW feed line length including two rectangular CPW sections and two CPW bends are 0.83 mm×4.155 mm with 0.15 mm slot width. This CPW feed line has a characteristic impedance of around 500. The connection side of the CPW bend has 0.83 mm width. The coupling portion of this coupler is realized by a CPW MTM coupled line where two CPW MTM transmission lines are placed in parallel to each other with a coupling capacitor Cm connecting in between. The total length of the one cell CPW MTM coupled line in this example is 4.4 mm and the gap between two CPW MTM transmission lines is 1 mm. The chip capacitor of 0.4 pF ($C_m$) is used here to enhance the coupling between two CPW MTM transmission lines. Each CPW MTM transmission line comprises two segments of CPW lines, a capacitor pads, two series capacitors ($2*C_L$) and one shorted stub. All the CPW segments are identical in this MTM coupler design and each section is 0.83 mm×1.5 mm. Two CPW sections on one side are connected by two series capacitors of $2C_L$. The capacitor pad between the two CPW segments is a metal base to mount the series capacitors on. In this example $C_L$ is realized by using a chip capacitor of 1.5 pF. The spacing between the CPW segment and the capacitor pad is 0.4 mm. The size of the capacitor pad is 0.6 mm×0.8 mm. The shorted stub is implemented by using a CPW stub where one side of the CPW stub is attached to the capacitor pad and the other side is connected directly to the CPW ground. The CPW stub is 0.15 mm×2.5 mm with 0.225 mm slot width in this example.

Figure 13B:
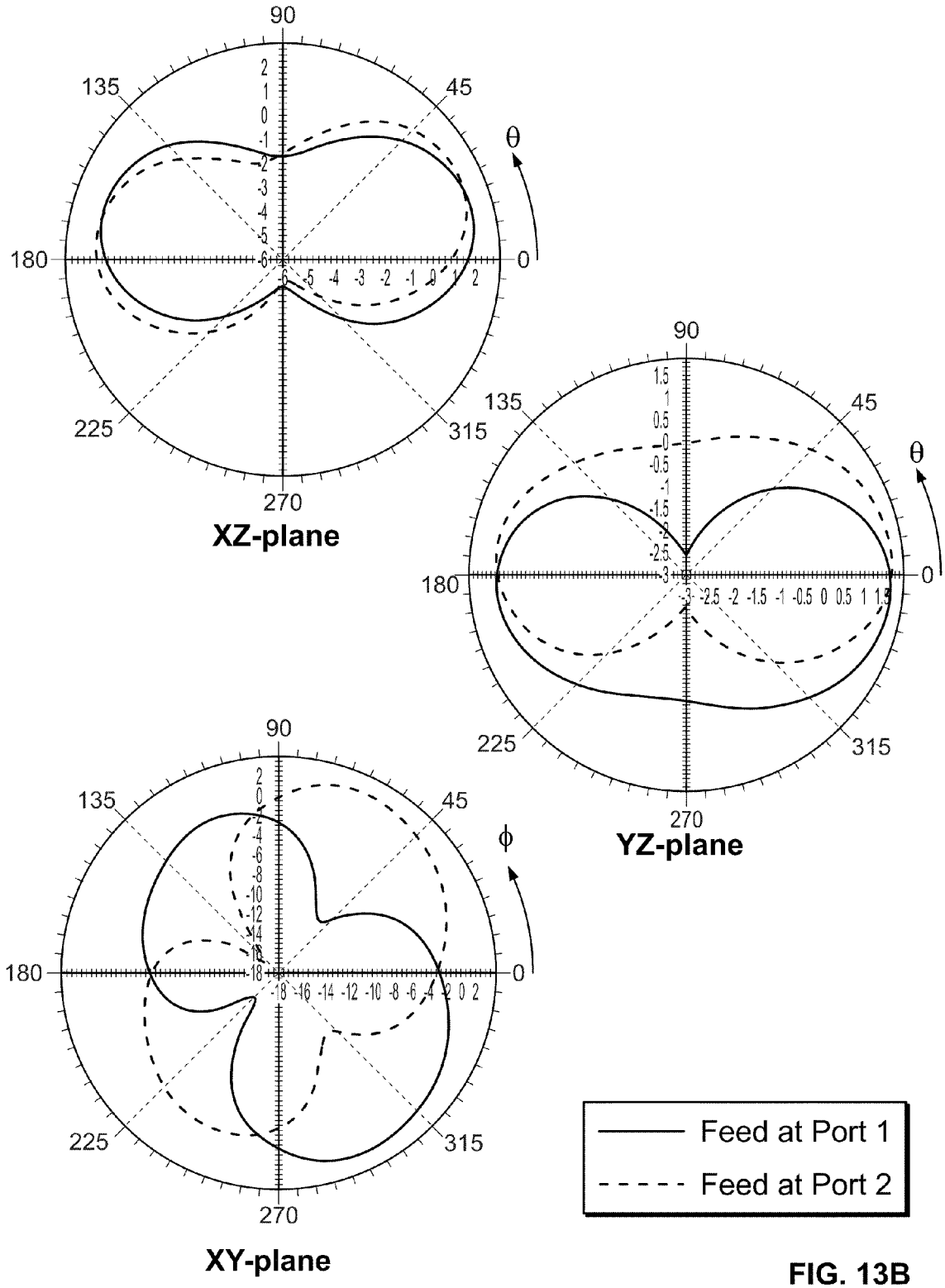
FIG. 13B shows radiation patterns of the 2-antenna MTM array with the directional MTM coupler in three different planes.

FIG. 13B shows the measured radiation patterns of the 2-antenna MTM array with the MTM coupler. Here, the signal patterns at port 1 and port 2 are created to be orthogonal to each other based on the decoupling scheme explained earlier. Generally, the physical size of a conventional RH coupler is determined by the operating frequency and the phase θ1. As a result, the circuit size becomes too large to fit in certain wireless communication systems. In contrast, the present technique by use of the MTM coupler provides size reduction owing to its design, and thus is useful in these size-limited applications.

In another radiation shaping technique, a single negative metamaterial (SNG) is used between two MTM antennas to direct the radiation patterns in certain directions. The SNG materials, which are also known as electromagnetic bandgap (EBG) structures in microwave regimes, are types of materials that are characterized by (∈×μ)<0 in their effective frequency bands, where ∈ is permittivity and μ is permeability of the SNG material. In these frequency bands the SNG materials don't support propagation of wave. See, for example, "Metamaterials: Physics and Engineering Explorations," John Wiley (June 2006).

In the present example, this property associated with SNG materials is utilized for shaping radiation patterns of two closely spaced antennas. When antennas are closely spaced, the mutual coupling between the antennas is high and significantly reduces efficiency of antennas. By using the SNG material between the two antennas, the radiation pattern can be shaped to be orthogonal while reducing the mutual coupling. As a result this technique improves isolation and efficiency while directing the radiation patterns.

Figure 14A:
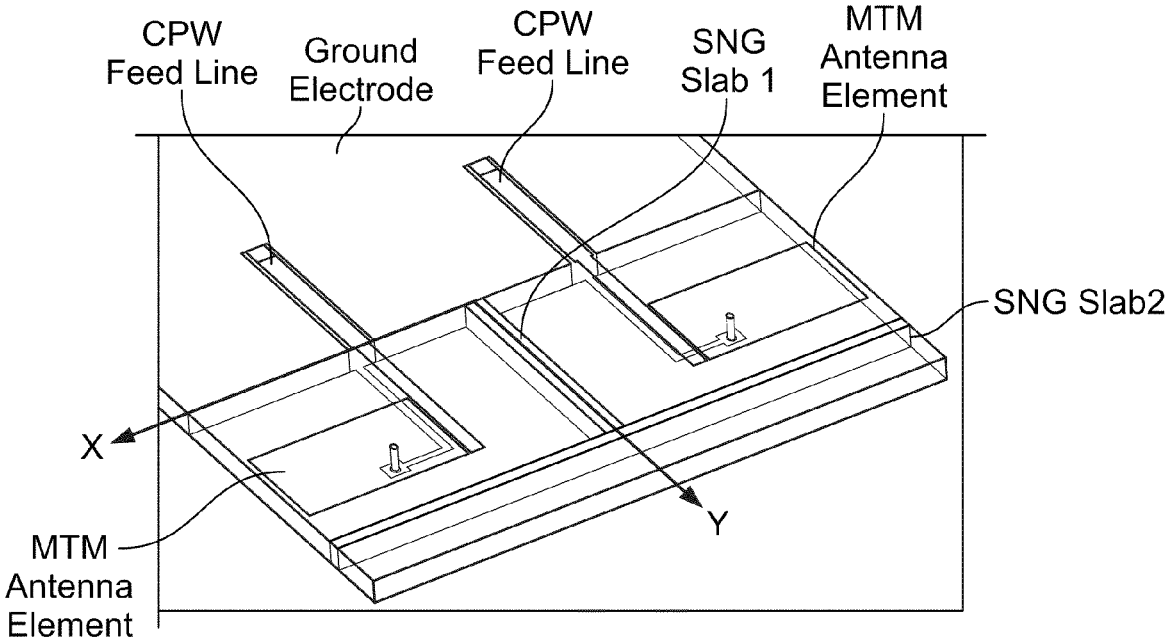
FIG. 14A shows an example of a 2-antenna MTM array with SNG slabs for shaping the radiation pattern.
Figure 14B:
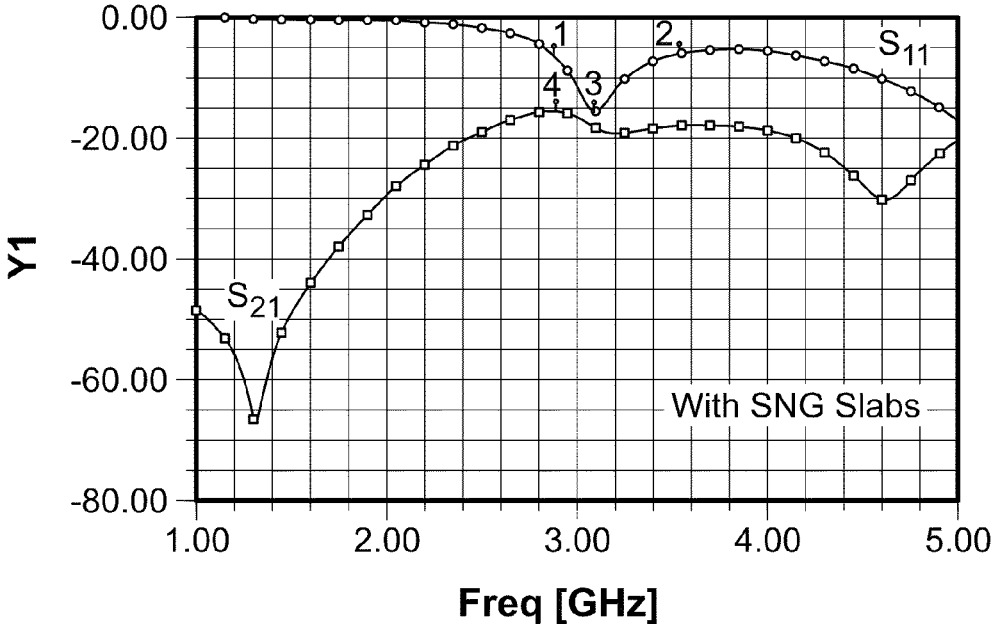
FIG. 14B shows simulated magnitudes of the S-parameters of the 2-antenna MTM array with the SNG slabs.

FIG. 14A shows an example of using SNG materials to suppress coupling between the two MTM antennas. The maximum coupling without the SNG material between the antennas is −5.77 dB. In this example, two slabs of SNG are inserted in the substrate: SNG Slab 1 in between the two MTM antennas, and SNG Slab 2 above the two MTM antennas as shown in FIG. 14A. In one example, the width in the X-direction of SNG Slab 1 is 0.8 mm, the width in the Y-direction of SNG. Slab 2 is 0.6 mm, $\in=-600$ and $\mu=1$, the spacing between the two antennas is 9.2 mm, and the Slab 2 is placed 1.9 mm away toward the positive Y-direction from the edge of the antennas. The return loss and the coupling between the antennas are shown in FIG. 14B for the case of using the SNG slabs. The graph shows that the operating frequency region of the antennas shifts slightly toward the higher region, but the coupling decreases to −15.38 dB from −5.77 dB. It should be mentioned that it is possible with optimizing the dimension of the antennas to adjust the operating frequency band of the antennas to original one.

Figure 14C:
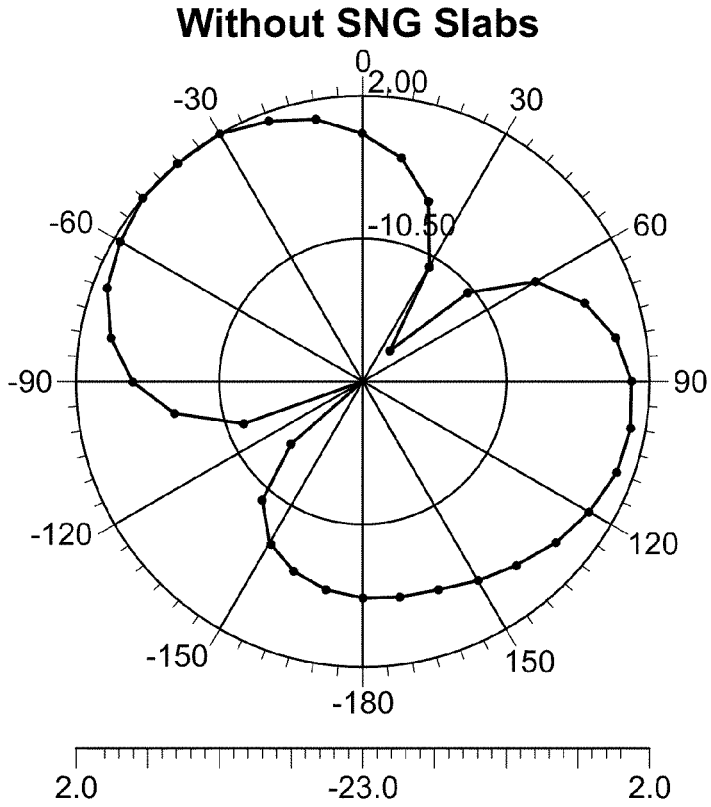
FIG. 14C shows radiation patterns of the 2-antenna MTM array without the SNG slabs.
Figure 14D:
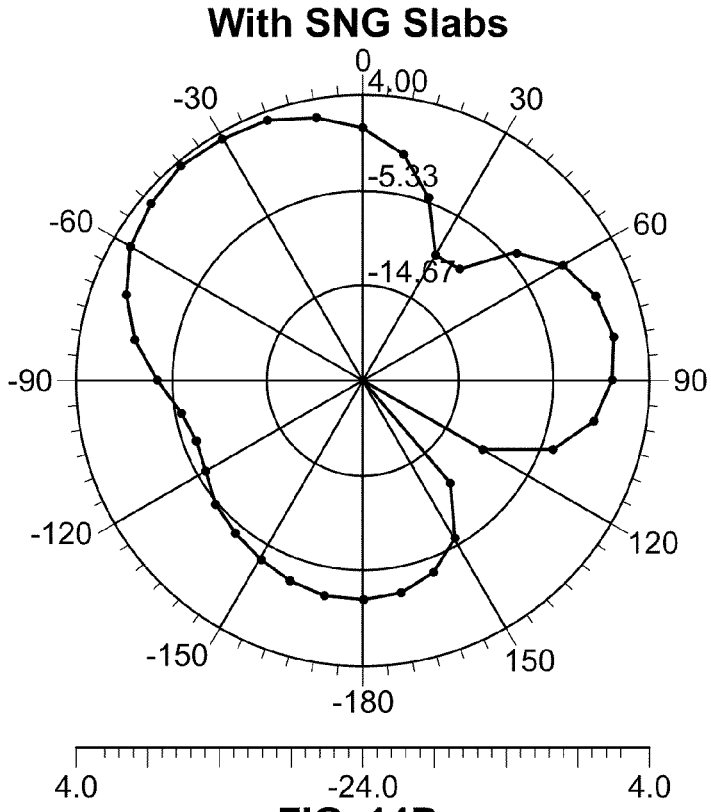
FIG. 14D shows radiation patterns of the 2-antenna MTM array with the SNG slabs.

The radiation patterns in the XY-plane for the cases without and with the SNG slabs are shown in FIGS. 14C and 14D, respectively. Comparing these plots clarifies that the radiation pattern becomes more directive in the presence of the SNG slabs. The maximum gain in the system without the SNG slabs is 2.27 dB at 2.63 GHz; however, after implementing the SNG slabs it increases to 3.448 dB at 3.09 GHz.

A power combiner or divider can be structured in a radial configuration terminated with switching devices to provide the antenna switching circuit in FIGS. 1A, 1B and 1C. The theory and analysis on the design of power combiners and dividers based on CRLH structures are summarized earlier in this application in conjunction with the zero degree CRLH transmission lines. The details are described in U.S. patent application Ser. No. 11/963,710 entitled "Power Combiners and Dividers Based on Composite Right and Left Handed Metamaterial Structures."

Figure 15A:
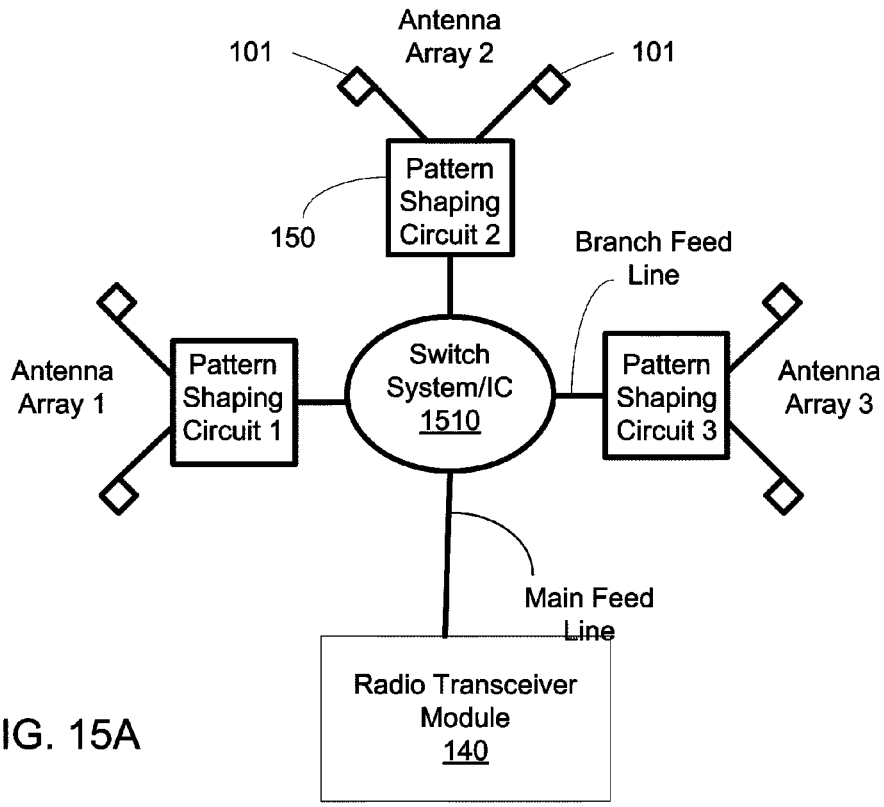
FIGS. 15A and 15B show two examples of an antenna switching circuit in FIG. 1C.
Figure 15B:
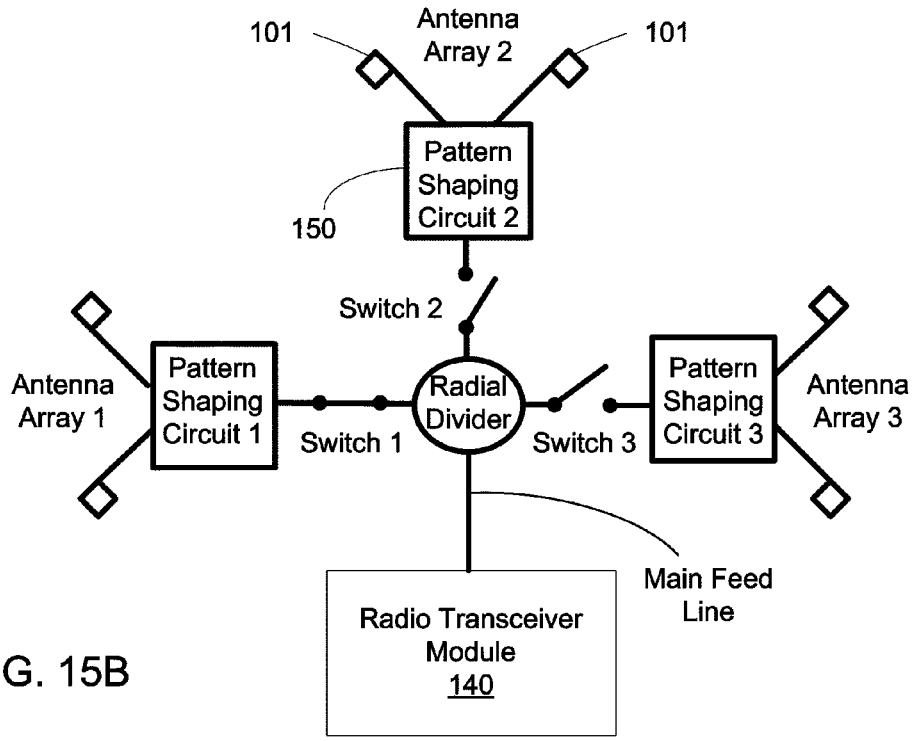

Referring back to FIG. 1C, the antenna switching circuit 170 can be implemented in various configurations. FIGS. 15A and 15B show two examples for 2-element MTM antenna arrays. The design in FIG. 15A uses a 1×N switch 1510 to connect the radio transceiver module 140 to the pattern shaping circuits 150 for different antenna arrays 160. The design in FIG. 15B uses a radio power divider and combiner and switching elements in the branches to control which antenna array is activated. In the example illustrated, the antenna array #1 is activated to be connected for RF transmission and reception while the other two antenna arrays are deactivated.

Figure 16B:
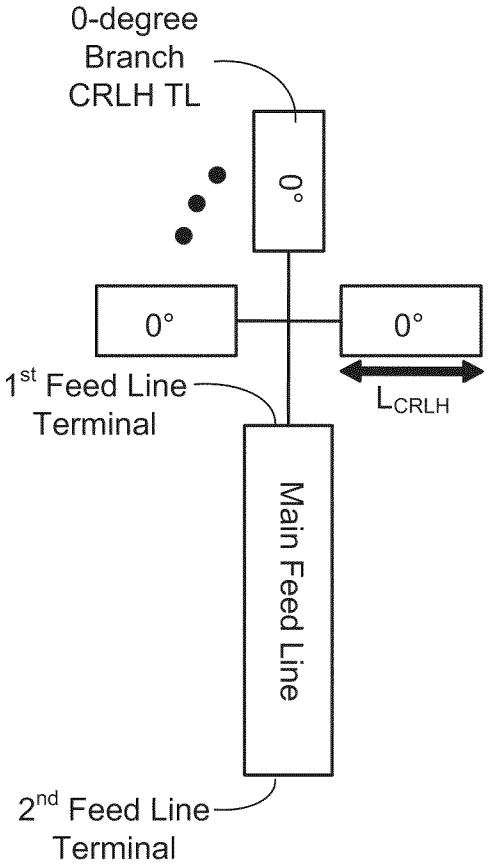
FIG. 16B shows an example of an N-port radial power combiner/divider using a zero degree CRLH transmission line.
Figure 16A:
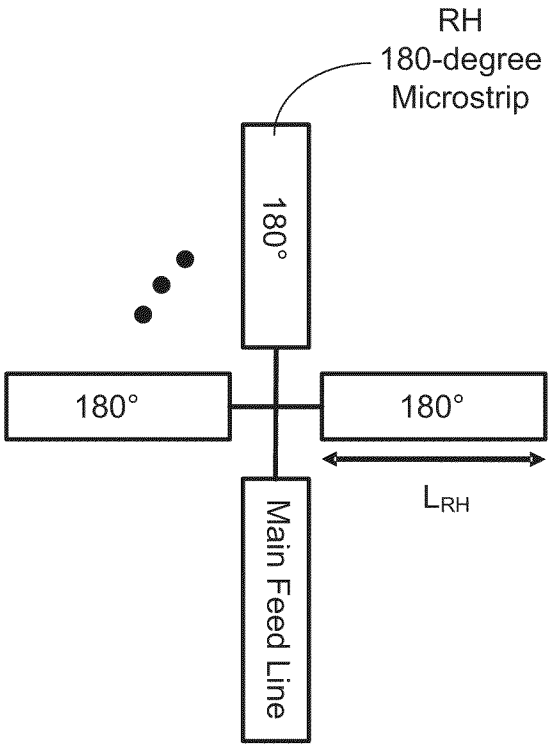
FIG. 16A shows an example of a conventional N-port radial power combiner/divider.

FIG. 16A shows an example of a conventional single-band N-port radial power combiner/divider formed by using conventional RH microstrips with an electrical length of 180° at the operating frequency. A feed line is connected to terminals of the RH microstrips to combine power from the microstrips to output a combined signal or to distribute power in a signal received at the feed line into signals directed to the microstrips. The lower limit of the physical size of such a power combiner or divider is limited by the length of each microstrip with an electrical length of 180 degrees.

FIG. 16B shows a single-band N-port CRLH TL radial power combiner/divider. This device includes branch CRLH transmission lines each formed on the substrate to have an electrical length of zero degree at the operating frequency. Each branch CRLH transmission line has a first terminal that is connected to first terminals of other branch CRLH TLs and a second terminal that is open ended or coupled to an electrical load. A main signal feed line is formed on the substrate to include a first feed line terminal electrically coupled to the first terminals of the branch CRLH transmission lines and a second feed line terminal that is open ended or coupled to an electrical load. This main feed line is to receive and combine power from the branch CRLH transmission lines at the first feed line terminal to output a combined signal at the second feed line terminal or to distribute power in a signal received at the second feed line terminal into signals directed to the first terminals of the branch CRLH transmission lines for output at the second terminals of the branch CRLH transmission lines, respectively. Each CRLH TL in FIG. 16B can be configured to have a phase value of zero degree at the operating frequency to form a compact N-port CRLH TL radial power combiner/divider. The size of this zero degree CRLH TL is limited by its implementation using lumped elements, distributed lines or a "vertical" configuration such as MIMs.

In FIG. 16B, each CRLH transmission line includes one or more CRLH MTM unit cells coupled in series. Various MTM unit cell configurations can be used for forming such CRLH transmission lines. The U.S. patent application Ser. No. 11/963,710 includes some examples of MTM unit cell designs. FIG. 11A shows an example of a distributed MTM unit cell.

Figure 17A:
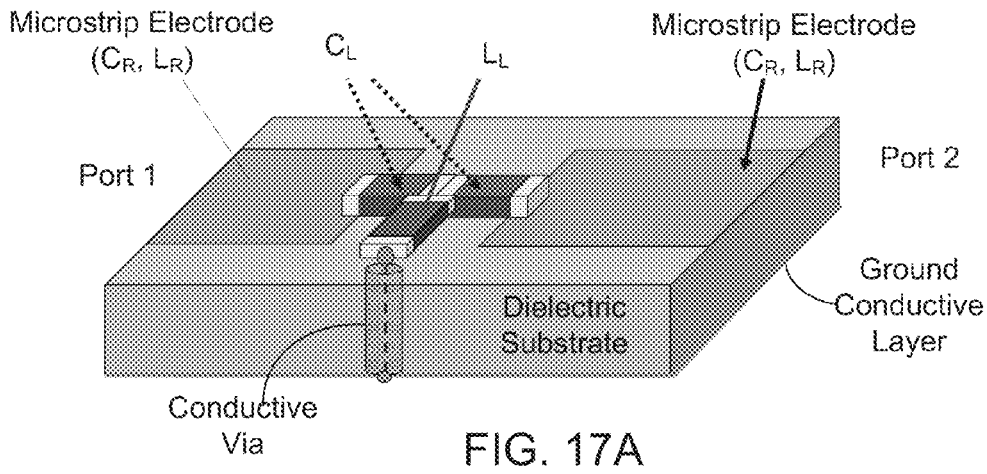
FIGS. 17A and 17B shows examples of MTM unit cells based on lumped components.
Figure 17B:
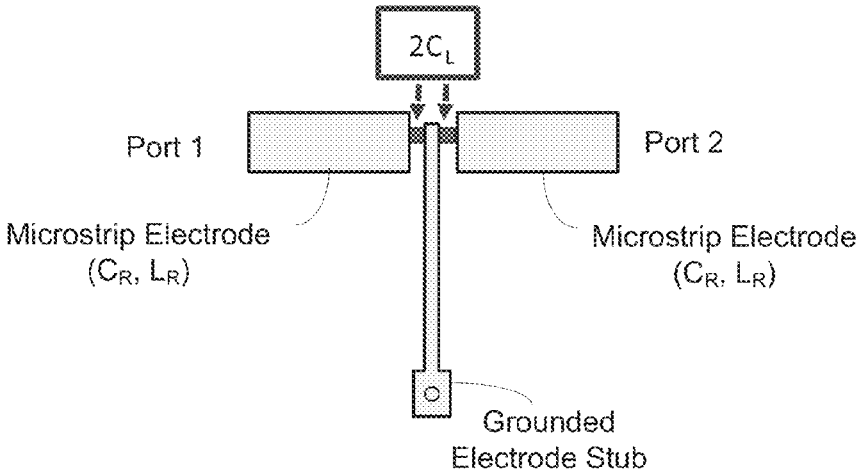
Figure 17C:
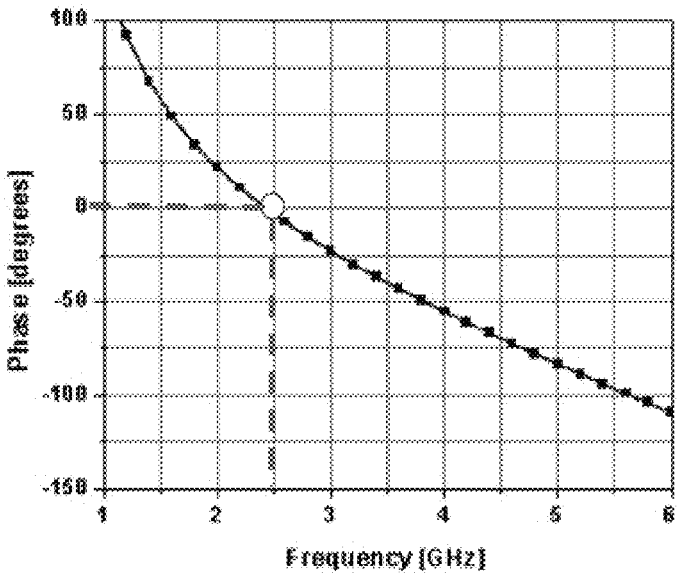
FIG. 17C shows the phase response of the zero degree CRLH transmission line used for the 2-port transmission line with a single MTM unit cell in FIG. 17B.

FIGS. 17A and 17B show two examples of MTM unit cells with lumped elements for the LH part and microstrips for the right hand parts. In FIG. 17A, microstrips are used to connect different unit cells in series and separated and capacitively coupled capacitors $C_L$ are coupled between the microstrips. The LH shunt inductor $L_L$ is a lumped inductor element formed on the top of the substrate. In FIG. 17B, the LH shunt inductor is a printed inductor element formed on the top of the substrate. The single MTM unit cell in FIG. 17B can be configured as a 2-port CRLH TL zero-degree single band radial power combiner/divider. FIG. 17C presents phase response of the unit cell in FIG. 17B as a function of frequency. The phase difference of zero degree at 2.4 GHz is indicated in FIG. 17C.

Figure 18A:
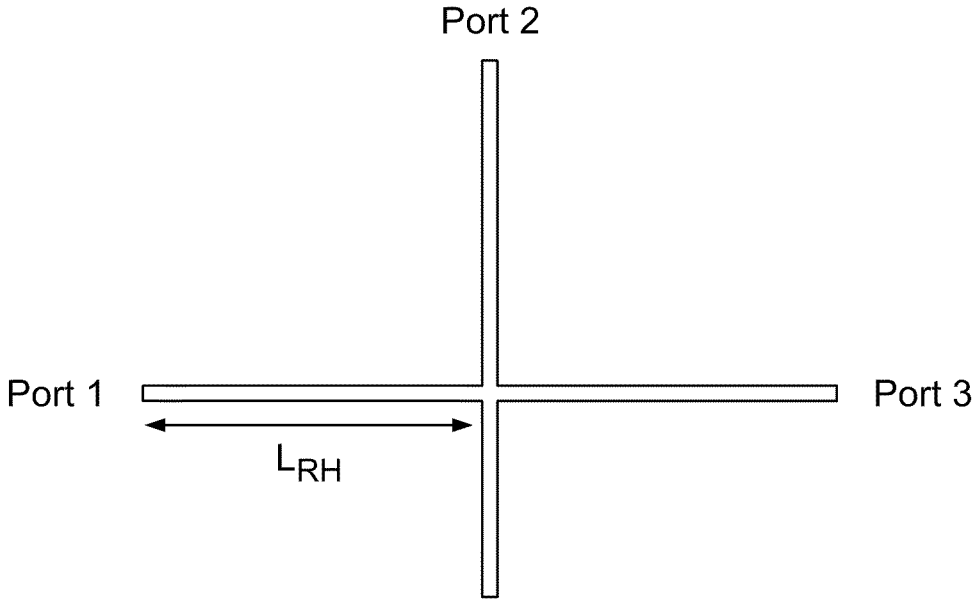
FIG. 18A shows an example of a conventional 3-port radial power combiner/divider.

FIG. 18A shows an example of a conventional (RH) 3-port single-band radial power combiner/divider, which is a special case of the conventional (RH) single-band N-port radial power combiner/divider, shown in FIG. 16A. The lower limit of the physical size of such a power combiner/divider is limited by the length of each microstrip with the electrical length of 180 degrees. This corresponds to the physical electrical length $L_{RH}$ of 33.7 mm by using the FR4 substrate with height of 0.787 mm.

Figure 18B:
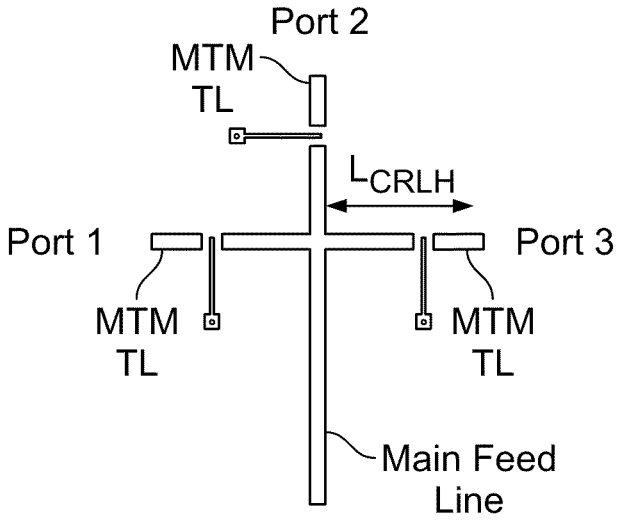
FIG. 18B shows an example of a 3-port radial power combiner/divider using a zero degree CRLH transmission line.

FIG. 18B shows an example of a 3-port CRLH zero-degree radial power combiner/divider device. This is a special case of the single-band N-port CRLH TL radial power combiner/divider shown in FIG. 16B, with the use of a zero-degree CRLH TL unit cell, shown in FIG. 17B for each branch. Each of the branch CRLH transmission lines has an electrical length of zero degree at the operating frequency. This corresponds to the physical electrical length $L_{CRLH}$ of 10.2 mm by using the FR4 substrate with height of 0.787 mm. Thus, the ratio of the dimensions of the two devices in FIGS. 18A and 18B is roughly 3:1. By way of example, the parameter values in the equivalent circuit for the zero-degree CRLH TL presented are: $C_L$=1.6 pF, $L_L$=4 nH and are implemented with lumped capacitors. For the right-hand part of the values chosen are: $L_R$=2.65 nH and $C_R$=1 pF. These values are implemented by using conventional microstrip, by way of example on the substrate FR4 ($\in_r$=4.4, H=0.787 mm).

Figure 18C:
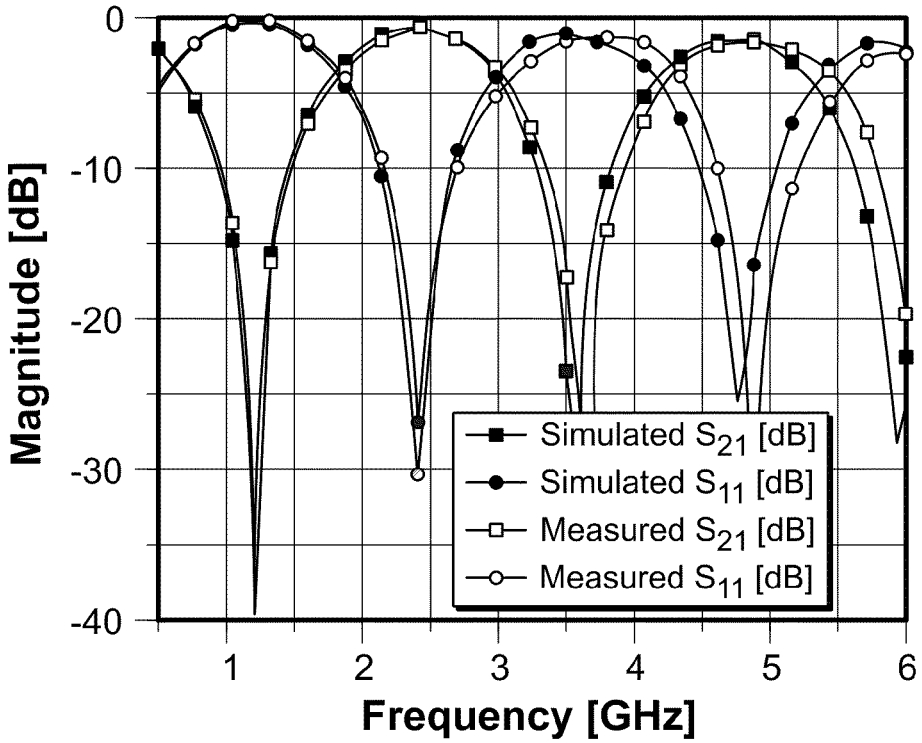
FIG. 18C shows simulated and measured magnitudes of the S-parameters for the conventional 3-port radial power combiner/divider in FIG. 18A.
Figure 18D:
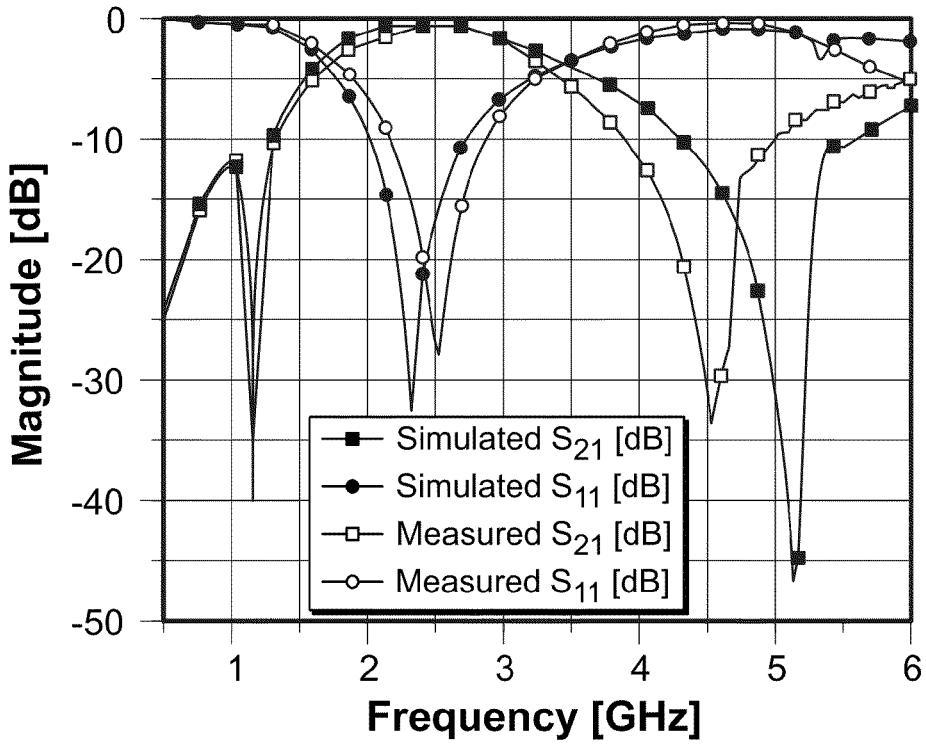
FIG. 18D shows simulated and measured magnitudes of the S-parameters for the 3-port radial power combiner/divider using the zero degree CRLH transmission line.

FIG. 18C shows the simulated and measured magnitudes of the S-parameters for the 3-port RH 180-degree microstrip radial power combiner/divider device, with $|S_{21@2.425\ GHz}|$=−0.631 dB and $|S_{11@2.425\ GHz}|$=−30.391 dB. FIG. 18D shows the simulated and measured magnitudes of the S-parameters for the 3-port CRLH TL zero-degree single band radial power combiner/divider, with $|S_{21@2.528\ GHz}|$=−0.603 dB and $|S_{11@2.528\ GHz}|$=−28.027 dB. There is a slight shift in the frequency between the simulated and measured results, which may be attributed to the lumped elements used. In both cases, $S_{21}$ at 2.45 GHz is good. Namely, the transmission is good from the feed line to one of the output terminals with the open mismatch due to the other output terminals. A slight improvement in the $S_{21}$ value is noted in the case of the CRLH TL zero-degree single band radial power combiner/divider.

Figure 19B:
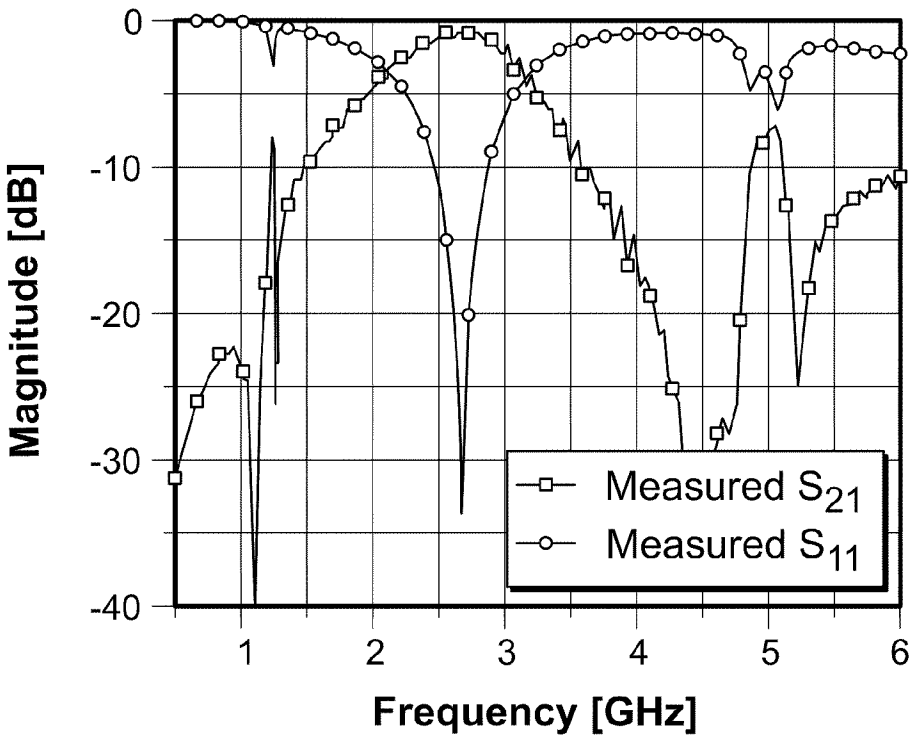
FIG. 19B shows measured magnitudes of the S-parameters of the 5-port radial power combiner/divider using the zero degree CRLH transmission line in FIG. 19A.
Figure 19A:
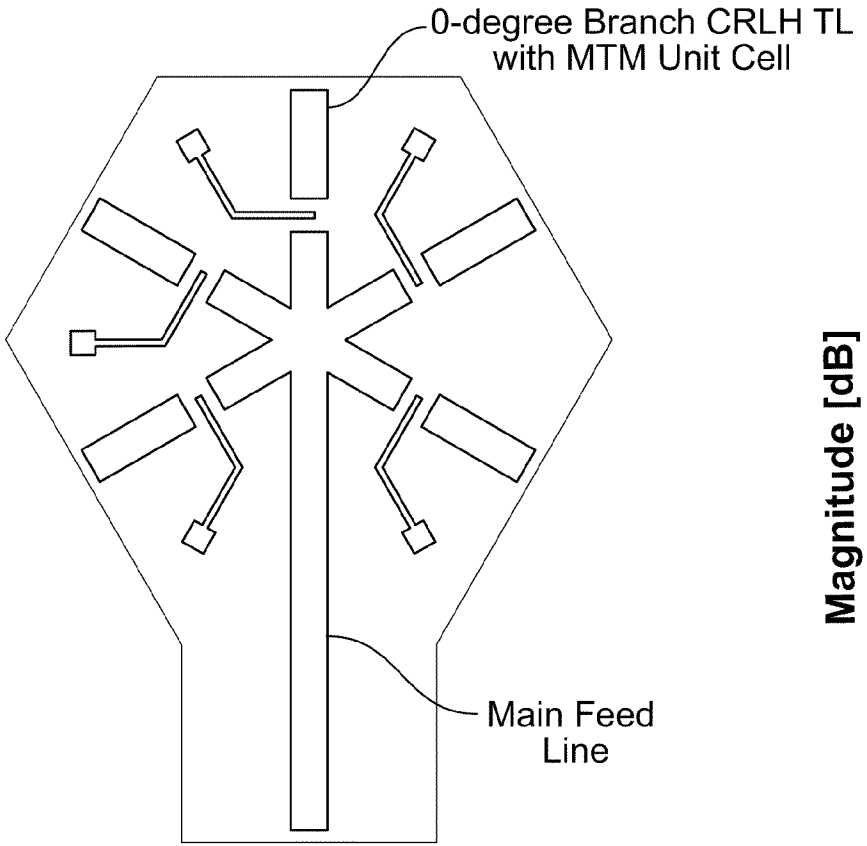
FIG. 19A shows an example of a 5-port radial power combiner/divider using a zero degree CRLH transmission line.

FIG. 19A shows an example of a 5-port CRLH TL zero degree single band radial power combiner/divider. As an example, this 5-port device can be implemented by using the zero-degree CRLH TL unit cell in FIG. 17B to form the 3-port CRLH TL zero degree single band radial power combiner/divider in FIG. 18B. FIG. 19B shows the measured magnitudes of the S-parameters for this implementation. The measured parameters are $|S_{21@2.665\ GHz}|$=−0.700 dB and $|S_{11@2.665\ GHz}|$=−33.84373 dB with a phase of 0°@2.665 GHz. The $S_{21}$ value indicates good performance for the 5-port device.

Figure 20A:
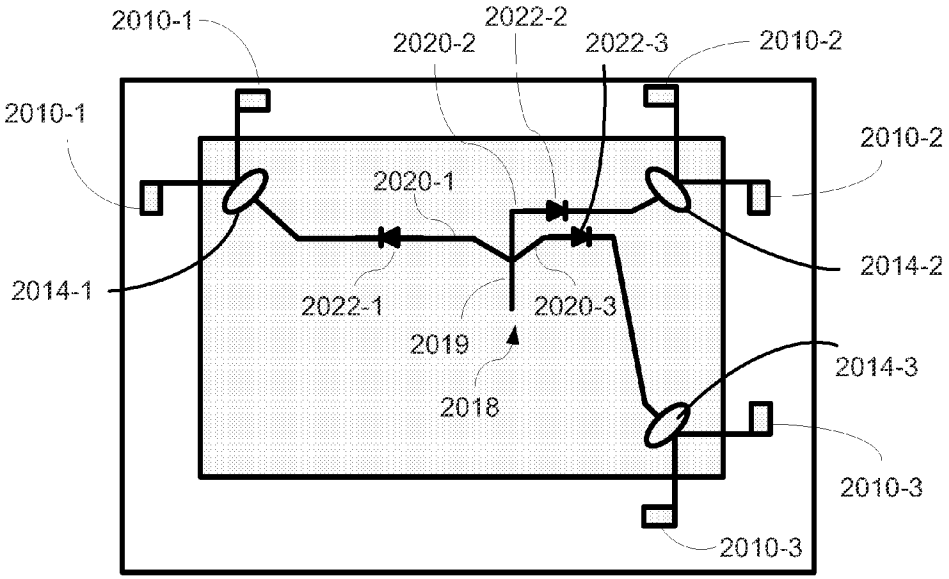
FIG. 20A shows an example of an antenna system with 6-antenna elements for radiation pattern shaping and beam switching.

FIG. 20A shows an example of an antenna system with radiation pattern shaping and beam switching using the MTM antenna arrays. This system enables at least one of the radiation patterns from the antenna arrays to be switched on at a time so as to direct the beam to the desired direction. This system can be implemented to achieve a high gain in a particular direction (e.g., 2-4 dB) that may be difficult to achieve with a conventional omni-directional antenna. In the example shown in FIG. 20A, the antenna system comprises three sets of 2-antenna MTM arrays 2010-1, 2010-2 and 2010-3. The two MTM antennas in each array are combined with the same phase by using a Wilkinson power combiner 2014. The RF signal is switched among the antenna subsets by using a radial power combiner/divider 2018 that includes a main feed line 2019 and three branch feed lines 2020-1, 2020-2 and 2020-3. Three switching elements (e.g., diodes) 2022-1, 2022-2 and 2022-3 are placed in the branch feed lines 2020-1, 2020-2 and 2020-3 at approximately λ/2 from the splitting point, where λ is the wavelength of the propagating wave. In one example, the switching diodes are 2022-1, 2022-2 and 2022-3 placed at ~36 mm from the split point for optimal performance at the operation frequency of 2.4 GHz.

Figure 20B:
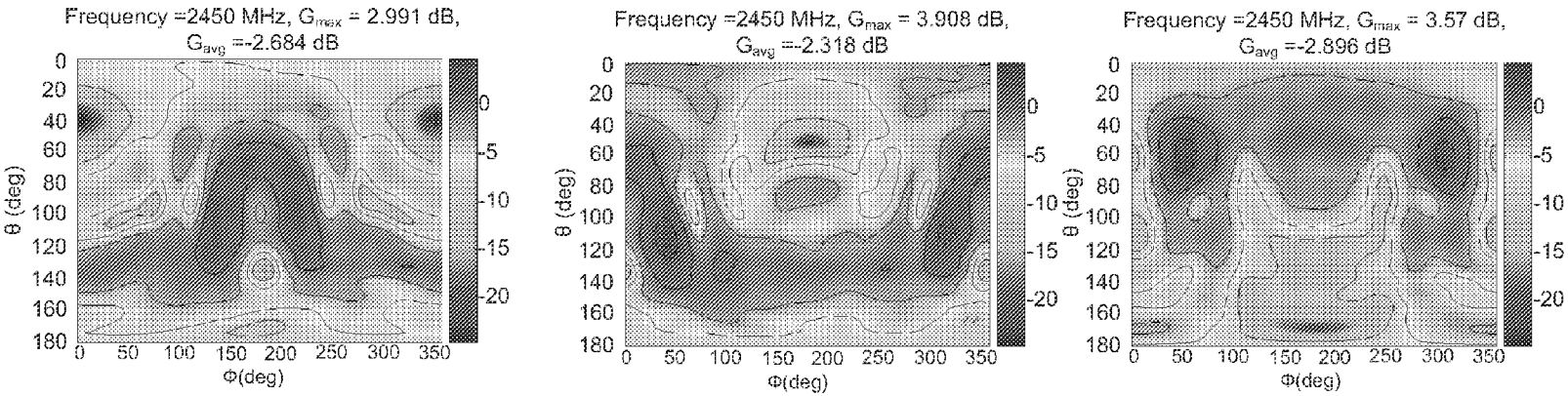
FIG. 20B shows radiation patterns of the three antenna subsets in the antenna system in FIG. 20A.

FIG. 20B shows the radiation patterns of the three antenna subsets 2010-1, 2010-2 and 2010-3. Each figure in FIG. 20B shows the 3D radiation pattern of the antenna unwrapped onto a 2D surface. The intensity of radiation is color coded. Blue color shows regions of low intensity, and red color shows regions of high intensity. The radiation patterns indicate that these three antenna subsets create three non-overlapping radiation patterns with good coverage in all directions.

Figure 21:
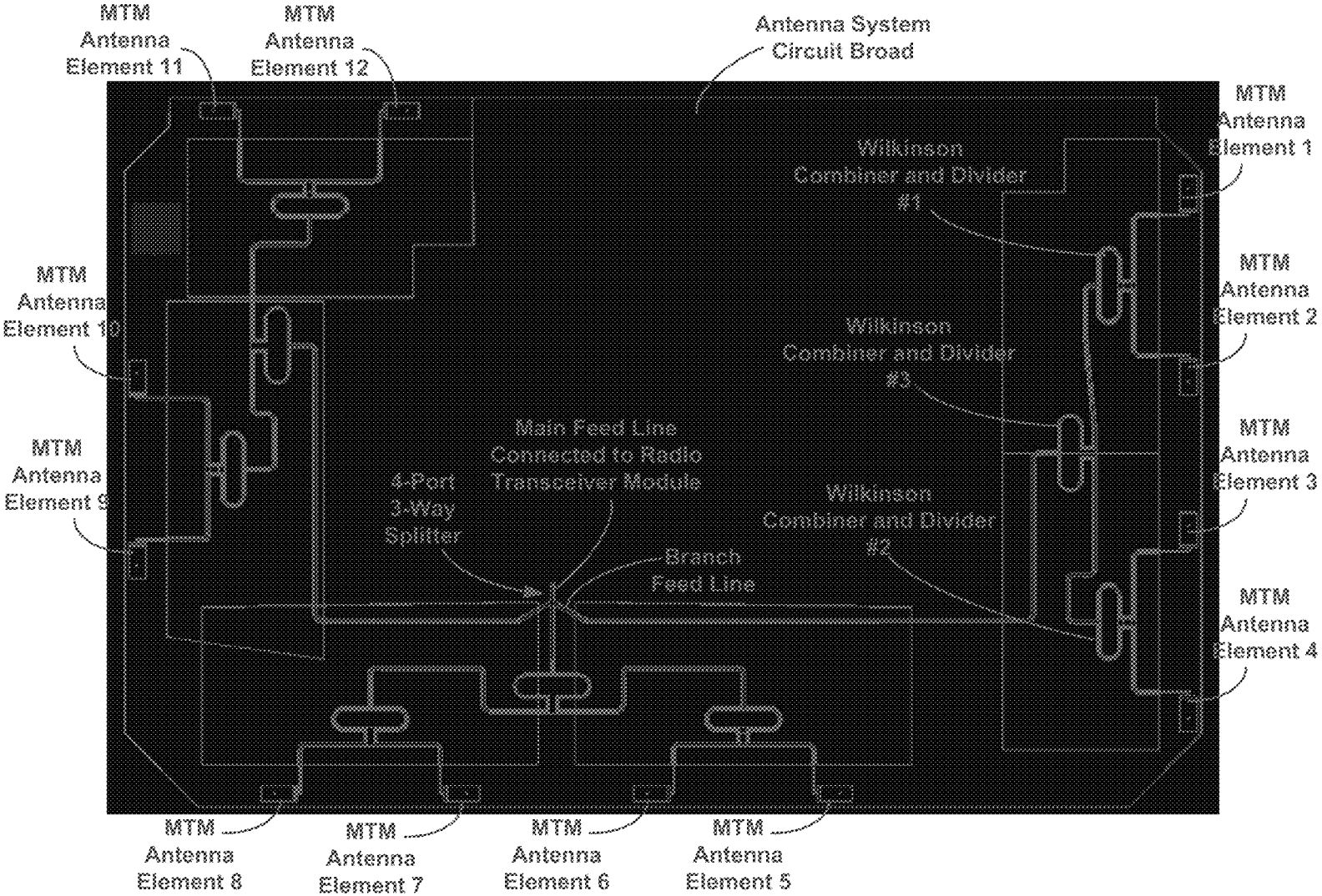
FIG. 21 shows an example of an antenna system with 12-antenna elements for radiation pattern shaping and beam switching.

FIG. 21 shows an example of a compact 12-antenna array formed on a PCB for a wireless transceiver such as a WiFi access point transceiver. The twelve MTM antenna elements are formed near edges of the PCB as shown to form 6 antenna pairs with adjacent MTM antenna elements 1 and 2 being the first pair, adjacent MTM antenna elements 3 and 4 being the second pair, etc. These pairs of 2 antenna elements can be configured to be identical to one another in structure but are placed at different locations on the PCB. The 2 antenna elements of each pair are identical but printed in opposite directions to minimize coupling and maximize the diversity gain. In addition, the antenna elements are grouped into three groups where the first group includes antenna elements 1-4, the second group includes antenna elements 5-8 and the third group includes antenna elements 9-12. A 4-port RF coupler is provided to connect the 12 MTM antenna elements to the radio transceiver module where the main feed line of the coupler is connected to the radio transceiver module and three branch feed lines are connected to the three antenna groups, respectively.

Referring to the first antenna group with antenna elements 1-4, three Wilkinson combiners 1, 2 and 3 are formed to connect these antenna elements to a respective branch feed line of the 4-port coupler. The Wilkinson combiner 1 is located and coupled to the first pair of antenna elements 1 and the Wilkinson combiner 2 is located and coupled to the second pair of antenna elements 3 and 4. The Wilkinson combiner 3 has its main feed line coupled to the 4-port coupler and is coupled to the main feed lines of the Wilkinson combiners 1 and 2 so that an RF signal from the 4-port coupler is first split into first and second RF signals by the Wilkinson combiner 3 with the first RF signal being fed to the Wilkinson combiner 1 and the second RF signal being fed to the Wilkinson combiner 2. Each of the Wilkinson combiners 1 and 2 further splits a respective RF signal into two portions for the respective two antenna elements.

In each group of two antenna pairs, the 4 antenna elements are combined in phase using Wilkinson combiners 1-3 to form a single combined antenna. Three such combined antennas are obtained from the 12 antennas. These three combined antennas provide patterns with higher gain and increased interference mitigation. These three are connected to the RF port through a 3 way radial combiner. Each of the antennas can be switched ON/OFF via PIN diodes placed on the lines connecting the combiner to the antenna. For the central branch, because of the small space, the PIN diode is as close as possible to the combiner. For the 2 other branches, the diodes are place ½ wavelength away from the combiner.

Figure 6C:
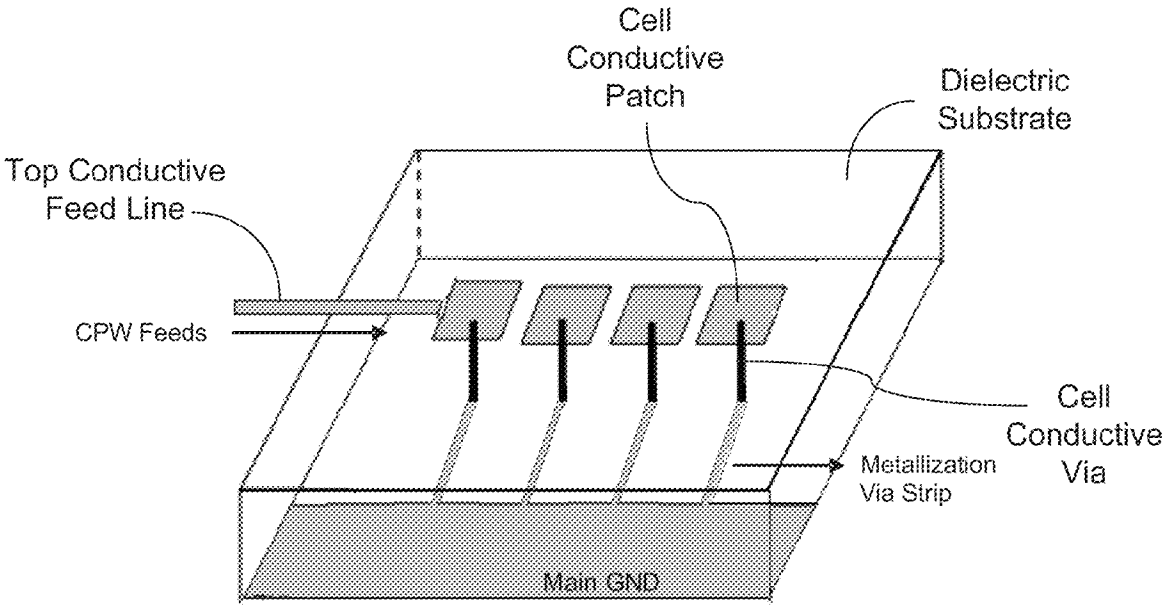
FIG. 6C shows an example of a CRLH MTM antenna with four MTM cells with a truncated ground conductive layer design based on the structure in FIG. 6A.
Figure 7E:
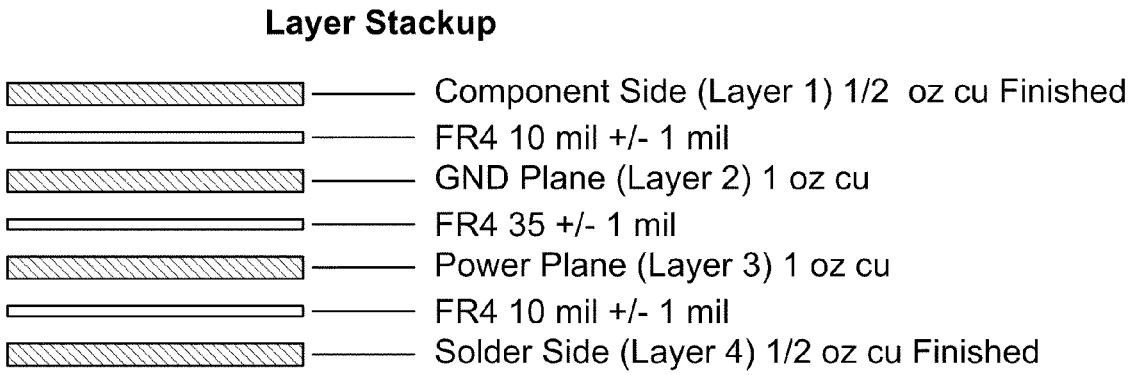
FIG. 7E shows an example of a FR4 printed circuit board for forming the structure shown in FIGS. 7A-7D.

Table 3 shows the antenna specification of a prototype of this 12-antenna system formed in a 4-layer FR4 substrate. The designs of each antenna element and a pair of antenna elements are shown in FIGS. 7A-7E. Table 4 details the different parts that constitute each antenna element used in the prototype and Table 4 provides the values of the antenna parameters. The thickness of each layer and the metalization layers is shown in FIG. 6. The top printed layer is shown in FIG. 7E.

TABLE 3

| Antenna specification | |
|---|---|
| Frequency Range | 2.4-2.52 GHz |
| Isolation | −12 dB |
| Peak Gain | 2 dBi |

TABLE 4

| Antenna element parts | | | |
|---|---|---|---|
| Parameter | Description | | Location |
| Antenna Element | Each antenna element consists of an MTM Cell connected to the 50 Ω CPW line via a Launch Pad and Feed Line. Both Launch Pad and Feed Line are located on the top of the FR4 substrate. | | |
| Feed Line | Connects the Launch Pad with the 50 Ω CPW line. | | Layer 1 |
| Launch Pad | Rectangular shape that connects MTM cell to the Feed Line. There is a gap, $W_{Gap}$, between the launch pad and MTM cell. Please refer to Table 2 for the mm value. | | Layer 1 |
| MTM Cell | Cell Patch | Rectangular shape | Layer 1 |
| | Via | Cylindrical shape and connects the Cell Patch with the GND Pad. | |
| | GND Pad | Small pad that connects the bottom part of the via to the GND Line. | Layer 4 |
| | GND Line | Connects the GND Pad, hence the MTM cell, with the main GND | Layer 4 |

TABLE 5

| Antenna array dimension and location | | | |
|---|---|---|---|
| Parameter | Description | Value | Location |
| $L_{Total}$ | Total length of the antenna portion | 8 mm | |
| $W_{Total}$ | Total width of the antenna portion | 41.6 mm | |
| $h_{Total}$ | Total substrate thickness | 1.6 mm | |
| $L_{CPW}$ | The length of the CPW feed | 10 mm | Layer 1 |
| $W_{CPW}$ | The width of the CPW feed | 17 mils | Layer 1 |
| $W_{CPW\ GAP}$ | Width of the gap between the CPW line & GND | 6.5 mils | Layer 1 |
| $L_{Cell}$ | Length of the Cell Patch | 6.2 mm | Layer 1 |
| $W_{Cell}$ | Width of the Cell Patch | 3 mm | Layer 1 |
| $W_{Gap}$ | Gap between Cell Patch and Launch Pad | 0.1 mm | Layer 1 |
| $D_{Via}$ | Diameter of the via | 0.25 mm | |
| $L_{Pad}$ | Length of the Launch Pad | 0.5 mm | Layer 1 |
| $W_{Feed}$ | Width of the Feed | 0.3 mm | Layer 1 |
| $L1_{Feed}$ | Length of the feed connecting to the CPW line | 5.35 mm | Layer 1 |
| $L2_{Feed}$ | Length of the feed connecting from the Launch Pad | 0.8 mm | Layer 1 |
| $L_{GND\ Pad}$ | Length of GND Pad | 1 mm | Layer 4 |
| $W_{GND\ Pad}$ | Width of the GND Pad | 0.762 mm | Layer 4 |
| $L1_{GND\ Line}$ | Length of the line connecting to the bottom GND | 5.35 mm | Layer 4 |
| $L2_{GND\ Line}$ | Length of the line connecting from the GND Pad | 4.7 mm | Layer 4 |
| $W_{GND\ Line}$ | Width of the GND Line | 0.2 mm | Layer 4 |

Only a few implementations are disclosed above. However, it is understood that variations and modifications may be made. For example, instead of using a conventional microstrip (RH) transmission line to couple the pattern shaping circuit with the MTM antenna, a CRLH transmission line may be used to obtain an equivalent phase with a smaller footprint than the conventional RH transmission line. In another example, a zeroth-order resonator may be used as the pattern shaping circuit. In yet another example, a feed line or transmission line can be implemented in various configurations including but not limited to microstrip lines and coplanar waveguides (CPW), and the MTM transmission lines. Various RF couplers can be used for implementing the techniques described in this application, including but not limited to directional couplers, branch-line couplers, rat-race couplers, and other couplers that can be used based on the required phase offset between the two output feeds to the antennas. Furthermore, any number of MTM antennas can be included in one array, and the number of antennas in an array can be varied from one array to another.

While this specification contains many specifics, these should not be construed as limitations on the scope of an invention or of what may be claimed, but rather as descriptions of features specific to particular embodiments of the invention. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or a variation of a subcombination.

Only a few examples and implementations are described. Other implementations, variation and enhancements can be made based on the disclosure of this application.

What is claimed is:

1. A communication system, comprising:

a ground electrode; and an antenna structure, comprising an input portion;

a radiating portion;

a capacitance element formed between the input portion and the radiating portion; and a shunt inductive element coupled between the radiating portion and the ground electrode, the shunt inductive element forming a shunt inductance from the radiating portion to the ground electrode, wherein the capacitance element forms a series capacitance between the input portion and the radiating portion, and wherein the communication system forms a Composite Right/Left-Handed (CRLH) structure having the series capacitance and the shunt inductance.

2. The communication system as in claim 1, wherein the ground electrode is formed in a first substrate layer and the radiating portion of the antenna structure is formed in a second substrate layer separated from the first substrate layer by a dielectric layer, and wherein the ground electrode does not substantially overlap a footprint of the radiating portion of the antenna structure.

3. The communication system as in claim 2, wherein the antenna structure is a monopole antenna structure.

4. The communication system as in claim 2, wherein the antenna structure is a printed conductive structure on a dielectric substrate.

5. The communication system as in claim 3, wherein the capacitance element is formed by a gap in the printed conductive structure between the input portion and the radiating portion of the antenna structure so as to form a capacitive coupling therebetween.

6. The communication system as in claim 2, wherein the ground electrode is isolated from the input portion of the antenna structure.

7. The communication system as in claim 2, wherein the shunt inductive element comprises a conductive line.

8. The communication system as in claim 7, wherein the series capacitance has a corresponding series resonance frequency, and the shunt inductance has a corresponding shunt resonance frequency.

9. The communication system as in claim 7, wherein the dimensions and placement of the ground electrode, radiating portion, and shunt inductive element determine an operating bandwidth of the antenna structure.

10. The communication system as in claim 7, wherein the antenna structure has a first resonant frequency, and wherein the communication system has a plurality of resonant frequencies.

11. The communication system as in claim 10, wherein the dimensions and placement of the ground electrode, radiating portion, and shunt inductive element determine the shunt resonance frequency.

12. The communication system as in claim 2, wherein the dimensions and placement of the radiating portion and input portion determine the series resonance frequency.

13. The communication system as in claim 2, further comprising:

a plurality of antenna structures each coupled to at least one switching element, wherein each switching element activates at least one of the plurality of antenna elements in response to a switching control signal, and wherein the at least one switching element is further coupled to a Radio Frequency (RF) transceiver module.

14. The communication system as in claim 13, further comprising:

a pattern shaping circuit to supply a radiation transmission signal to the plurality of antenna structures, wherein the pattern shaping circuit splits a received signal into different antenna feed signals to create a radiation pattern.

15. The system as in claim 14, wherein the pattern shaping circuit generates an amplitude phase combination for each antenna structure.

16. The system as in claim 14, wherein the pattern shaping circuit comprises a phase shifting circuit including a transmission line structure having a series capacitance and a shunt inductance.

17. The system as in claim 16, wherein the phase shifting circuit is a directional coupler.

18. The system as in claim 17, wherein the directional coupler is a multi-port microwave directional coupler, and wherein the phase shifting circuit provides isolation between the plurality of antenna structures.

19. The system as in claim 18, wherein the directional coupler provides offset to at least one antenna feed signal so as to generate an orthogonal radiation pattern set to input portions of multiple antenna structures.

20. The system as in claim 16, wherein the phase shifting circuit comprises an electromagnetic band gap structure.

21. The communication system as in claim 14, further comprising:

a beam switching controller responsive to a feedback control signal from the RF transceiver module to produce the switching control signal, wherein the switching control signal initiates one of a plurality of operating modes, including a Multiple Input Multiple Output (MIMO) operation mode to find directions of multipath links and lock the plurality of antenna structures to generate antenna patterns in these directions.

22. The communication system as in claim 21, wherein the pattern shaping circuit and the beam switching controller are configured to selectively direct at least one radiation transmission signal to at least one antenna structure at a time.

* * * * *

UNITED STATES PATENT AND TRADEMARK OFFICE

CERTIFICATE OF CORRECTION

PATENT NO. : 8,462,063 B2
APPLICATION NO. : 12/849623
DATED : June 11, 2013
INVENTOR(S) : Gummalla et al.

It is certified that error appears in the above-identified patent and that said Letters Patent is hereby corrected as shown below:

On Title page 2, in column 2, Item (56), under "Other Publications", line 3, before "Metamaterials", insert --"--, therefor On Title page 2, in column 2, Item (56), under "Other Publications", line 3-4, delete "Explorations," and insert --Exploration",--, therefor On Title page 2, in column 2, Item (56), under "Other Publications", line 12, delete "(RAWCOM)" and insert --(RAWCON)--, therefor On Title page 2, in column 2, Item (56), under "Other Publications", line 25, delete "D.M., Microwave Engineering," and insert --D. M., "Microwave Engineering",--, therefor On Title page 2, in column 2, Item (56), under "Other Publications", line 27, delete "D.F.," and insert --D. F.,--, therefor On Title page 2, in column 2, Item (56), under "Other Publications", line 37, delete "dated" and insert --mailed--, therefor On Title page 2, in column 2, Item (56), under "Other Publications", line 40, delete "C.J.," and insert --C. J.,--, therefor On Title page 2, in column 2, Item (56), under "Other Publications", line 42, after "218-221", insert --,--, therefor On Title page 2, in column 2, Item (56), under "Other Publications", line 51, before "Korean", insert --"--, therefor On Title page 2, in column 2, Item (56), under "Other Publications", line 52, delete "dated" and insert --mailed--, therefor Signed and Sealed this
Twenty-second Day of April, 2014

Michelle K. Lee

Michelle K. Lee
*Deputy Director of the United States Patent and Trademark Office*

On Title page 2, in column 2, Item (56), under “Other Publications”, line 52, after “2010”, insert --”--, therefor On Title page 2, in column 2, Item (56), under “Other Publications”, line 55, delete “mailed” and insert --filed--, therefor On Title page 3, in column 1, Item (56), under “Other Publications”, line 25, delete “12/270,410 ,” and insert --12/270,410,--, therefor On Title page 3, in column 1, Item (56), under “Other Publications”, line 41, delete “12/785,246 ,” and insert --12/785,246,--, therefor On Title page 3, in column 1, Item (56), under “Other Publications”, line 66, delete “w/ English” and insert --w/English--, therefor On Title page 3, in column 1, Item (56), under “Other Publications”, line 67, delete “response” and insert --Response--, therefor On Title page 3, in column 1, Item (56), under “Other Publications”, line 69, delete “2007800392167,” and insert --200780039216.7,--, therefor On Title page 3, in column 2, Item (56), under “Other Publications”, line 22, delete “Appiication” and insert --Application--, therefor On Title page 3, in column 2, Item (56), under “Other Publications”, line 28, delete “w/Engiish” and insert --w/English--, therefor On Title page 3, in column 2, Item (56), under “Other Publications”, line 30, delete “translation” and insert --Translation--, therefor On Title page 3, in column 2, Item (56), under “Other Publications”, line 36-37, delete “English translation,” and insert --w/English Translation,--, therefor On Title page 3, in column 2, Item (56), under “Other Publications”, line 39, delete “Mailed” and insert --mailed--, therefor On Title page 3, in column 2, Item (56), under “Other Publications”, line 39, delete “Pgs.” and insert --pgs.--, therefor On Title page 3, in column 2, Item (56), under “Other Publications”, line 41, delete “English translation,” and insert --w/English Translation,--, therefor On Title page 3, in column 2, Item (56), under “Other Publications”, line 49-50, delete “English translation,” and insert --w/English Translation,--, therefor On Title page 3, in column 2, Item (56), under “Other Publications”, line 56, delete “2010”.” and insert --2010”,--, therefor On Title page 3, in column 2, Item (56), under “Other Publications”, line 56, delete “translation” and insert --Translation--, therefor On Title page 3, in column 2, Item (56), under “Other Publications”, line 58, delete “translation” and insert --Translation--, therefor On Title page 3, in column 2, Item (56), under “Other Publications”, line 60, delete “with English translation,” and insert --w/English Translation,--, therefor On Title page 3, in column 2, Item (56), under “Other Publications”, line 62, delete “English translation,” and insert --w/English Translation,--, therefor On Title page 3, in column 2, Item (56), under “Other Publications”, line 65, delete “mailedAug.” and insert --mailed Aug.--, therefor On Title page 3, in column 2, Item (56), under “Other Publications”, line 67, delete “Aaction” and insert --Action--, therefor On Title page 3, in column 2, Item (56), under “Other Publications”, line 67-68, delete “English translation,” and insert --w/English Translation,--, therefor On Title page 4, in column 1, Item (56), under “Other Publications”, line 2, delete “English” and insert --w/English--, therefor On Title page 4, in column 1, Item (56), under “Other Publications”, line 6, after “No.”, delete “Korean Application Serial No.”, therefor On Title page 4, in column 1, Item (56), under “Other Publications”, line 7, delete “English” and insert --w/English--, therefor On Title page 4, in column 1, Item (56), under “Other Publications”, line 9, delete ““Taiwan” and insert --“Taiwanese--, therefor On Title page 4, in column 1, Item (56), under “Other Publications”, line 10, delete “maiied” and insert --mailed--, therefor On Title page 4, in column 1, Item (56), under “Other Publications”, line 13, delete “English translation,” and insert --w/English Translation,--, therefor On Title page 4, in column 1, Item (56), under “Other Publications”, line 18, delete “English translation,” and insert --w/English Translation,--, therefor On Title page 4, in column 1, Item (56), under "Other Publications", line 19, delete "maiied" and insert --mailed--, therefor On Title page 4, in column 1, Item (56), under "Other Publications", line 20, delete "translation" and insert --Translation--, therefor On Title page 4, in column 1, Item (56), under "Other Publications", line 31, delete "L," and insert --L.,--, therefor On Title page 4, in column 1, Item (56), under "Other Publications", line 34, delete "S H," and insert --S. H.,--, therefor On Title page 4, in column 1, Item (56), under "Other Publications", line 37, delete "G V," and insert --G. V.,--, therefor On Title page 4, in column 1, Item (56), under "Other Publications", line 41, delete "V," and insert --V.,--, therefor On Title page 4, in column 2, Item (56), under "Other Publications", line 23, delete "Samada. A," and insert --Sanada, A.,--, therefor On Title page 4, in column 2, Item (56), under "Other Publications", line 31, delete "2006." and insert --2006--, therefor On Title page 4, in column 2, Item (56), under "Other Publications", line 34, delete "international" and insert --International--, therefor On Title page 4, in column 2, Item (56), under "Other Publications", line 36, delete "L." and insert --L.,--, therefor On Title page 4, in column 2, Item (56), under "Other Publications", line 40, delete "G," and insert --G.,--, therefor In the Claims In column 28, line 33, in Claim 1, delete "structure, comprising" and insert --structure comprising:--, therefor In column 28, line 58, in Claim 5, delete "claim 3," and insert --claim 4,--, therefor In column 29, line 5, in Claim 9, delete "claim 7," and insert --claim 8,--, therefor In column 29, line 9, in Claim 10, delete "claim 7," and insert --claim 8,--, therefor